US005887217A

United States Patent [19]

Mitekura et al.

[11] Patent Number: 5,887,217

[45] Date of Patent: Mar. 23, 1999

[54] IMAGE FORMING APPARATUS THAT SEARCHES FOR TONER CARTRIDGES IN NEED OF REPLACEMENT

[75] Inventors: Yoshihiro Mitekura, Yokohama; Hiroshi Hosaka; Katsuhiro Kosuge, both of Tokyo, all of Japan

[73] Assignee: Ricoh Company, Ltd., Tokyo, Japan

[21] Appl. No.: 773,766

[22] Filed: Dec. 24, 1996

[30] Foreign Application Priority Data

| | | | |
|---|---|---|---|
| Dec. 25, 1995 | [JP] | Japan | 7-351648 |
| Dec. 31, 1995 | [JP] | Japan | 7-353016 |
| Jan. 11, 1996 | [JP] | Japan | 8-020439 |

[51] Int. Cl.[6] ..... G03G 15/01; G03G 15/08

[52] U.S. Cl. ..... 399/112; 399/27; 399/227

[58] Field of Search ..... 399/27, 28, 226, 399/227, 119, 13, 224, 30

[56] References Cited

U.S. PATENT DOCUMENTS

| | | | |
|---|---|---|---|
| 4,620,783 | 11/1986 | Tanaka et al. | 399/27 |
| 4,916,547 | 4/1990 | Katsumata et al. | 358/300 |
| 5,617,198 | 4/1997 | Ishikawa et al. | 399/27 |

FOREIGN PATENT DOCUMENTS

| | | |
|---|---|---|
| 63-78185 | 4/1988 | Japan . |
| 1-166065 | 6/1989 | Japan . |
| 2-257167 | 10/1990 | Japan . |
| 3-160484 | 7/1991 | Japan . |
| 6-250482 | 9/1994 | Japan . |
| 07295374 A | 11/1995 | Japan . |
| 7-295374 | 11/1995 | Japan . |
| 7-306582 | 11/1995 | Japan . |

*Primary Examiner*—Joan Pendegrass

*Attorney, Agent, or Firm*—Oblon, Spivak, McClelland, Maier & Neustadt, P.C.

[57] ABSTRACT

In an image forming apparatus, a rotary developing device or revolver has a plurality of developing sections each storing a developer of particular color thereinside. The revolver is rotatable to sequentially move the developing sections to a preselected developing position so as to develop toner images sequentially formed on an image carrier. Toner cartridges are each removably mounted to the respective developing section. Only one of the cartridges located at a preselected replacing position can be pulled out and replaced. A toner cartridge is prevented from being accidentally mounted to the developing section located at the replacing position and whose cartridge has already been replaced.

18 Claims, 57 Drawing Sheets

| CURRENT COLOR AT REPLACING POSITION / TARGET COLOR | K | C | M | Y |
|---|---|---|---|---|
| BLACK (K) | 180° | 270° | 0° | 90° |
| CYAN (C) | 90° | 180° | 270° | 0° |
| MAGENTA (M) | 0° | 90° | 180° | 270° |
| YELLOW (Y) | 270° | 0° | 90° | 180° |

| COLOR AT REPLACING POSITION | COLOR AT DEVELOPING POSITION |
|---|---|
| BLACK (K) | M |
| CYAN (C) | Y |
| MAGENTA (M) | K |
| YELLOW (Y) | C |

START
292
MODE DIFFERENT FROM EXISTING ONE ?
NO
YES
301
FULL-COLOR MODE ?
NO
YES
302
RED MODE?
NO
YES
303
GREEN MODE?
NO
YES
304
BLUE MODE ?
NO
YES
308
FULL-COLOR MODE MOVEMENT
309
RED MODE MOVEMENT
310
GREEN MODE MOVEMENT
311
BLUE MODE MOVEMENT
END
AO

IMAGE FORMING APPARATUS THAT SEARCHES FOR TONER CARTRIDGES IN NEED OF REPLACEMENT

BACKGROUND OF THE INVENTION

The present invention relates to a copier, facsimile apparatus, printer or similar image forming apparatus using, e.g., a rotary developing device having a plurality of developing sections and sequentially moving the developing sections to develop latent images electrostatically formed on an image carrier with developers of different colors.

Image forming apparatuses of the type described include one having a rotary developing device, or revolver as often referred to, adjoining a photoconductive drum or similar image carrier. The revolver has a plurality of developing sections arranged in preselected positions inside of a rotary body. While latent images are sequentially formed on the drum, the developing sections are sequentially moved to a preselected developing position to develop the latent images with toner of different colors. In a color image forming apparatus, for example, the developing sections of the revolver usually store black toner and toner of three complementary primary colors, i.e., cyan, magenta, and yellow, respectively.

Today, there is an increasing demand for a space-saving developing device capable of implementing a miniature image forming apparatus. The revolver is one of measures for meeting the above demand. To further save space, there has been proposed a revolver omitting tubings communicating toner cartridges each storing toner of particular color and developing sections, and positioning the cartridges in the vicinity of the developing sections. In this kind of revolver, every time the color for development is switched, the developing section storing the toner of necessary color is brought to a stop at the developing position. At the same time, the other developing sections are each brought to a stop at a particular position. The replenishment of toner from each cartridge to the associated developing section is effected via an opening provided at the portions of the cartridge and developing section joining each other. Because a single position is available for the above opening to be so oriented as not to fall the toner in the event of replacement of the cartridge, only one cartridge can be replaced at a time in the event of replenishment.

When any one of the toner cartridges runs out of toner, it is replaced with a new toner cartridge. After the replacement of the cartridge, a toner content in the developing section associated therewith must be restored to the original content, so that images can be formed with stable density even just after the replacement. A recovery operation for the restoration of the toner content is under study. For example, a discharge lamp or quenching lamp QL, a main charger, a bias for development and so forth are sequentially turned on in order to form a preselected pattern for density measurement on the photoconductive drum. The preselected pattern is read by an optical sensor for sensing density. The toner is repeatedly replenished from the toner cartridge to the developing section until an adequate toner content has been set up in the developing section. Then, the main charger, bias for development, QL and so forth are sequentially turned off, and the drum is brought to a stop. The procedure from the rotation of the drum to the formation of the density pattern will be referred to as pre-rotation processing. Also, the procedure from the formation of the density pattern to the establishment of the adequate toner content will be referred to as recovery processing. Further, the procedure from the end of the replenishment to the stop of the drum will be referred to as post-rotation processing. The pre- and post-rotation processing each needs a certain period of time because it continues until the surface of the drum reaches a stable state.

It has also been proposed to use toner sensing means for determining whether or not the toner is present in each toner cartridge either directly or indirectly, and reporting means for urging, based on the output of the sensing means, the operator to replace the cartridge needing replacement.

However, the conventional revolver has some problems yet to be solved, as follows.

[Problem 1]

The revolver is so constructed as to allow only one toner cartridge located at the replacing position to be replaced. Therefore, if the cartridge reached a toner end or toner near end condition is not located at the replacing position in the event of replenishment, the operator must move the cartridge to the replacing position by hand. Particularly, it is difficult to rotate conventional revolvers by hand, so that an implementation capable of enhancing efficient replenishment is desired.

[Problem 2]

Assume that the recovery operation is performed every time a cartridge is replaced. Then, the pre-rotation processing, recovery processing and post-rotation processing are repeated each time. When a plurality of cartridges are replaced, the above procedure restricts the operator to the apparatus until the replacement of the last cartridge completes, resulting in low operation efficiency. Further, such a procedure effected with a plurality of cartridges increases the overall recovery time and causes the operator to wait a long period of time up to the start of image formation. Moreover, when any one of the cartridges is replaced while a power switch provided on the apparatus is in its OFF state, which cartridge has been replaced cannot be seen when the power switch is turned on. Executing the recovery operation with all the cartridges, including even those not replaced, is wasteful. This would also causes the operator to wait a long period of time up to the start of image formation.

[Problem 3]

Assume that the previously mentioned reporting means ends a report after the recovery operation has been completed. Then, because a certain period of time is necessary between the replacement of the cartridge and the end of the recovery operation, the operator is likely to inadvertently replace the cartridge associated with the same developing section twice during, e.g., recovery operation following the replacement. This is particularly true when the person replaced the cartridge leaves the apparatus, and another person uses the apparatus. Such repeated replacement simply wastes labor. In addition, it is likely that the toner existing at the portion where the cartridge and revolver join each other flies about.

[Problem 4]

Assume that any one of the cartridges is absent on the revolver. Then, the rotation of the revolver is likely to cause the toner to fly about from the portion where the revolver is expected to join the above cartridge. For example, assume that the apparatus has a cover member which the operator may open and close for the replacement of the cartridge. Then, when the operator opens the cover member, the rotation of the revolver is stopped for safety operation. When the cover member is again closed, the revolver may be rotated for homing. Alternatively, while the cover member is open, the revolver may be rotated for the recovery operation. In such a case, if any cartridge is absent, the toner flies about from the above portion during the rotation of the revolver.

[Problem 5]

Assume that cartridge sensing means responsive to the cartridge is located at a preselected position on a path along which the revolver moves the cartridges, and that when the operator opens the cover member for replacement, the rotation of the revolver is stopped for safety operation. Then, the cartridge sensing means is apt to operate erroneously. Specifically, it occurs that when the revolver in rotation is stopped for the safety purpose due to the opening of the cover member, no cartridges exist at the above preselected sensing position despite that all the cartridges are present on the revolver. If the revolver is stopped at such a position, the sensing means does not sense any cartridge despite that all the cartridges are present. As a result, if the apparatus operates on condition that the sensing means senses the cartridge, the apparatus will remain inoperative.

[Problem 6]

The erroneous operation of the sensing means stated above also occurs when the revolver is stopped due to the turn-off of the power switch.

[Problem 7]

The recovery operation is executed, based on a preselected criterion, when the cartridge is determined to have been replaced. It is likely, depending on the criterion, that the cartridge is determined to have been replaced despite that it has not been replaced, resulting in wasteful recovery operation. Specifically, assume that the cartridge is determined to have been replaced if it is in the toner end or toner near end condition when the cover member is opened and closed by the operator for replacement. Then, the recovery operation occurs even when the operator simply opens and closes the door without replacing the cartridge.

SUMMARY OF THE INVENTION

It is therefore an object of the present invention to provide an image forming apparatus allowing the operator to replace a plurality of toner cartridges efficiently.

It is another object of the present invention to provide an image forming apparatus capable of reducing the overall recovery time in the event of replacement of a plurality of toner cartridges.

It is another object of the present invention to provide an image forming apparatus capable of reducing the overall recovery time even when a toner cartridge is replaced while the power switch of the apparatus is in its OFF state.

It is another object of the present invention to provide an image forming apparatus capable of preventing a toner cartridge assigned to any developing section from being replaced twice by accident.

It is another object of the present invention to provide an image forming apparatus capable of inhibiting cartridge moving means from operating when any toner cartridge is absent.

It is another object of the present invention to provide an image forming apparatus capable of preventing cartridge sensing means, located at a preselected position on a path along which cartridge moving means moves toner cartridges, from operating erroneously due to the opening of a cover member which may occur while toner cartridges are in movement.

It is another object of the present invention to provide an image forming apparatus capable of preventing the above cartridge sensing means from operating erroneously due to the turn-off of a power switch which may occur while toner cartridges are in movement.

It is another object of the present invention to provide an image forming apparatus capable of making an accurate decision on the replacement of a toner cartridge.

In accordance with the present invention, an image forming apparatus includes a plurality of developing sections supported to be movable integrally with each other. A plurality of toner cartridges are respectively removably mounted to the developing sections, and each stores toner to be replenished to the respective developing section. Only one of the toner cartridges located at a preselected replacing position is replaceable. A searching section searches for at least one of the toner cartridges needing replacement. A moving device moves preselected one of the toner cartridges to the replacing position. A control circuit causes, at the end of image formation, the searching section to search for the toner cartridge needing replacement, and causes the moving device to move the toner cartridge needing replacement to the replacing position.

Also, in accordance with the present invention, an image forming apparatus includes a plurality of developing sections supported to be movable integrally with each other. A plurality of toner cartridges are respectively removably mounted to the developing sections, and each stores toner to be replenished to the respective developing section. Only one of the toner cartridges located at a preselected replacing position is replaceable. A color mode receiving section receives the input of any one of a plurality of color modes each designating a particular color. A searching section searches for at least one of the toner cartridges needing replacement. A moving device moves preselected one of the toner cartridges to the replacing position. A control circuit causes, when the color mode receiving section receives the input of preselected one of the color modes, the searching section to search for one of the toner cartridges to be used in the color mode input, and causes the moving device to move the toner cartridge searched for to the replacing position.

Further, in accordance with the present invention, an image forming apparatus includes a plurality of developing sections supported to be movable integrally with each other. A plurality of toner cartridges are respectively removably mounted to the developing sections, and each stores toner to be replenished to the respective developing section. A recovery executing section restores the toner content of any one of the developing sections to a preselected toner content. After at least two of the toner cartridges have been replaced, a recovery operation is continuously executed with the at least two developing sections.

BRIEF DESCRIPTION OF THE DRAWINGS

The above and other objects, features and advantages of the present invention will become apparent from the following detailed description taken with the accompanying drawings in which:

FIG. 40 is a flowchart showing a procedure included in the eighth embodiment for executing the recovery operation when a power switch is turned on;

FIG. 43 is a flowchart showing how a replacement recognition flag included in the procedure of FIG. 41 is dealt with;

FIG. 45 is a flowchart showing how a revolver movement flag included in the control of FIG. 44 is dealt with; and FIG. 46 is a flowchart showing a specific control procedure to be executed in the eighth embodiment when the power switch is turned on.

DESCRIPTION OF THE PREFERRED EMBODIMENTS

Preferred embodiments of the image forming apparatus in accordance with the present invention will be described. The embodiments are implemented as an electrophotographic color printer by way of example.

Figure 1:
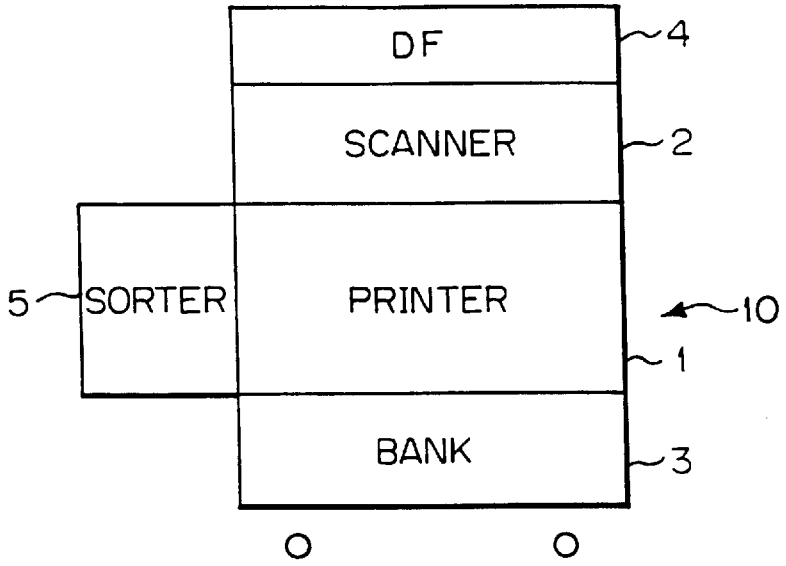
FIG. 1 is a block diagram schematically showing the basic construction of a printer in accordance with the present invention.

First, a reference will be made to FIG. 1 for describing the basic construction of the color printer. As shown, the printer, generally 10, is generally made up of a printer 1, a scanner 2, a sheet feed device or bank 3, a document feeder (DF) 4, and a sorter 5. The printer 1 performs color image formation based on an electrophotographic process. The scanner 2 transfers image data read out of a document to the printer 1. The bank 3 feeds sheets to the printer 1. The DF 4 feeds documents to the scanner 2. The sorter 5 sorts o r otherwise deals with the sheets driven out of the printer 1. As for the overall configuration, the printer 10 is substantially identical with this type of conventional printer.

Figure 2:
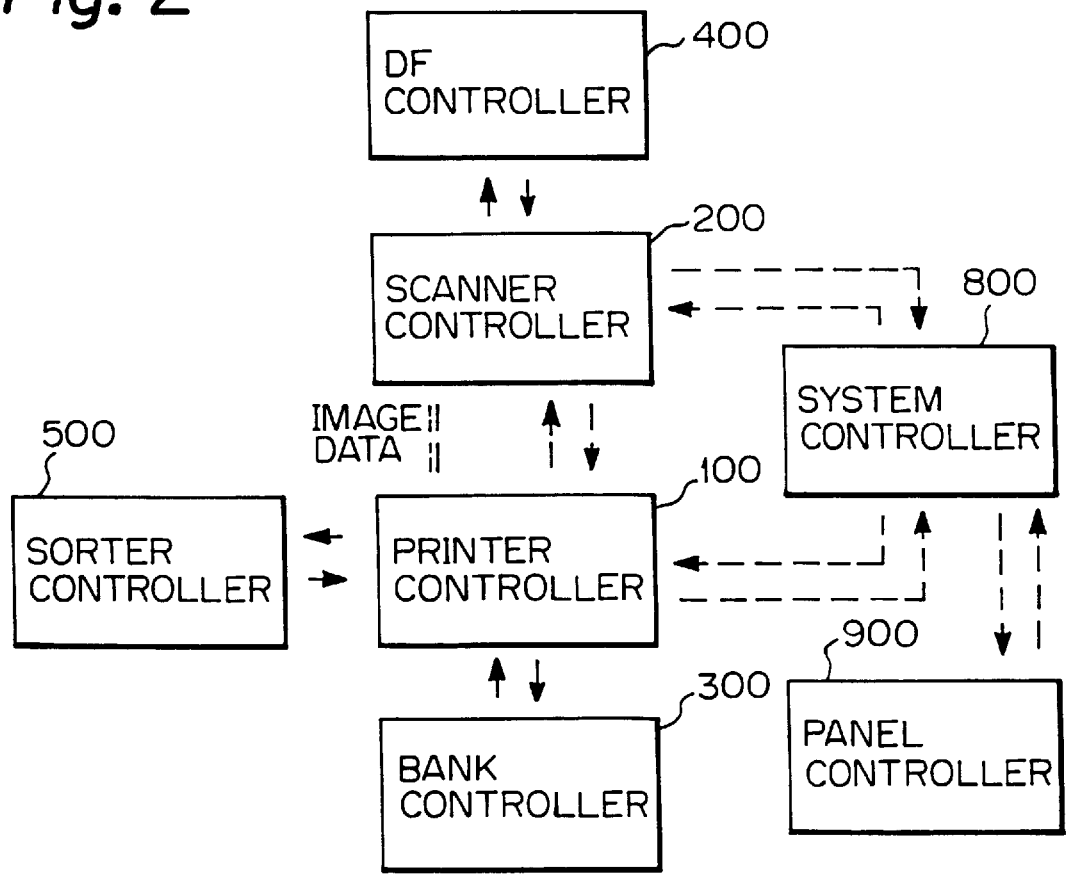
FIG. 2 is a block diagram schematically showing a control system included in the printer of FIG. 1.

FIG. 2 shows a control system built in the printer 10. As shown, the control system has a printer controller 100, a scanner controller 200, a bank controller 300, a DF controller 400, and a sorter controller 500 respectively assigned to the associated sections of FIG. 1. Also shown in FIG. 2 are a system controller 800 and a panel controller 900.

The printer controller 100 controls an electrophotographic process sequence and sheet transport processing. The printer controller 100 is connected to the bank controller 300 and sorter controller 500 by optical fiber serial communication, and executes control in response to preselected commands in unison with image formation. The scanner controller 200 controls the reading of image data out of a document and image processing. The scanner controller 200 is connected to the DF controller 400 by optical fiber serial communication, and controls a document feed sequence in response to preselected commands.

The system controller 800 controls the entire system of the printer 10. The system controller 800 hands over image forming conditions to the printer controller 100 and scanner controller 200 in response to commands input from the operation panel controller 900. In addition, the system controller 800 controls the statuses of the entire system and outputs display commands. The system controller 800 is connected to the various controllers by optical fiber serial communication. The panel controller 900 hands over commands input by the operator to the system controller 800, and displays the statuses of the system and messages in response to commands output from the system controller 800.

The register of image components of different colors and the register of a paper and an image should each be extremely accurate. In light of this, the printer controller 100 and scanner controller 200 are connected to each other by optical serial communication, so that sequence control can be directly executed. Also provided in the control system is a data bus which allows image data to be directly transferred from the scanner controller 200 to the printer controller 100.

Figure 3:
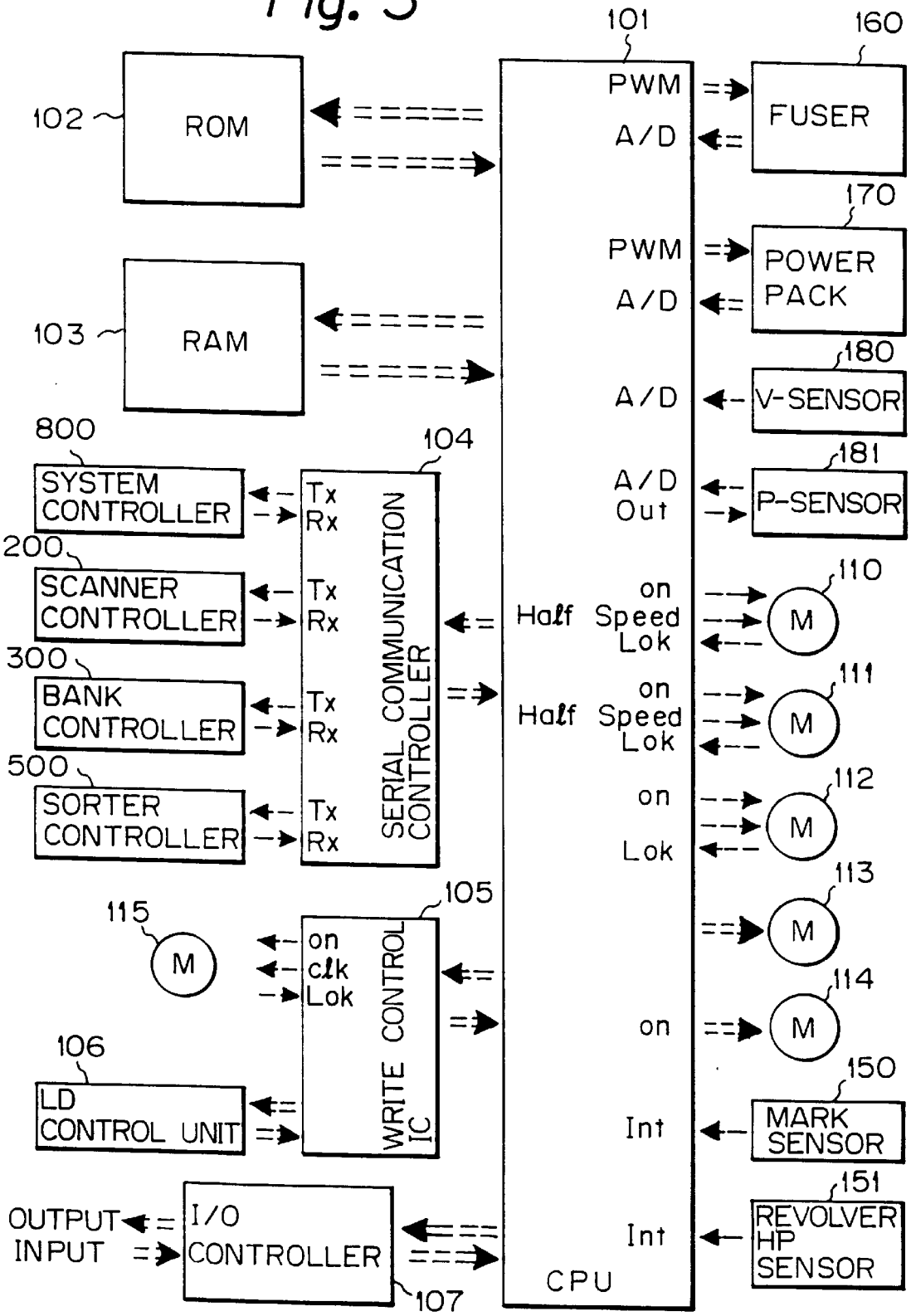
FIG. 3 is a block diagram schematically showing a printer controller included in the control system of FIG. 1 in detail.

FIG. 3 shows the printer controller 100 in detail. As shown, functions assigned to the printer controller 100 are implemented by a CPU (Central Processing Unit) 101, a ROM (Read Only Memory) 102, a RAM (Random Access Memory) 103, a serial communication controller 104, a write control IC (Integrated Circuit) 105, an LD (Laser Diode) control unit 106, an I/O (Input/Output) controller 107, and various kinds of sensors. These constituents of the printer controller 100 will be described specifically hereinafter.

The CPU 101 computes and executes the contents of a program and controls the entire printer controller 100. The CPU 101 searches for a toner cartridge to be replaced and moves a revolver to bring the cartridge to a preselected replacing position in accordance with a flowchart which will be described. The ROM 102 stores a control program while the RAM 103 stores and saves data. The CPU 101 and each of the the ROM 102 and RAM 103 are interconnected by a data bus and an address bus. The serial communication controller 104 interchanges commands with the scanner controller 200, bank controller 300, sorter controller 500 and system controller 800 shown in FIG. 2, and is connected to the CPU 101 by a data bus and an address bus. The write control IC 105 controls exposure, i.e., the LD control unit 106 and a polygon motor 115. The I/O controller 107 controls the input and output between the various sections of the printer and the CPU 101.

A fixing unit or fuser 160 performs PWM (Pulse Width Modulation) output for controlling a heater, not shown, on the basis of the digitized output of a thermistor, not shown. A power pack unit 170 performs PWM control over the output of a power pack, not shown, on the basis of the digitized output of the power pack fed back thereto. The power pack unit 170 outputs a bias, DC bias and AC bias for development as well as voltages to be applied to a main charger, charge grid, belt transfer charger, and sheet transfer charger which will be described later. An electrometer circuit or V-sensor 180 senses the surface potential of a photoconductive drum which will be described. The output of the V-sensor 180 is connected to an A/D (Analog-to-Digital) input included in the CPU 101. An optical sensor circuit or P-sensor 181 is responsive to the amount of toner deposited on the photoconductive drum. A phototransistor included in the P-sensor 181 delivers its output to another A/D input of the CPU 101. The PWM output of the CPU 101 is connected to a driver for driving an LED (Light Emitting Diode) also included in the P-sensor 181.

A main motor 110 drives a sheet transport system built in the printer. A drum motor 111 drives the photoconductive drum and an intermediate transfer belt which will be described later. Further, a development motor 112 drives developing sleeves which will also be described. The CPU 101 sends an ON signal and a half-speed signal for halving a rotation speed to each of the motors 110–112. In addition, each of the motors 110–112 sends to the CPU 101 a constant rotation signal (Lok) showing that the motor has reached a target rotation speed. A revolver motor 113 drives the revolver having developing sections which will be described. The CPU 101 sends a four-phase output thereof to the revolver motor 113 in order to bring a necessary color for development to a preselected developing position. A replenishment motor 114 is used to replenish toner from a toner cartridge to a developing section associated therewith. The ON time of the motor 114 is controlled in accordance with the amount of toner deposition.

A mark sensor 150 senses a reference mark provided on the intermediate transfer belt as a reference for color register. Because the output of the mark sensor 150 should be extremely accurate in timing, it is connected to an interrupt input (Int) included in the CPU 101. A revolver home position (HP) sensor 151 is responsive to a revolver home position which is the reference stop position of the revolver. The output of the HP sensor 151 is connected to another interrupt input (Int) of the CPU 101 because the output pulse must be switched while the revolver is in rotation.

Figure 4:
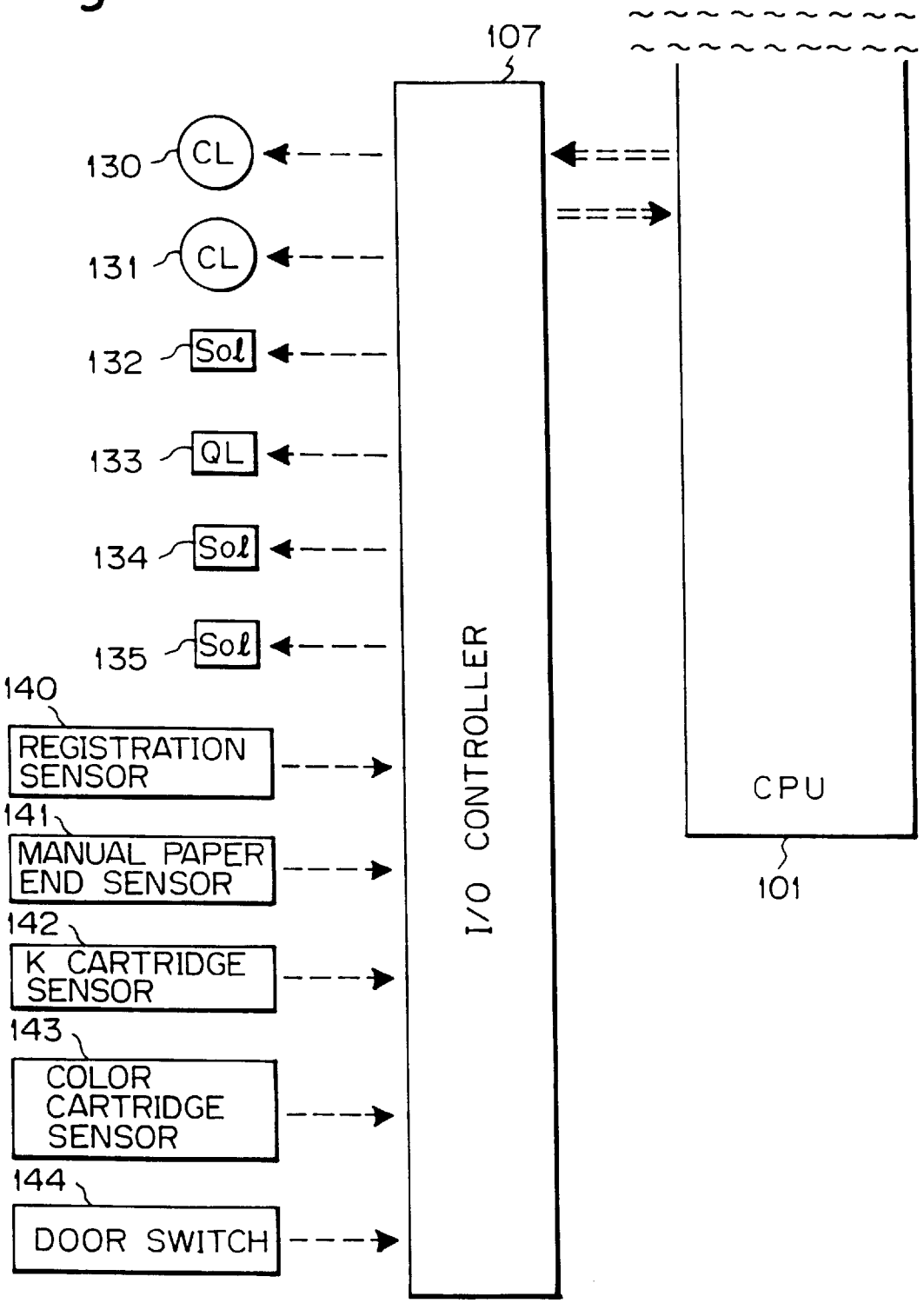
FIG. 4 is a block diagram schematically showing a relation between an I/O (Input/Output) controller shown in FIG. 3 and peripheral units.

FIG. 4 shows a relation between the I/O controller 107 and various peripheral units. As shown, the I/O controller 107 delivers it outputs to a registration clutch (LC) 130, a manual insertion clutch CL 131, a manual insertion pick-up solenoid 132, a discharge lamp 133, a solenoid 134 for the selective contact of the intermediate transfer belt, a solenoid 135 for lubricant application, etc. The I/O controller 107 receives the outputs of a registration sensor 140, a manual insertion paper end sensor 141, a paper egress sensor, a black cartridge sensor 142, a color cartridge sensor 143, a door switch 144 responsive to the open/close position of a door mounted on the printer body, etc.

The essential arrangement of the printer 1 will be described with reference to FIG. 5. As shown, the printer 1 is generally made up of a photoconductive drum or image carrier 11, a revolver or developing device 20, an intermediate transfer belt 30, and a writing unit or laser optics 40.

Arranged around the drum 11 are a discharge lamp or quenching lamp (QL) 18, a main charger (CH) or charging means 12, an electrometer 13, an optical sensor 14, a pretransfer Lamp (PTL) 15, a belt transfer charger 16, and a drum cleaner 17. The QL 18 dissipates charge remaining on the drum 11 after image transfer. The electrometer 13 measures the surface potential of the drum 11. The sensor 14 reads the density of an image formed on the drum 11. The PTL 15 lowers the surface potential of the drum 11 before image transfer. The belt transfer charger 16 deposits positive charge on the belt 30. The drum cleaner 17 removes toner left on the drum 11 after image transfer. Both the drum 11 and belt 30 are driven by the drum motor 111 shown in FIG. 3.

The revolver 20 contacting the drum 11 has its interior partitioned into four compartments or developing sections 21Y, 21M, 21C and 21K. Letters Y, M, C and K stand for yellow, magenta, cyan and black, respectively. The developing sections 21Y, 21M, 21C and 21K support rotatable developing sleeves 22Y, 22M, 22C and 22K, respectively. The sleeves 22 are each driven by the development motor 112 shown in FIG. 3. Toner cartridges, not shown, each storing toner of particular color are removably held in the developing section 21K, 21C, 21M or 21Y, respectively. Specifically, each toner cartridge is positioned in close proximity to the associated developing section and movable in interlocked relation to the developing section. The developing position assigned to the revolver 20 is located between the potential sensor 13 and the optical sensor 14 with respect to the periphery of the drum 11. In FIG. 5, the revolver 20 is shown as having its developing section 21K located at the developing position by way of example. The revolver 20 is rotated by the revolver motor 113, FIG. 3, in the direction indicated by an arrow C. The CPU 101, FIG. 3, controls the rotation of the revolver motor 113 with its four-phase output, so that a necessary color for development is brought to the developing position. The revolver HP position 151 senses the home position of the revolver 20, as stated earlier.

The writing unit 40 includes a polygonal mirror 116 rotated by a polygon motor 115, an f-θ lens 117, and a mirror 118. A laser beam issuing from an LD, not shown, is steered by the polygonal mirror 116, passed through the f-θ lens 117, reflected by the mirror 118, and then incident to the surface of the drum 11 uniformly charged by the main CH 12. The position where the laser beam is incident to the drum 11 is between the main CH 12 and the electrometer 13.

Arranged around the intermediate transfer belt 30 are the mark sensor 150, a lubricant application unit 32, a sheet transfer charger 33, and a belt cleaner 34. The mark sensor 150 senses a mark, not shown, provided on the inner periphery of the belt 30 and serving as a reference for color register. The lubricant application unit 32 applies a lubricant to the belt 30. The sheet transfer charger 33 transfers an image transferred from the drum 11 to the belt 30 to a sheet, not shown. The belt cleaner 34 removes toner remaining on the belt 30. During image formation, the belt 30 and drum 11 contact each other at the position where the belt transfer charger 16 is located. When two rollers 119 and 120 are shifted, the belt 30 is released from the drum 11, as indicated by a dotted line in FIG. 5. The belt 30 has a circumferential length greater than the sum of a maximum image size and the pattern area of the optical sensor (including a distance to the trailing edge of an image, and a margin of the pattern length). A belt cleaner solenoid, not shown, selectively brings the belt cleaner 34 into and out of contact with the belt 30. Likewise, a lubricant solenoid, not shown, selectively brings the lubricant application unit 32 into and out of contact with the belt 30.

A registration roller 50 and registration sensor 140 are positioned upstream of the sheet transfer charger 33 with respect to the direction of sheet transport. A conveyor belt 51 and a fixing unit, not shown, are located downstream of the transfer charger 33 with respect to the above direction. The registration roller 50 and conveyor belt 51 as well as a fixing roller, not shown, are driven by the main motor 110, FIG. 3. Further, the registration roller 50 is turned on and turned off by the registration clutch 130, FIG. 4.

Figure 5:
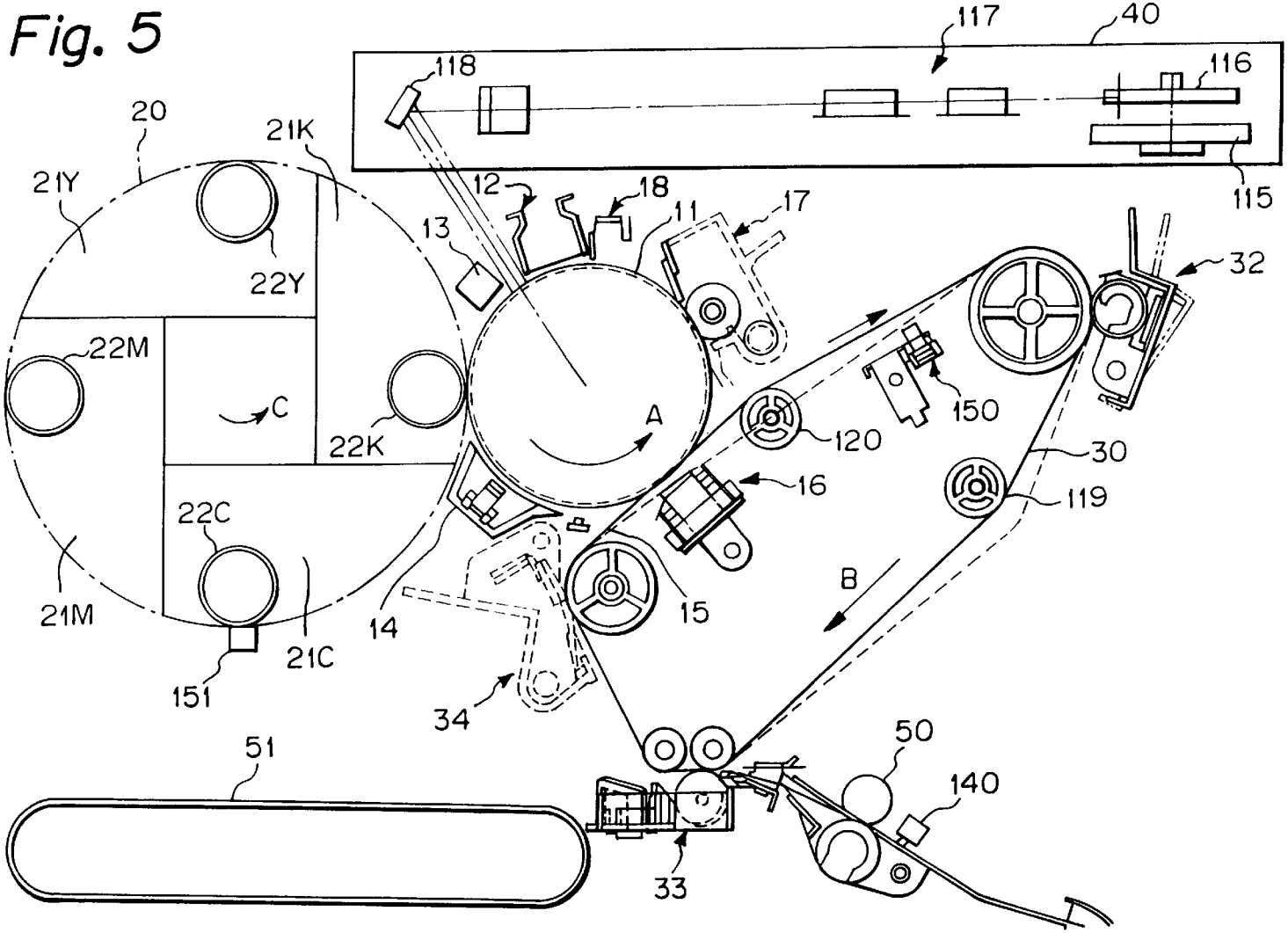
FIG. 5 shows an essential part of a printer section included in the printer of FIG. 1.

In the construction shown in FIG. 5, the drum 11 rotates in a direction A while having its surface uniformly charged by the main CH 12. The writing unit 40 scans the charged surface of the drum 11 in accordance with image data so as to form an electrostatic latent image thereon. The image data will be black image data in the case of monocolor printing or will be yellow, magenta, cyan and black image data derived from a full-color image in the case of full-color printing. The latent image formed on the drum 11 is developed by yellow, magenta, cyan or black toner by the revolver 20 to turn out a corresponding toner image.

The toner images of different colors, i.e., yellow, magenta, cyan and black toner images sequentially formed on the drum 11 by the above procedure are sequentially transferred to the intermediate transfer belt 30 one above the other. The belt 30 is rotating in the direction indicated by an arrow B. The resulting composite image or full-color image is transferred from the belt 30 to a sheet by the sheet transfer charger 33. The sheet is fed from a tray, not shown, by a pick-up roller, not shown, via the registration roller 50. The sheet with the full-color image is conveyed by the conveyor belt 51 to the fixing roller, not shown. After the fixing roller has fixed the toner image on the sheet, the sheet is driven out of the copier as a full-color printing.

The toner remaining on the drum 11 after the i mage transfer is is removed by the drum cleaner 17. Likewise, the toner left on the belt 30 is removed by the belt cleaner 34.

An image forming sequence will be described with reference to FIGS. 6–8. In timing charts to be described, it is assumed that any one of the developing sections 21Y–21K is held at the developing position. "FGATE" appearing in the timing charts refers to an image data gate signal; while the image data gate signal in its ON state, image data are continuously written to the drum 22. Further, in the following description, constituents correspond the constituents shown in the timing charts are indicated by parenthesis.

First, a monocolor image forming sequence will be described with reference to FIG. 6. FIG. 6 demonstrates a specific case wherein two black-and-white printings of size A4 (vertically long) are output.

On receiving a start signal (a) from the system controller 800, the CPU 101, FIG. 3, turns on the QL 18 and drum motor 111 (g, b). When the start position (discharged portion) of the drum 11 reaches a charging position assigned to the main CH 12, the CPU 101 turns on the main CH 12 (h). Further, when the charged portion of the drum 11 arrives at the developing position, the CPU 101 turns on the DC and AC biases and development motor 112 (i, j, k). As soon as the position on the drum 11 where the biases for development have been turned on arrives at a belt transfer position assigned to the intermediate transfer belt 30, the CPU 101 turns on the belt transfer charger (n). The above procedure is the pre-rotation of the drum 11. If the color of the developing unit held at the developing position is different from a necessary color, then the revolver 20 is rotated after the turn-on of the DC and AC biases, until the necessary color has been brought to the developing position. In this case, the procedure up to the rotation of the revolver 20 is the pre-rotation.

If the exposing position of the drum 11 has been charged by the pre-rotation, then the drum 11 is ready to form a latent image thereon. The CPU 101 sends a lamp ON and scanner start command (d) to the scanner controller 200, FIG. 3, in order to cause it to output image data after the above timing. When an image is scanned, the resulting image data are transferred from the scanner control section 200 to the write control IC 105, FIG. 3. The write control IC 105 converts the image data to exposure data and controls the LD control unit 106 and motor 115. As a result, a latent image is electrostatically formed on the drum 11 (e).

The latent image on the drum 11 is developed by the developing section 21 of the revolver 20 to turn out a corresponding toner image. The toner image is transferred from the drum 11 to the belt 30 by the transfer charger 16. Before the toner image on the belt 30 arrives at the sheet transfer position, the CPU 101 turns on the sheet transfer charger 33 (o) with the result that the toner image is transferred from the belt 30 to the sheet. Specifically, the sheet is once brought to a stop with its leading edge abutting against the registration roller 50, FIG. 5. The registration clutch 130, FIG. 4, is turned on (r) at such a timing that the leading edge of the sheet meets the leading edge of the toner image at the sheet transfer position. The sheet with the toner image is conveyed to the fixing unit by the conveyor belt 140, FIG. 4, as stated earlier.

When the CPU 101 determines that the transfer of the toner image from the belt 30 to the sheet is not followed by any image formation, it turns off the transfer charger 16 (n). Subsequently, the CPU 101 turns off the main CH 12 when the position on the drum 11 where the belt transfer charger 1 6 has been turned off arrives at the main CH 12. When such a position on the drum 11 reaches the developing position, the CPU 101 turns off the DC and AC biases for development and motor 112 (i, j, k). At this time, the CPU 101 conditions the mark sensor 150, FIG. 5, for the detection of the reference mark (c). After the mark sensor 150 has sensed the reference mark, the CPU 101 continuously turns on the drum motor 111 (b) until the reference mark has been brought to a preselected position. The CPU 101 turns off the QL 18 (g) at the same time as it turns off the drum motor 111.

After the exposure of the drum 11, the CPU 101 turns on the optical sensor 14 and optical sensor LED, not shown, (f, l). Also, before turning on the sheet transfer charger 33, the CPU 101 turns on the PTL 15 (m). However, the CPU 101 holds the belt cleaner 34 in contact with the belt 30 (p) and does not turn on the revolver motor 113, FIG. 3, (q).

Figure 6:
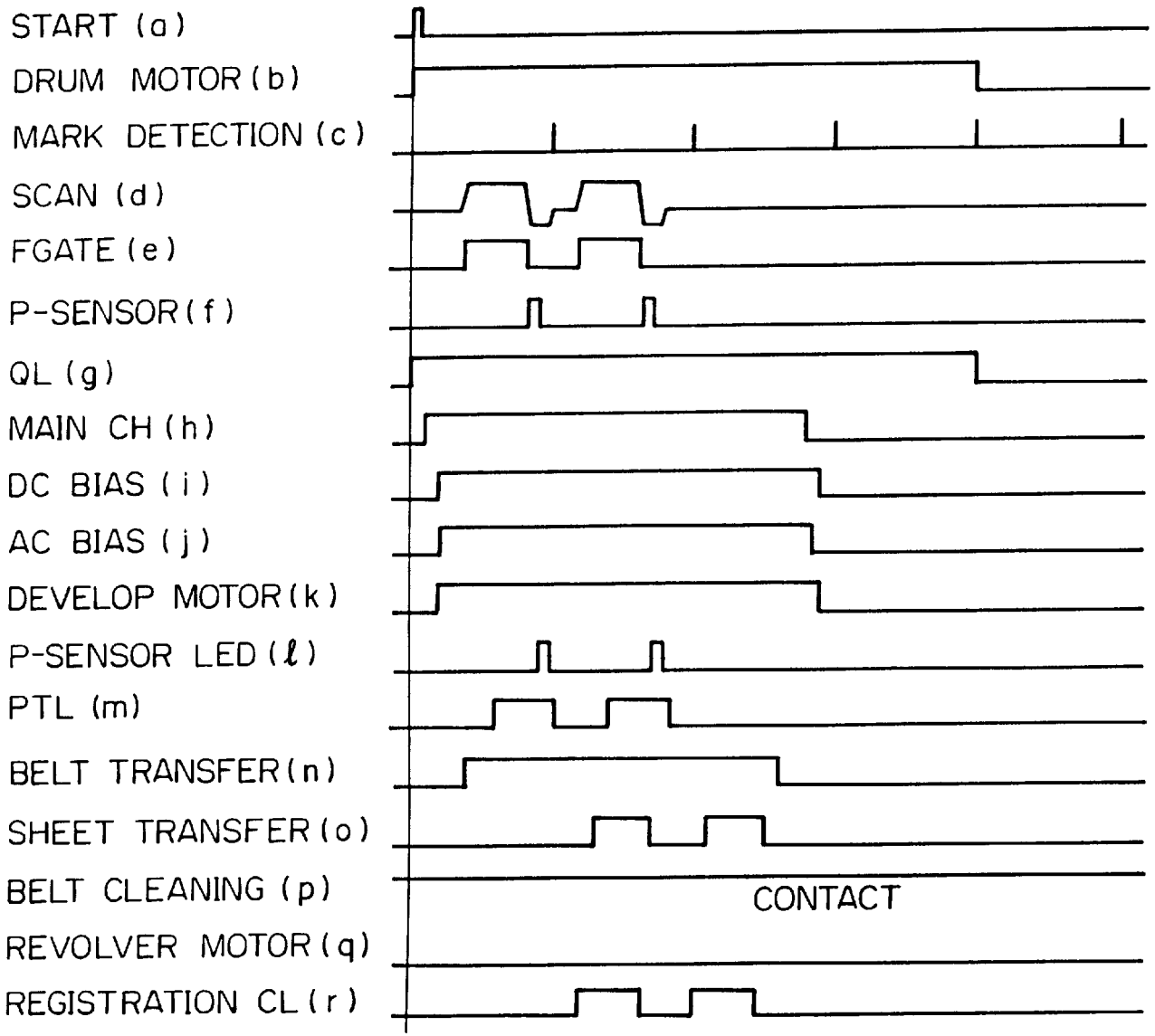
FIG. 6 is a timing chart showing a specific operation in which two black-and-white printings of size A4 are output.
Figure 7:
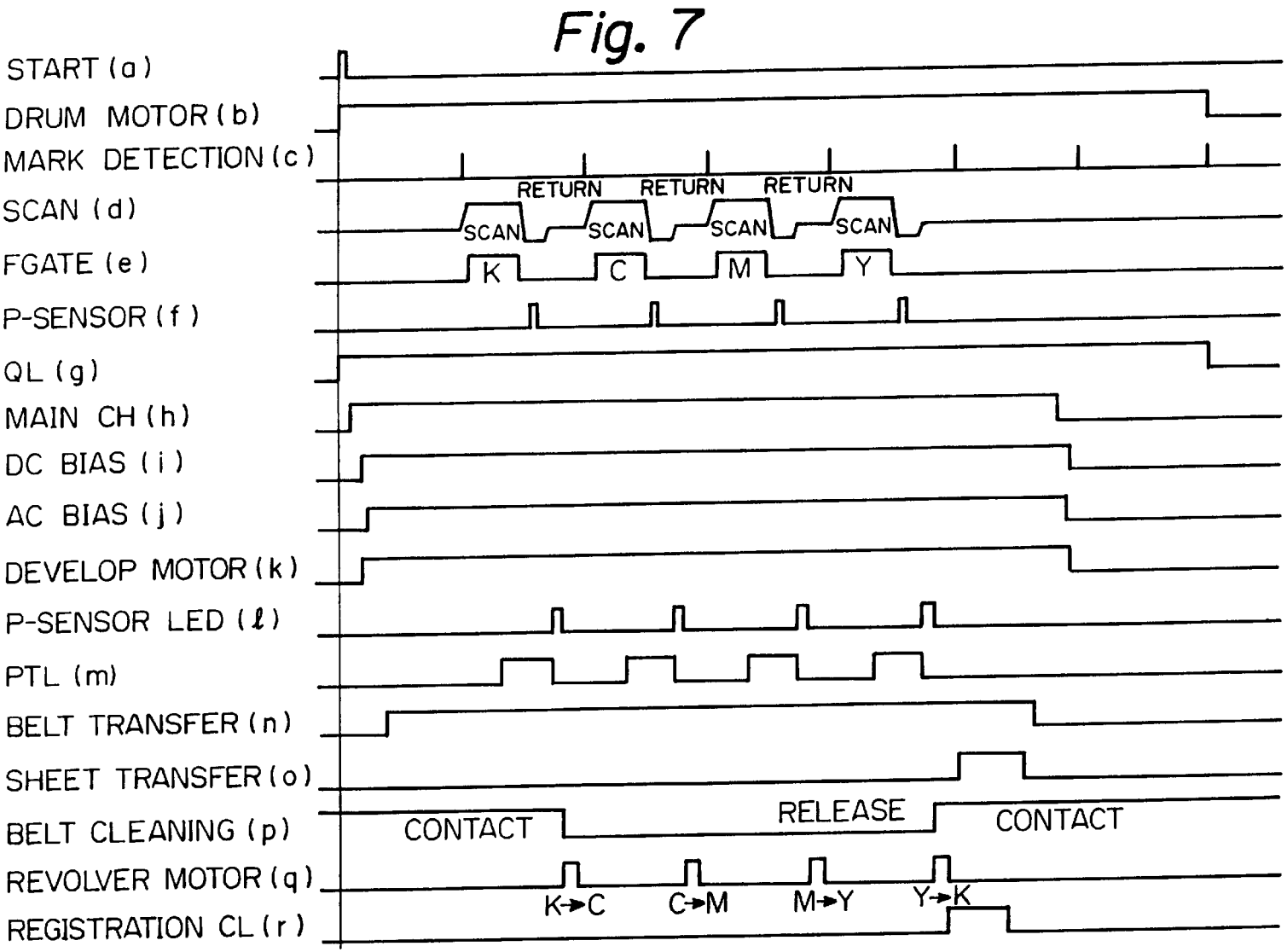
FIG. 7 is a timing chart showing another specific operation in which a single full-color printing of size A4 is output.

FIG. 7 demonstrates a full-color image forming sequence. The part of the sequence identical with the sequence shown in FIG. 6 will not be described in order to avoid redundancy. In the following description, assume that a single full-color printing of size A4 (vertically long) is produced.

The control up to the pre-rotation is the same as in the monocolor printing shown in FIG. 6. In the full-color sequence, the color for development is sequentially switched during image formation. Assume that the drum motor 111 is turned on to rotate the belt 30 until the mark sensor 150 senses the reference mark (c). Then, the CPU 101 executes interrupt processing because the output of the mark sensor 150 is connected to the interrupt terminal of the CPU 101. In the interrupt processing, the CPU 101 sends a scan start command meant for a first color (K) to the scanner controller 200 (d). After the developing section 21K has developed a latent image of the first color (K) formed on the drum 11, the resulting toner image is transferred to the belt 30. Subsequently, the CPU 101 causes the revolver 20 to rotate (q) until the developing section 21C assigned to a second color (C) has been brought to the developing position. After the transfer of the toner image from the drum 11 to the belt 30, the CPU 101 releases the belt cleaner 34 from the belt 30 (p) so as not to erase the toner image.

When the mark sensor 150 again senses the reference mark (c), the CPU 101 sends a scan start command means for the second color (C) to the scanner controller 200 (d). After a latent image of the second color (C) has been formed on the drum 11, it is developed by the developing section 21C. The resulting toner image is transferred from the drum 11 to the belt 30. Subsequently, the CPU 101 again rotates the revolver (q) until the developing section 21M assigned to a third color (M) reaches the developing position. This is repeated with a third color (M) and a fourth color (Y). As a result, the toner images of different colors are sequentially transferred to the belt 30 one above the other, forming a full-color image. Just before the full-color image arrives at the sheet transfer position, the CPU 101 turns on the sheet transfer charger 33 (o) in order to transfer the image to the sheet. The sheet is transported in exactly the same manner as in the monocolor printing.

After the transfer of the fourth color (Y) to the belt 30, the CPU 101 causes the revolver 20 to rotate (q) until the developing section 21K assigned to the first color (K) again reaches the developing position. At the same time, the CPU 101 brings the belt cleaner 34 into contact with the belt 30 (p) in order to clean the surface of the belt 30. As a result, the belt 30 is prepared for the next image formation. The end sequence is the same as in the monocolor printing.

Figure 8:
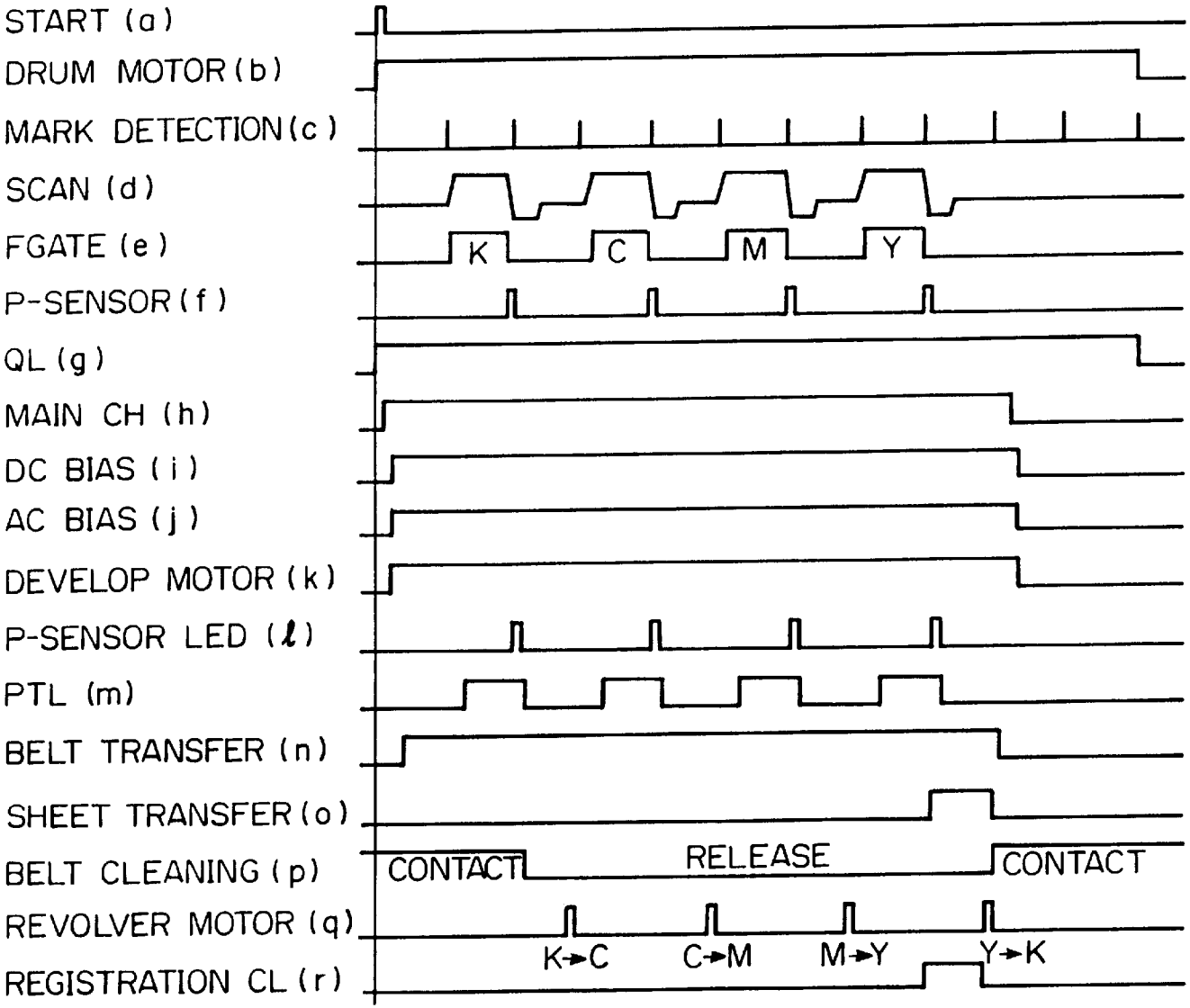
FIG. 8 is a timing chart showing still another specific operation in which a single full-color image of size A3 is output.

FIG. 8 shows a case wherein a single full-color image of size A3 (horizontally long). In FIG. 7, one turn of the belt 30 is the image forming period for a single color. By contrast, in FIG. 8, two turns of the belt 30 is the image forming period for a single color because a time for replacing the color for development is not available with one turn. That is, the detection of the reference mark by the mark sensor 150 is skipped once for each color. The contact of the belt cleaner 34 with the belt 30 and the image transfer to the sheet are effected at a particular timing for each of the sheets of sizes A4 and A3. As for size A4, because the image can be fully accommodated in the distance between the belt transfer charger 16 and the sheet transfer charger 33, the belt cleaner 34 is brought into contact with the belt 30 before the image transfer to the sheet. By contrast, as for size A3, the belt cleaner 34 is caused to contact the belt 30 before the image transfer to the sheet because the image cannot be fully accommodated in the above distance and in order to obviate defective image transfer ascribable to vibration.

Assume that an image is input to the printer from the outside. Then, the image can be printed on the sheet without sending a scanner start command to the scanner controller 200 and by writing, in a full-color mode, data at the timing based on the output of the mark sensor 150.

Figure 9:
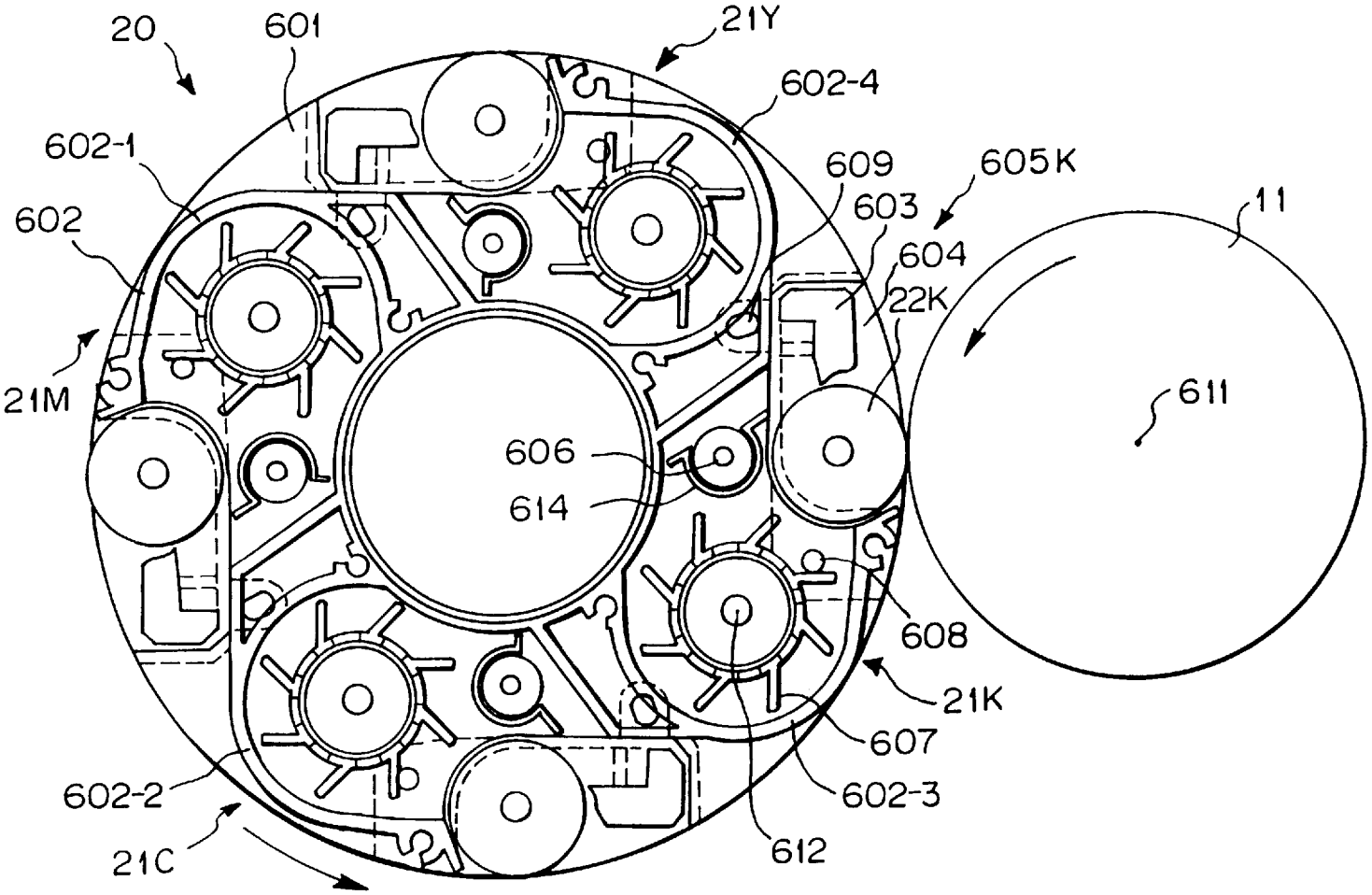
FIG. 9 is a section showing a revolver.
Figure 10:
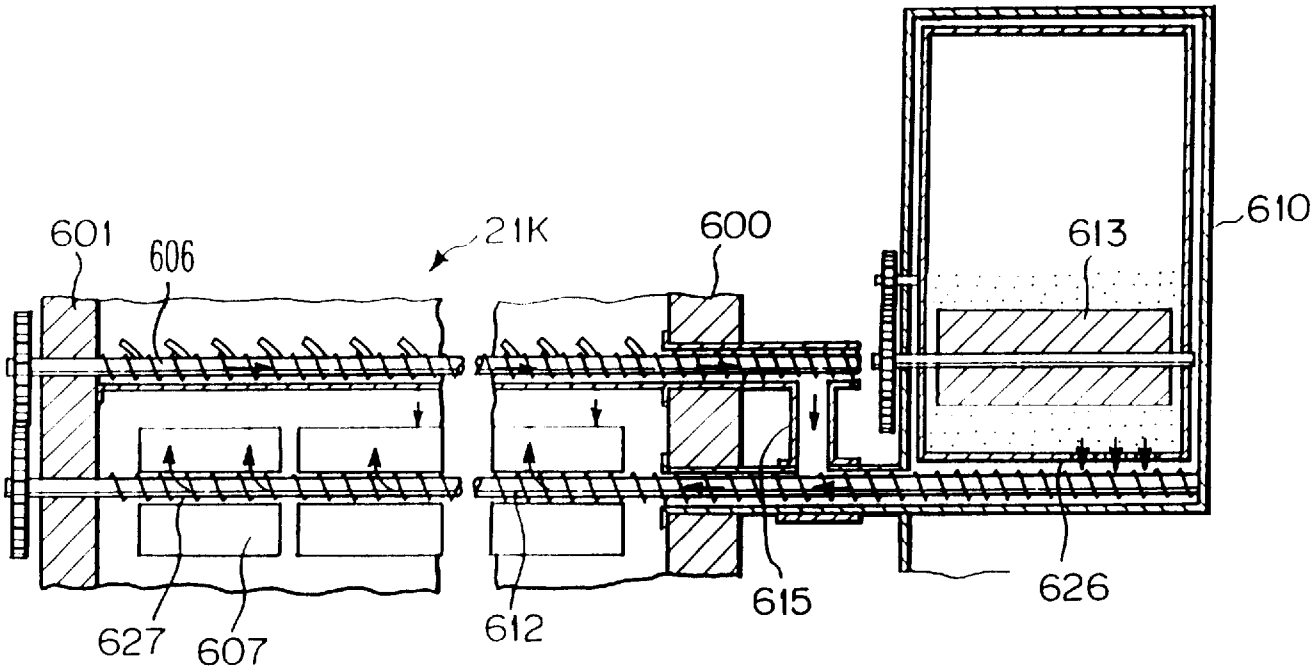
FIG. 10 is a section showing a toner circulation path formed in the revolver.

FIG. 9 shows the structure of the revolver 20 in detail while FIG. 10 shows a toner circulation path defined in the revolver 20. Specifically, FIG. 9 is a section as seen in the axial direction with a front side wall 600 shown in FIG. 10 removed. Various constituent parts of the revolver 20 positioned in front of a rear side wall 601, as seen in the above direction, are visible in FIG. 9. FIG. 10 is a section showing the developing section 21K by way of example and in a plane containing the center axes of an upper and a lower screw 606 and 612.

As shown in FIG. 9, the front and rear side walls 600 and 601 (see FIG. 10) each has a substantially disk-like configuration. A casing 602 has its interior divided into four compartments by partitions 602-1, 602-2, 602-3 and 602-4. The developing sections 21K, 21C, 21M and 21Y are respectively arranged in the compartments. In FIG. 9, the black developing section 21K storing black toner and carrier is shown as being located at the developing position facing the drum 11. The developing section 21K is followed by the developing section 21C storing cyan toner and carrier, developing section 21M storing magenta toner and carrier, and developing section 21Y storing yellow toner and carrier, as named in the clockwise direction.

Because the four developing sections 21K–21Y are exactly the same in construction, let the following description concentrate on the developing unit 21K by way of example.

The developing unit 21K includes a small unit 605K and a paddle 607 in addition to the upper screw 606 and lower screw 612. The small unit 605K is mounted between a front and a rear small side plate 604 (only one is visible on FIG. 9), and has a cylindrical developing sleeve 22K and a doctor 603. A shaft 608 is positioned below the small unit 605K and extends throughout the two small side plates 604. Further, the shaft 608 is supported by the front and rear side plates 600 and 601. The small unit 605K is bodily rotatable about the shaft 608. The small side plates 604 are each formed with an elongate slot 609 in its upper end portion. The side plates 604 are respectively fastened to the front and rear side plates 600 and 601 by screws through the slots 609. In this configuration, the operator may loosen the screws and turn the small unit 605K about the shaft 608 so as to move the developing sleeve 22K toward and away from the drum 11. This allows the operator to adjust the gap for development between the sleeve 22 and the drum 11.

As shown in FIG. 9, in the event of development, the stop position of the revolver 20 is set such that the axis of the developing sleeve 22 (22K in this case) is coincident with the axis 611 of the drum 11 in the horizontal direction. This position will be referred to as a developing position or a regular stop position assigned to the revolver 20.

Figure 11:
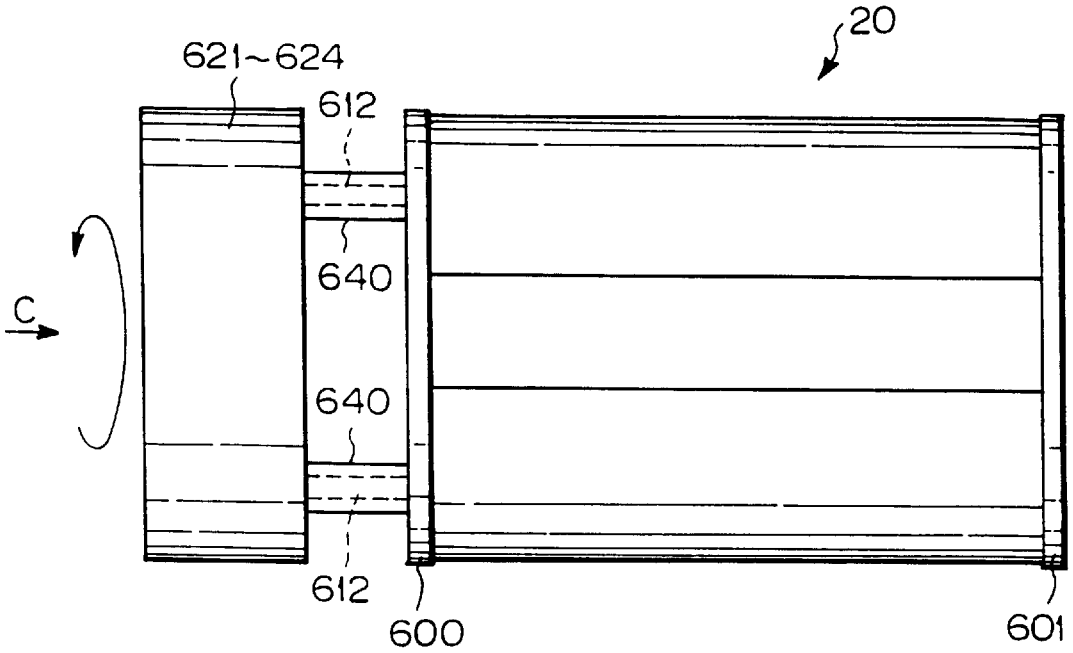
FIG. 11 is a side elevation showing toner cartridges removably mounted on the revolver.
Figure 12:
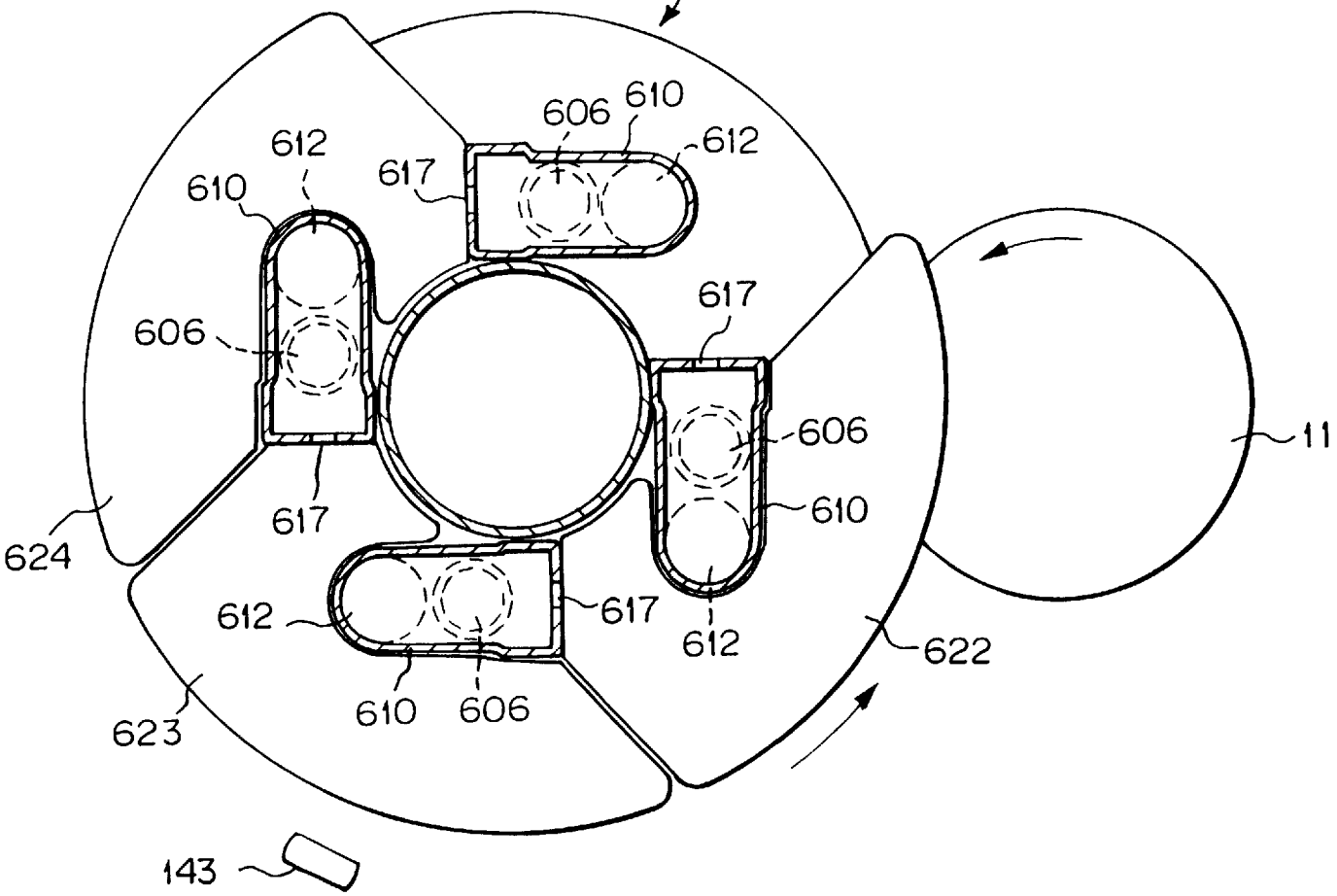
FIG. 12 is a front view showing the internal arrangement of the toner cartridges and that of toner hoppers.

FIG. 11 shows toner cartridges removably mounted on the revolver 20. FIG. 12 shows the internal arrangements of the toner cartridges and those of toner hoppers. FIG. 11 is a view as seen in opposite direction to FIG. 10. FIG. 12 shows the revolver 20 as seen in a direction C of FIG. 11.

As shown in FIG. 11, the front and rear side walls 600 and 601 and developing sections 21K–21Y (only 21K and 21Y are shown) constitute the hollow cylindrical revolver 20 in combination. Toner cartridges 621–624 respectively storing K, C, M and Y toner (only K and Y are shown) are positioned in the vicinity of the front end (left end as viewed in the figure) of the revolver 20. The cartridges 621–624 are held in alignment with the developing sections 21K–21Y, respectively. Specifically, as shown in FIG. 12, C toner, M toner and Y toner are stored in the cartridges 622, 623 and 624, respectively. K toner is stored in the cartridge 621 (not shown in FIG. 12).

As shown in FIG. 10, toner hoppers 610 are formed in the front end portion of the revolver 20 in the vicinity of the cartridges 621–624. Because all the toner hoppers 614 are identical in configuration, the upper and lower screws are labeled 606 and 612 in all of them. As shown in FIG. 12, each of the cartridges 621–624 is coupled with the respective hopper 610 with its recess portion mating with a projection portion included in the hopper 610. When all the cartridges 621–624 and hoppers 610 are assembled together, the front end of the revolver 20 generally forms a cylinder or a part of a cylinder. The hoppers 610 are affixed to a disk-like side plate, not shown, constituting a unit. As shown in FIG. 11, each hopper 610 is connected to the revolver 20 by a guide 640 covering the lower screw 612. In FIG. 12, the reference numeral 617 designates a passage for replenishing the toner from each of the cartridges 621–624 to the associated hopper 610.

Further, in FIG. 12, the cartridge (621), not shown, held at the developing position exists in the first quadrant while the cartridge 623 which will be described exists in the third quadrant. A cartridge sensor 143 is positioned below the cartridge 623 so as to sense a cartridge brought to the replacing position. The sensor 143, implemented as a reflection type photosensor, detects a reflection from a cartridge if the cartridge is present in the third quadrant. The resulting output of the sensor 143 is sent to the CPU 101, FIG. 3, showing that the cartridge is present.

Figures 13, 14, 15:
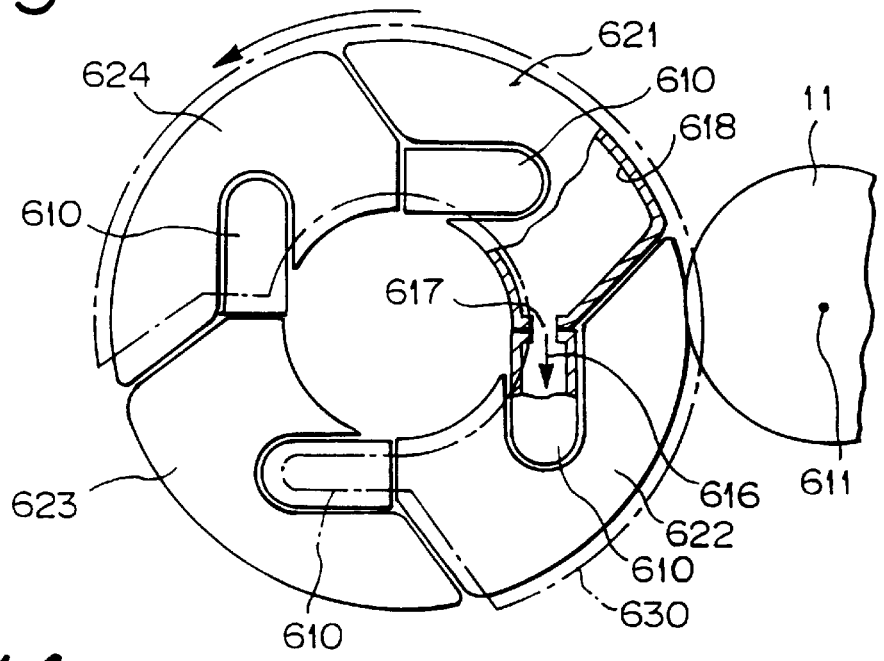
FIG. 13 shows how toner is transferred from each toner cartridge to the associated toner hopper.
FIG. 14 is a table listing correspondence between a color located at a developing position and a target color to be brought to the developing position.
FIG. 15 is a table listing correspondence between a color located at the developing position and a color located at a replacing position.

How the toner is replenished from the cartridges 621–624 to the associated hoppers 610 is as follows. FIG. 13 corresponds in position to FIG. 12 and demonstrates the movement of the toner from the cartridge to the hopper. The following description will concentrate on the cartridge 621 storing black toner by way of example. As shown in FIG. 13, when the cartridge 621 is located at the developing position, the passage 617 communicating the cartridge 621 and hopper 610 extends substantially vertically, as indicated by an arrow 616. The side wall of the cartridge 621 extending toward the passage 617 has a funnel-like configuration. Therefore, the toner stored in the cartridge 621 moves toward the hopper 610 due to gravity and fills the hopper 610. This is also true with the other cartridges 622–624. The inner periphery of the wall of the cartridge 621 which the toner contacts is implemented as a smooth surface 618 contiguous with the passage 617. It follows that the cartridge itself guides the toner to the inlet of the passage 617 due to the rotation of the revolver 20. This, coupled with gravity acting when the passage 617 is moved to its vertical position, allows the entire toner stored in the cartridge 621 to be used.

The conveyance of the toner from the hopper to the developing sleeve will be described, taking the developing section 21K as an example. As shown in FIG. 10, a replenish roller 613 is positioned in a lower portion of each hopper 610. The toner accumulating on the replenish roller 613 is driven downward in accordance with the rotation of the roller 613. Then, the toner drops on the lower screw or conveyor 612 via a plurality of outlets 626 formed in the bottom of the hopper 610. The screw 612 in rotation conveys the toner in the direction indicated by arrows in FIG. 10. Subsequently, the toner is discharged to the outside of the paddle 607 via openings 627 formed in the paddle 607. The paddle 607 agitates the toner vertically. The toner agitated vertically is scooped up to the developing sleeve 22K (see FIG. 9) and used for development.

During development, the drum 11 and developing sleeve 22K rotate counterclockwise and clockwise, respectively. A doctor 603 contacts the sleeve 22K and regulates the amount of the toner deposited on the sleeve 22K. A screw guide 614 surrounds the upper screw 606. The toner shaved off by the doctor 603 is partly introduced into the screw guide 614 and then conveyed to the front, as seen in the direction perpendicular to the sheet surface of FIG. 9, by the upper screw 606. As shown in FIG. 10, the toner conveyed by the upper screw 606 is transferred to the lower screw 612 via an outlet pipe 615. As a result, this part of the toner is mixed with the toner replenished from the toner cartridge 621 via the hopper 610. In this manner, the toner is agitated horizontally by the two screws 606 and 612 and agitated vertically by the paddle 607, so that it is provided with a uniform toner content.

The revolver 20 has its four developing sections arranged at angular intervals of 90 degrees. In the event of color development, the revolver 20 rotates counterclockwise in order to switch the color in the order of K, C, M and Y. By the rotation of the revolver 20, the toner is loosened in the respective cartridge and accumulates on the replenish roller 613, FIG. 10.

In the revolver 20, the position for the replacement of the toner cartridge is limited to the third quadrant, as stated earlier. Because the cartridge existing in the third quadrant has its mouth, not shown, oriented upward without fail, the toner, if remaining in the cartridge, is successfully prevented from flying about. For example, in FIG. 12, only the toner cartridge 623 lying in the third quadrant can be replaced. An inner cover 630 (only its contour is shown in FIG. 13) is so configured as to delimit the above replacing position. Specifically, the inner cover 623 has its portion corresponding to the replacing position removed and prevents the cartridge from being pulled out via portions other than the removed portion.

FIG. 14 shows a relation between the color presently held at the developing position and the other colors to be brought to the replacing position. As shown, assume that the K cartridge is located at the developing position. Then, the C and Y cartridges should only be respectively rotated 270 degrees and 90 degrees to the replacing position.

FIG. 15 shows correspondence between the color held at the developing position and the color held at the replacing position. As shown, when M, for example, is located at the developing position, K is located at the replacing position. The revolver HP sensor 151 disposed below the revolver 20 senses the home position or reference stop position of the revolver 20, as stated earlier. When the sensor 151 senses the revolver 20 brought to its home position, the CPU 101, FIG. 3, causes the revolver 20 to stop when the K developing section reaches the developing position. Further, by referencing the tables shown in FIGS. 14 and 15, it is possible to determine how much the revolver 20 should be rotated to bring a desired color to the replacing position or to see a color presently located at the replacing position on the basis of a color located at the developing position.

In the above printer, every time a preselected number of printings (e.g. ten) are produced, a reference density pattern is formed on the drum 11. The optical sensor, FIG. 5, reads the density of the density pattern. The toner is replenished to the developing section in accordance with the density read by the sensor, so that the toner content in the developing section remains constant. When the toner content is determined to be low a plurality of consecutive times (e.g. three times) by such toner density control, the developing section is determined to have reached its toner near end condition. Then, a toner near end LED, not shown, associated with the above developing section is turned on. Even after the turn-on of the LED, the developing section is allowed to operate a preselected number of times. Thereafter, the developing section is determined to have reached its toner end condition with the result that a toner end LED, not shown, associated therewith is turned on. Then, the printer inhibits printing operation and waits until the operator replaces the cartridge or executes any preselected preparatory procedure.

Assume that any one of the cartridges reaches its toner near end or toner end condition when a printing operation ends normally, or that the last one of a plurality of consecutive times of printing operation ends in the toner end condition. Then, the printer so rotates the revolver 20 as to bring the cartridge reached the toner near end or toner end condition to the replacing position, and then waits. This facilitates the replacement of the cartridge by the operator. This is also done by referencing the tables shown in FIGS. 14 and 15. While the cartridge may be replaced for any reason other than the toner end or toner near end condition, let the replacement be ascribable to the toner end or toner near end condition.

While the printer is waiting with at least one cartridge reached its toner near end or toner enu condition, the operator opens the front cover of the printer body, pulls out the cartridge via the replacing position, inserts a new cartridge, and then closes the door. After such replacement, the printer executes a recovery operation for recovering the toner content in the developing section to which the new cartridge has been mounted. Then, the developing section is ready to operate with the new cartridge.

On the other hand, a revolver allowing only the toner cartridge located at a replacing position to be replaced has [Problem 1] discussed earlier. Specifically, if the cartridge in the toner end or toner near end condition is not located at the replacing position, then the operator must move such a cartridge to the replacing position by hand. Also, assume that the operator desires to replace only the cartridge of particular color. Then, if the desired cartridge is not located at the replacing position, then the operator must also move it to the replacing position by hand. Generally, however, it is difficult and inefficient to rotate the revolver by hand.

In light of the above, the printer of the present invention searches for a toner cartridge to be replaced and moves, at the end of image formation or in response to a command input by the operator, the toner cartridge to the replacing position.

Preferred embodiments of the present invention capable of solving [Problem 1] will be described hereinafter.

1st Embodiment

Figure 16A:
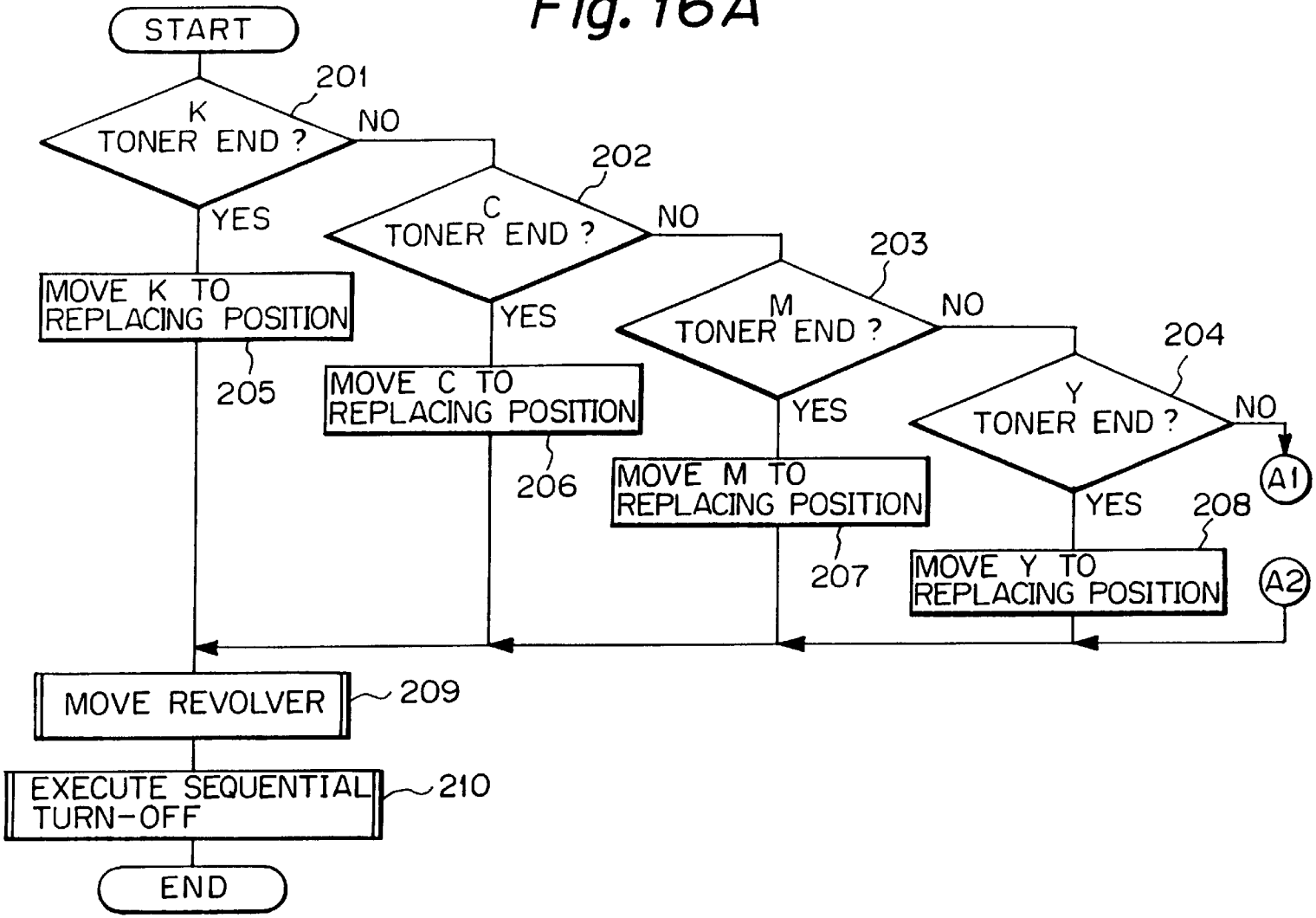
FIG. 16 is a flowchart representative of a first embodiment of the present invention and showing a procedure to be effected at the end of image formation.
Figure 16B:
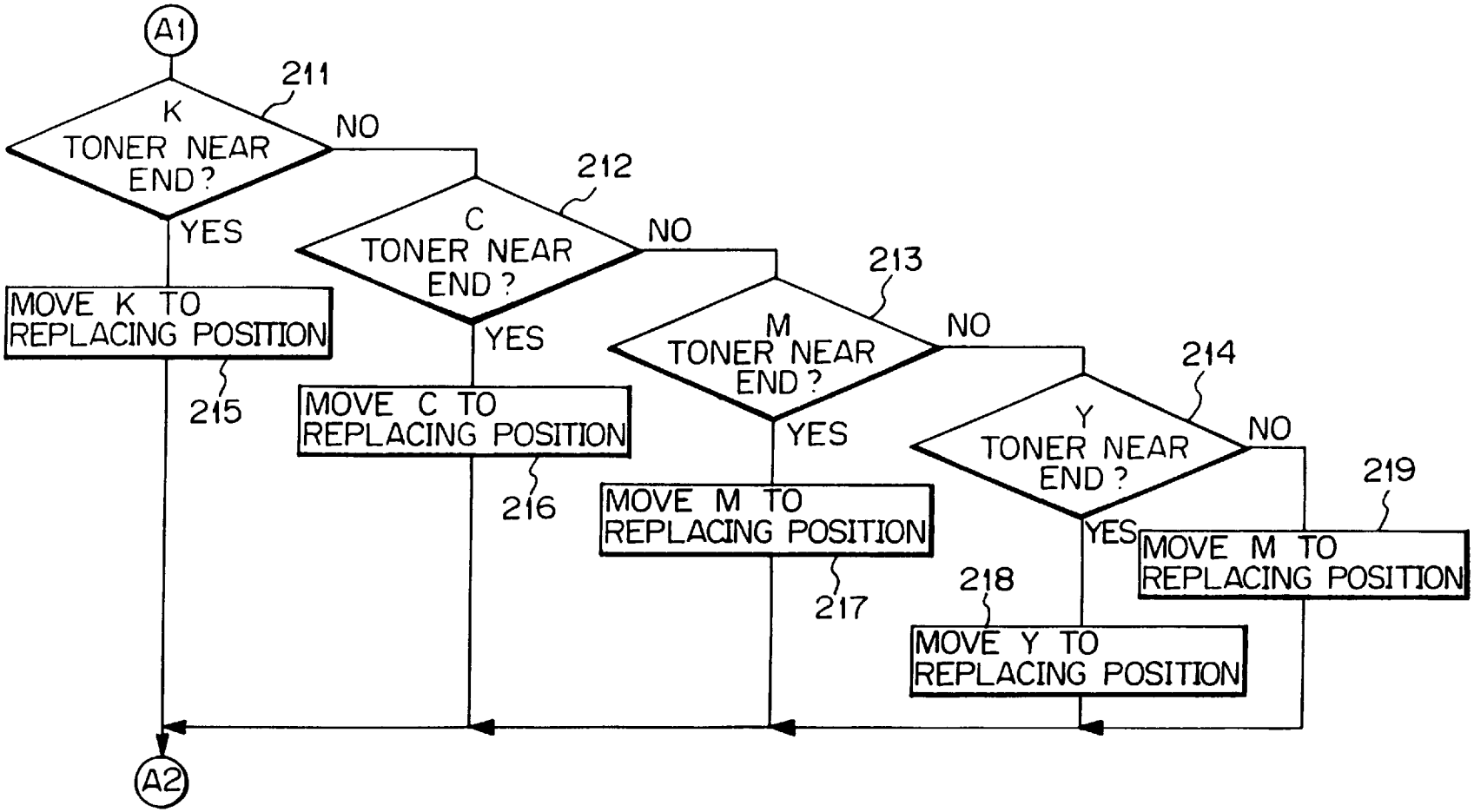

FIG. 16 shows a procedure representative of a first embodiment of the present invention and to be executed by the CPU 101, FIG. 3, at the end of image formation, particularly a routine to be executed when a toner end or toner near end condition has been reached.

First, the CPU 101 searches the toner K, C, M and Y in this order in order to determine whether or not any of them has reached a toner end condition (steps 201–204). If any one of the toner K-Y has reached the toner end condition, the CPU 101 determines that it should be moved to the replacing position (steps 205–208). Then, the CPU 101 moves the revolver to bring the color reached the toner end condition to the replacing position (step 209), sequentially turns off the power pack, motor and so forth (step 210), and ends the routine.

If none of the toner K-Y has reached the toner end condition, the CPU 101 again searched the toner K-Y in this order in order to determine whether or not any one of them has reached a toner near end condition (steps 211–214). If any one of the toner K-Y has reached the toner near end condition, the CPU 101 determines that it should be moved to the replacing position (steps 215–218). If the toner Y has not reached the toner near end condition (N, step 214), the CPU 101 determines that the toner M should be moved to the replacing position (step 219). This is followed by the same processing as in the case of the toner end condition. When none of the toner K-Y is in the toner end or toner near end condition, the CPU 101 ends the routine after moving the toner M to the replacing position. This is because the toner K is to be brought to the developing position in an ordinary end routine (see FIG. 15). The above procedure allows the operator to replace the cartridge reached the toner end or toner near end condition immediately after image formation.

The priority given in the order of K, C, M and Y as to the search is derived from the estimated frequency of use, among others. Specifically, a black or a full-color mode is predominant with an ordinary image forming apparatus. Therefore, so long as all the toner cartridges have the same volume, the K toner cartridge is used most often. It follows that the probability that the interval between the toner near end condition and the toner end condition or the interval between the toner end condition and the inhibition of image formation is shortest with the K cartridge is high. In addition, when a plurality of toner cartridges have reached the toner end or toner near end condition, the probability that the operator desires to replace the K cartridge for the subsequent image formation is highest. The colors C, M and Y are not noticeably different as to the frequency of use. However, because the colors K, C, M and Y sequentially reach the replacing position in this order, as shown in FIG. 13, the colors K, C, M and Y should preferably be searched in this order in order to minimize the amount and time of movement of the revolver. With the above priority order, it is possible to move, when a plurality of toner cartridges have reached, e.g., the toner end condition, the toner cartridge needing urgent replacement or desired to be replaced most often to the replacing position first, compared to the case wherein the toner cartridges are moved to the replacing position at random.

In the illustrative embodiment, the CPU 101 searches the colors K, C, M and Y in this order as to the toner end condition before it searches them as to the toner near end condition, as stated above. It is therefore possible to move the cartridge least in the amount of remaining toner and most likely to need urgent replacement at the end of image formation to the replacing position.

Moreover, even when only the cartridge reached the toner near end condition is present, it is moved to the replacing position. This allows the operator to replace the cartridge before it reaches the toner end condition, and therefore to repeat image formation a greater number of times.

2nd Embodiment

Assume a printer so constructed as to allow only a toner cartridge held at a preselected replacing position to be replaced. When this type of printer should be operated with a toner cartridge reaches the toner end or toner near end condition and not held at the replacing position, the operator must move such a toner cartridge to the replacing position by hand. To solve this problem, this embodiment moves, on the basis of a color mode key pressed by the operator, a toner cartridge to be replaced to the replacing position, as will be described hereinafter. It is to be noted that color mode keys are provided on a control panel, not shown, controlled by the panel controller 900, FIG. 2.

FIGS. 17–25 demonstrate processing for moving the toner cartridges as designated via color mode keys. In the illustrative embodiment, full-color, red, green, blue, cyan, magenta, yellow and black color mode keys are available. When the operator presses desired one of such color mode keys, the CPU 101, FIG. 3, executes preselected processing with the cartridge or cartridges to be used in the color mode selected.

Figure 17:
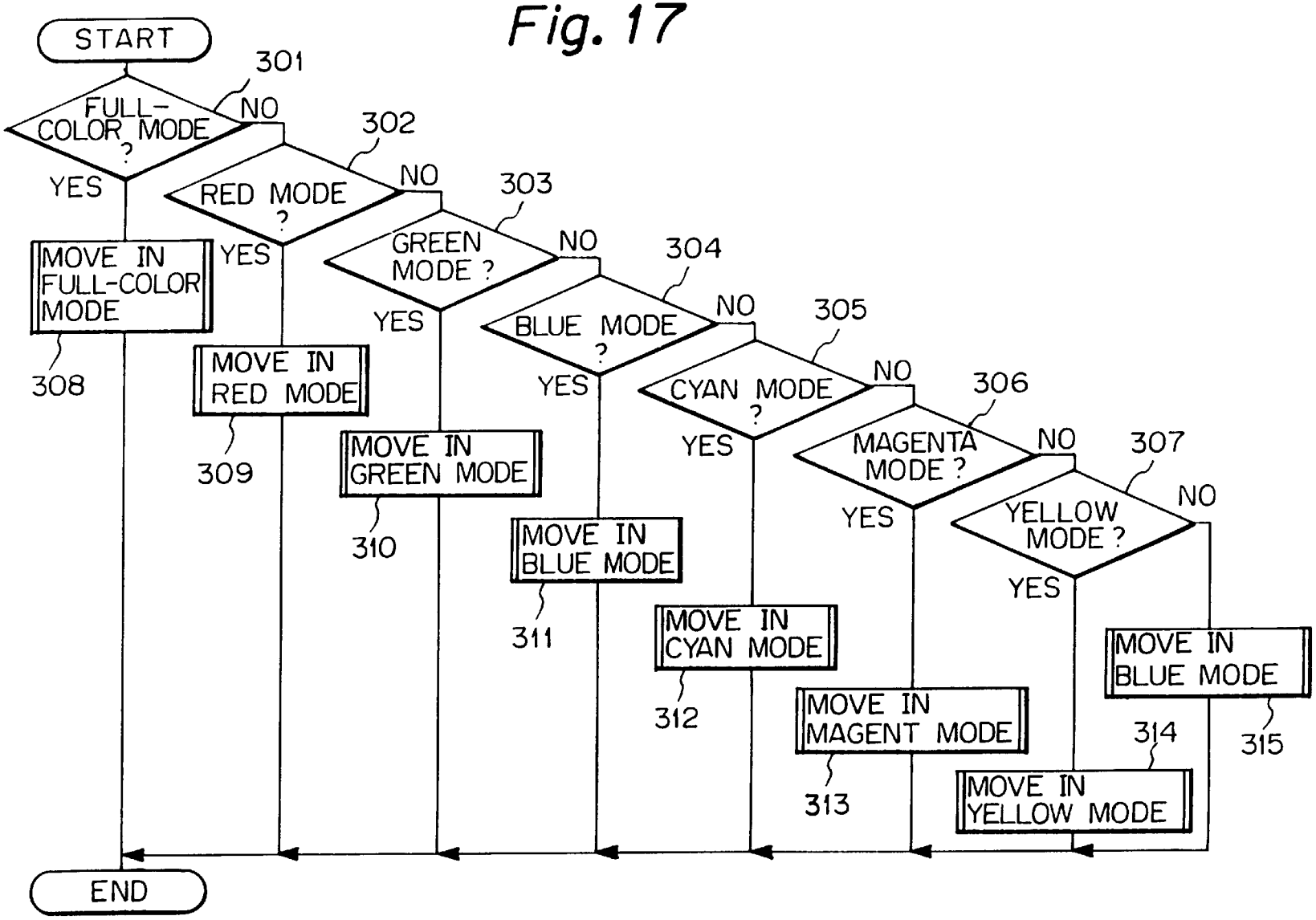
FIG. 17 is a flowchart representative of a second embodiment of the present invention and showing a procedure for executing a particular manner of movement, depending on a color mode key pressed by the operator.

FIG. 17 shows a routine for selecting particular movement on the basis of the color mode key pressed. As shown, when the operator presses desired color mode key, the CPU 101 identifies the color mode selected (steps 301–307), and then starts processing assigned to the color mode (steps 308–315). FIGS. 18–25 each shows particular processing or subroutine assigned to each of the different color nodes.

Figure 18A:
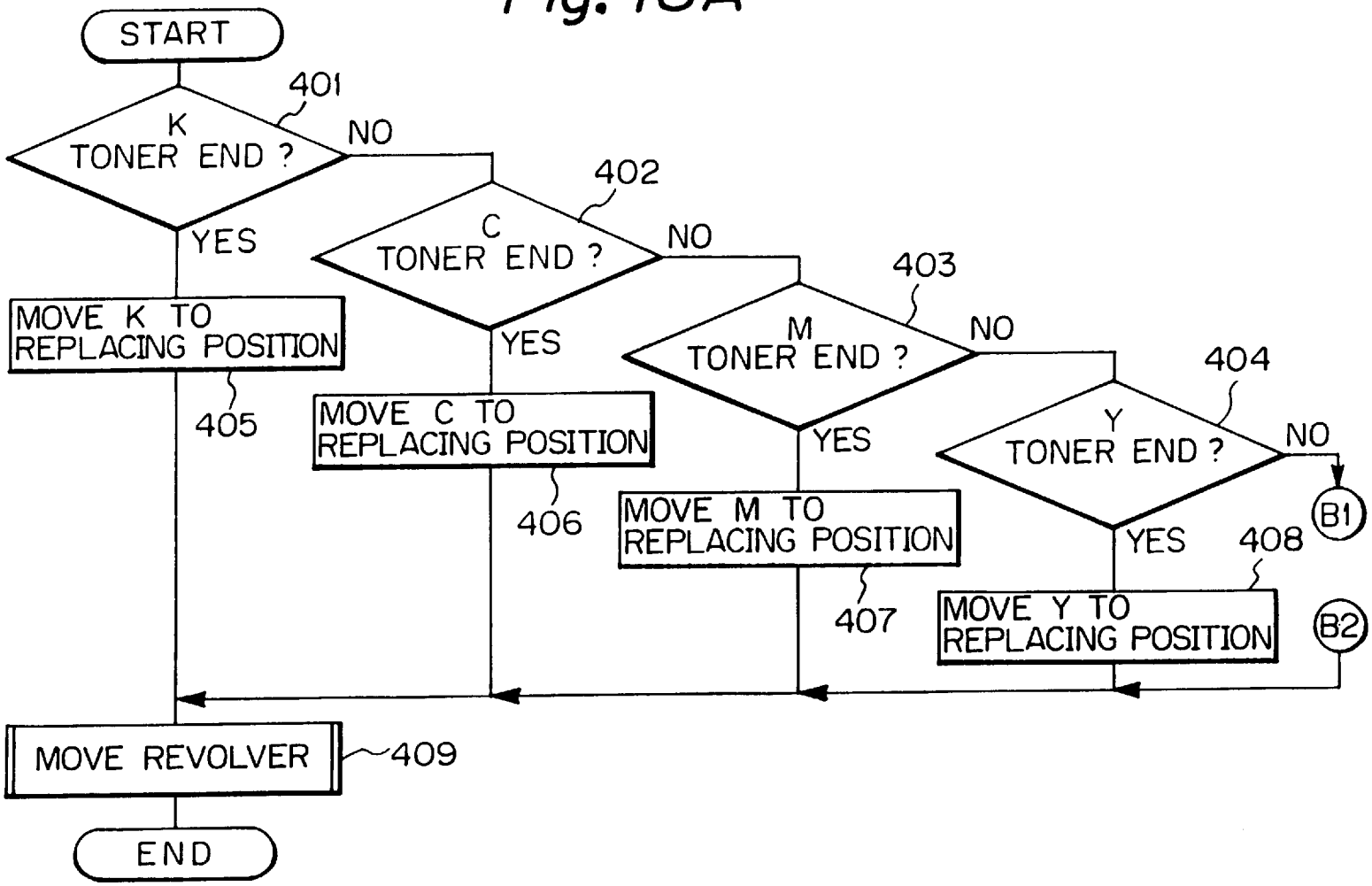
FIG. 18 is a flowchart showing a procedure included in the second embodiment for moving toner cartridges in a full-color mode.
Figure 18B:
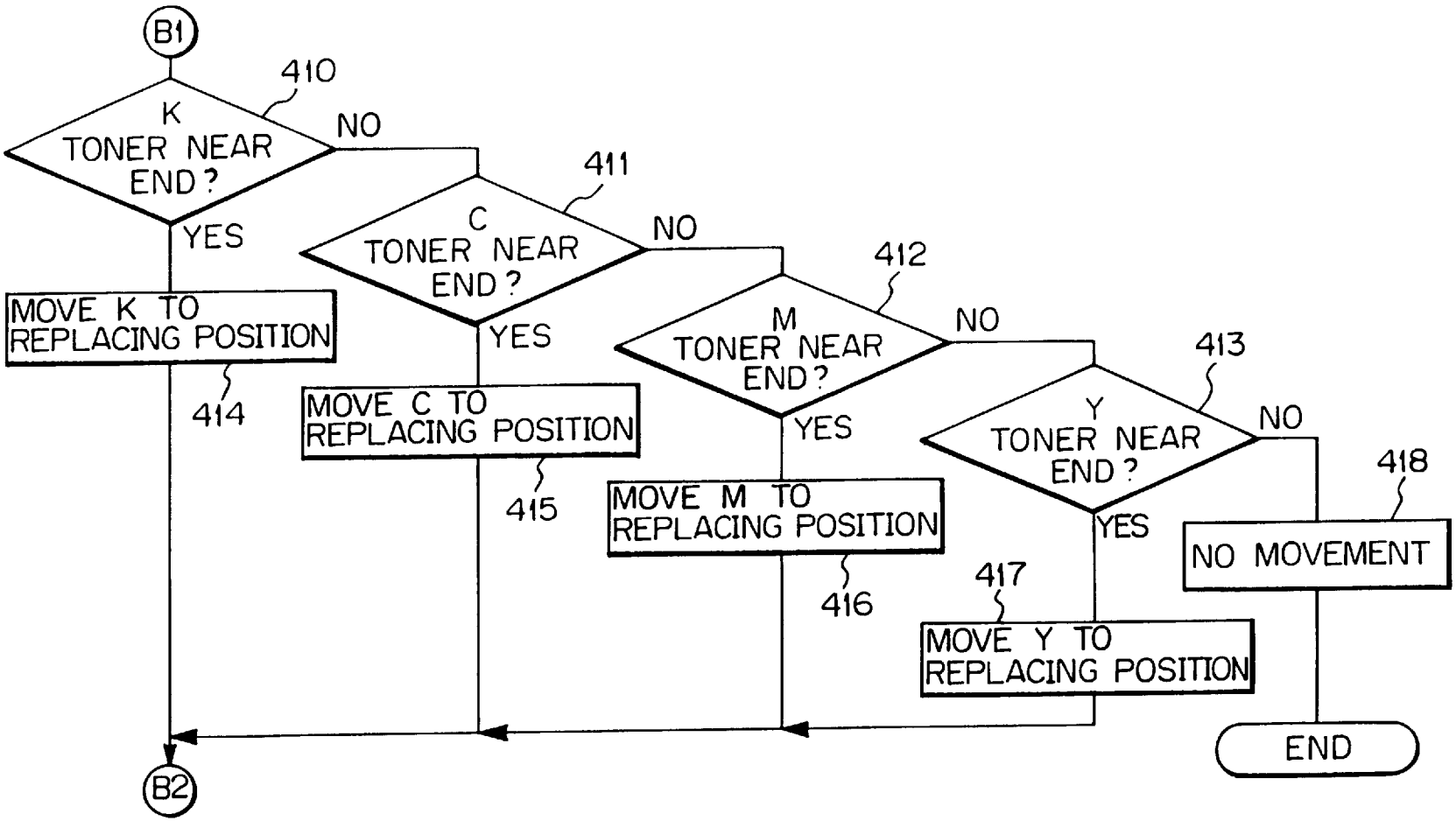

As shown in FIG. 18, in the full-color mode, the CPU 101 searches the toner K, C, M and Y in this order to see if any one of them has reached the toner end condition (steps 401–404). If the answer of this decision is positive, the CPU 101 determines that the color reached the toner end condition should be brought to the replacing position (steps 405–408). Then, the CPU 101 moves the revolver until the cartridge of the identified color reaches the replacing position (step 409). If none of the colors K–Y has reached the toner end condition, the CPU 101 determines whether or not any one of the colors K–Y has reached the toner near end condition (steps 410–413). If any one of the colors K–Y is in the toner near end condition, the CPU 101 determines that it should be brought to the replacing position (steps 414–417), and then executes the step 409. If none of the colors K–Y is in the toner end condition or the toner near end condition, the CPU 101 ends the processing without moving the revolver (step 418).

Figure 19:
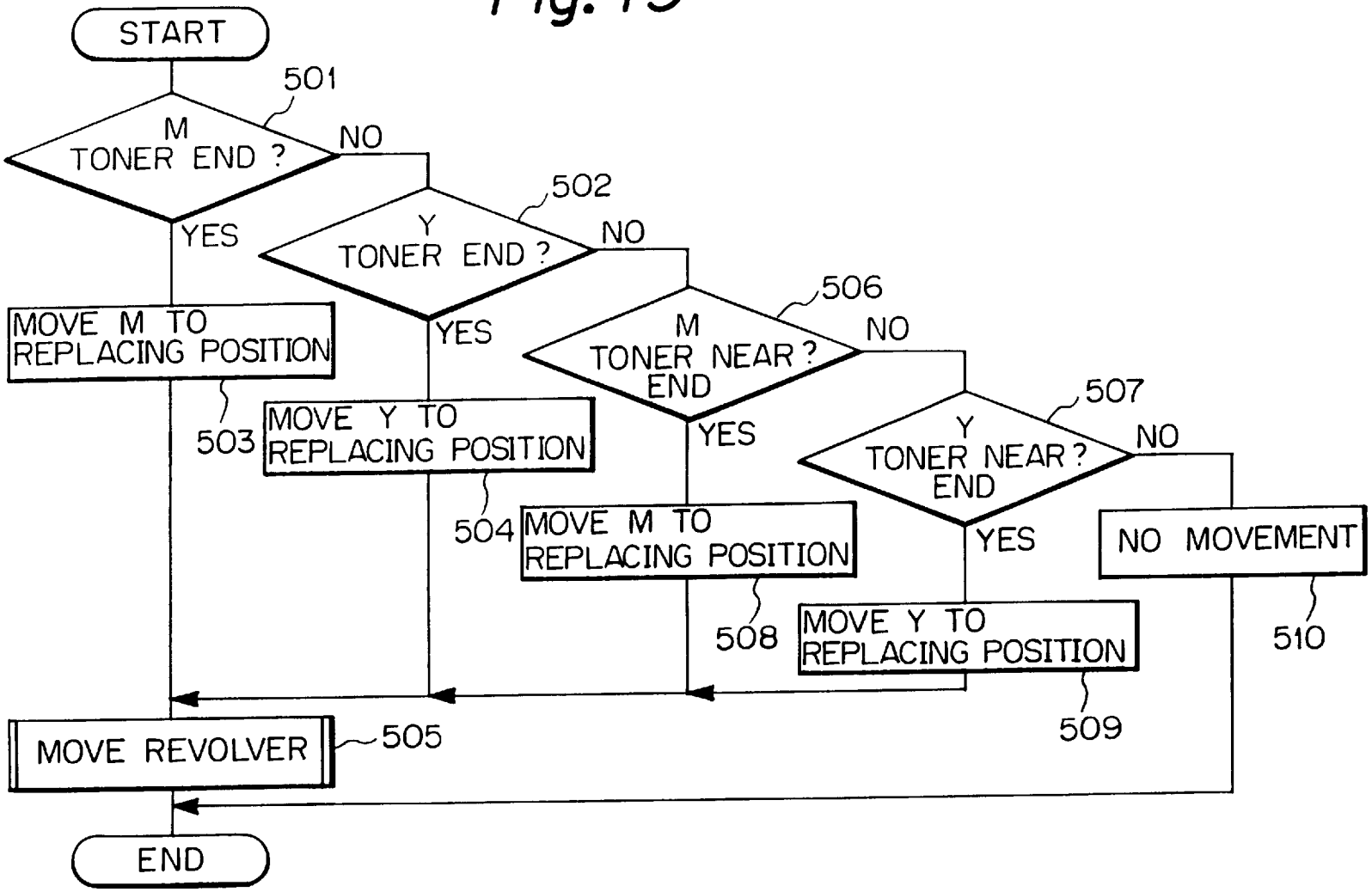
FIGS. 19–25 are flowcharts respectively demonstrating procedures included in the second embodiment for moving the cartridges in a red mode, green mode, blue mode, black mode, cyan mode, magenta mode, and yellow mode.

As shown in FIG. 19, in the red mode, the CPU 101 searches the colors M and Y in this order to see if any one of them has reached the toner end condition (step 501 or 502). If the answer of this decision is positive, the CPU 101 determines that M or Y reached the toner end condition should be moved to the replacing position (steps 503 or 504), and then moves the revolver to bring the above color to the replacing position (step 505). If neither M nor Y has reached the toner end condition, the CPU 101 determines whether or not M or Y is in the toner near end condition in this order (step 506 or 507). If the answer of this step is positive, the CPU 101 determines that M or Y in the toner near end condition should be brought to the replacing position (step 508 or 509), and then executes the step 505. If neither M or Y is in the toner end or toner near end condition, the CPU 101 ends the processing without moving the revolver.

Figure 20:
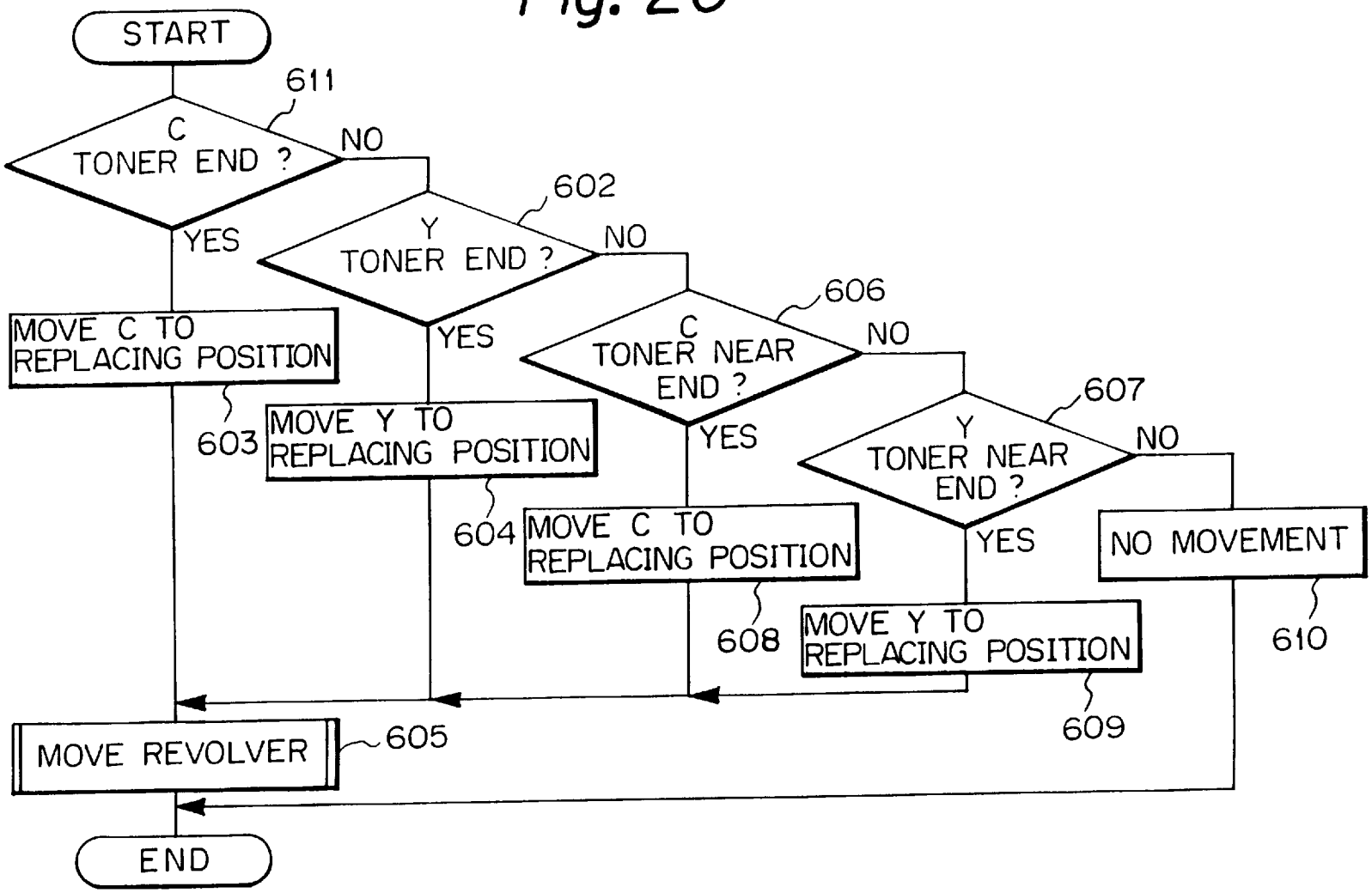

As shown in FIG. 20, in the green mode, the CPU 101 searches the colors C and Y in this order to see if any one of them has reached the toner end condition (step 601 or 602). If the answer of this decision is positive, the CPU 101 determines that C or Y reached the toner end condition should be moved to the replacing position (steps 603 or 604), and then moves the revolver to bring the above color to the replacing position (step 605). If neither C nor Y has reached the toner end condition, the CPU 101 determines whether or not C or Y is in the toner near end condition in this order (step 606 or 607). If the answer of this step is positive, the CPU 101 determines that C or Y in the toner near end condition should be brought to the replacing position (step 608 or 609), and then executes the step 605. If neither C or Y is in the toner end or toner near end condition, the CPU 101 ends the processing without moving the revolver.

Figure 21:
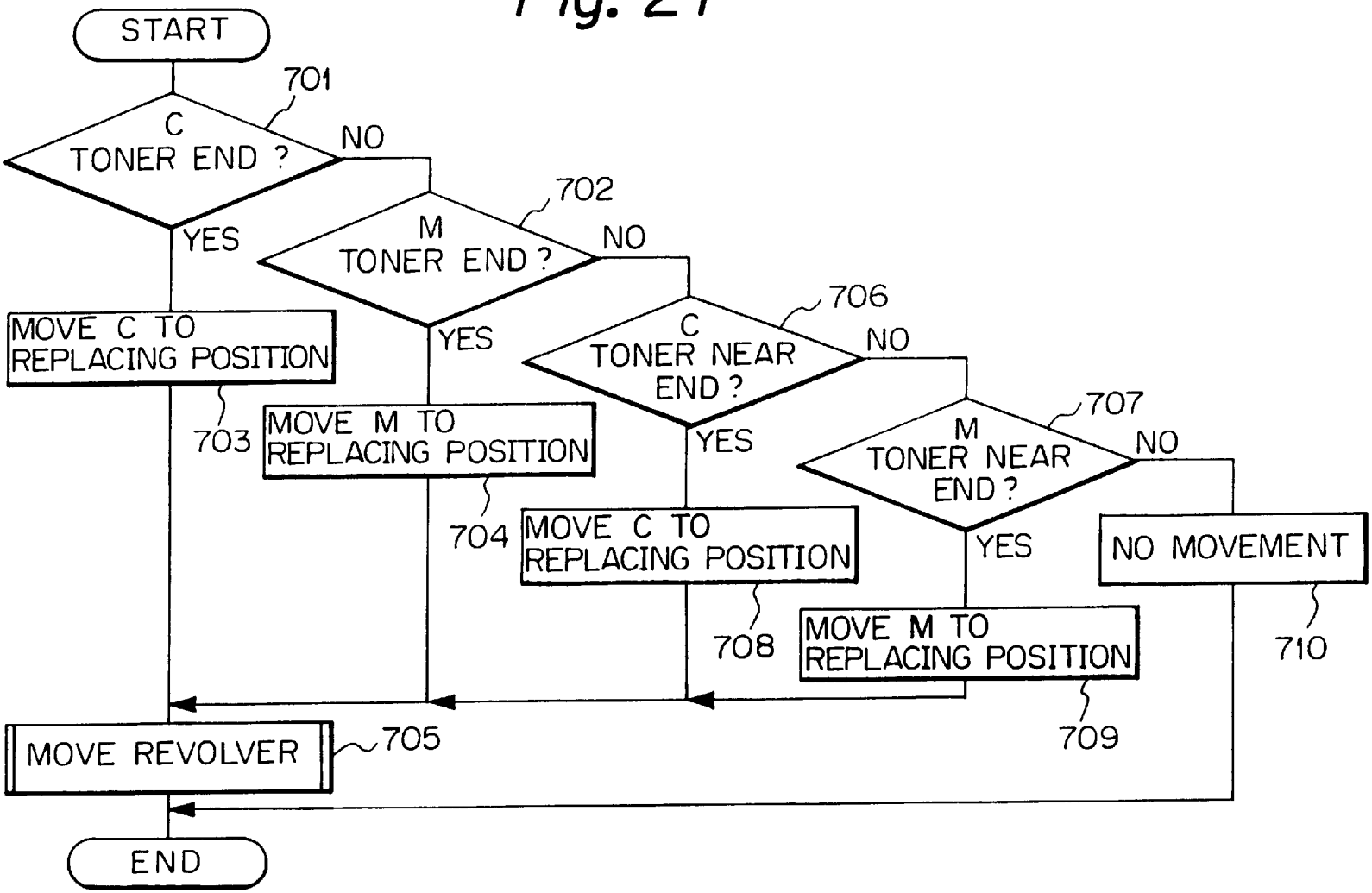

As shown in FIG. 21, in the blue mode, the CPU 101 searches the colors C and M in this order to see if any one of them has reached the toner end condition (step 701 or 702). If the answer of this decision is positive, the CPU 101 determines that C or M reached the toner end condition should be moved to the replacing position (steps 703 or 704), and then moves the revolver to bring the above color to the replacing position (step 705). If neither C nor M has reached the toner end condition, the CPU 101 determines whether or not C or M is in the toner near end condition in this order (step 706 or 707). If the answer of this step is positive, the CPU 101 determines that C or M in the toner near en d condition should be brought to the replacing position (step 708 or 709), and then executes the step 705. If neither C or M is in the toner end or toner near end condition, the CPU 101 ends the processing without moving the revolver.

Figure 22:
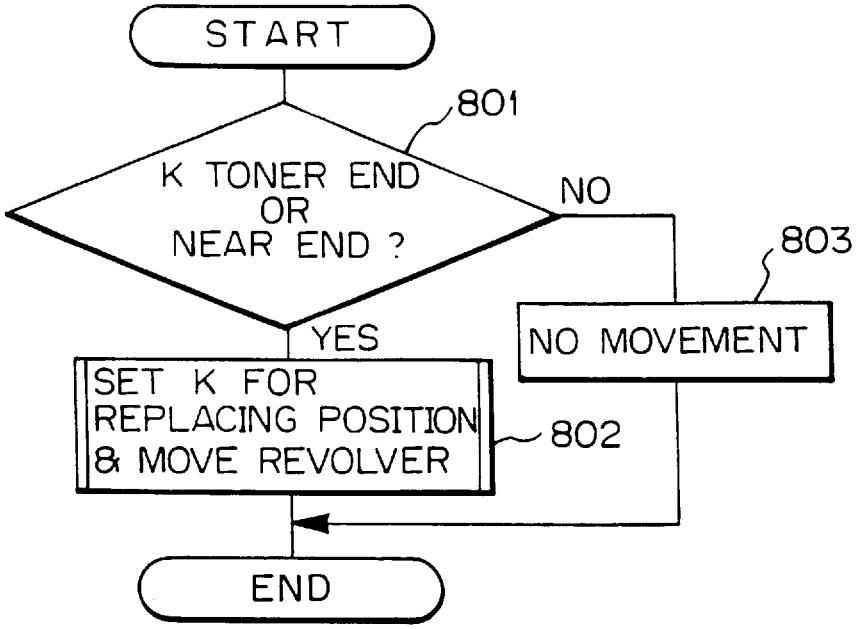

As shown in FIG. 22, in the black mode, the CPU 101 determines whether or not the color K has reached the toner end or toner near end condition (step 801). If the color K is in one of the two conditions, the CPU 101 determines that the color K should be brought to the replacing position, and then moves the revolver (step 802). if the answer of the step 801 is negative, the CPU 101 ends the processing without moving the revolver (step 803).

Figure 23:
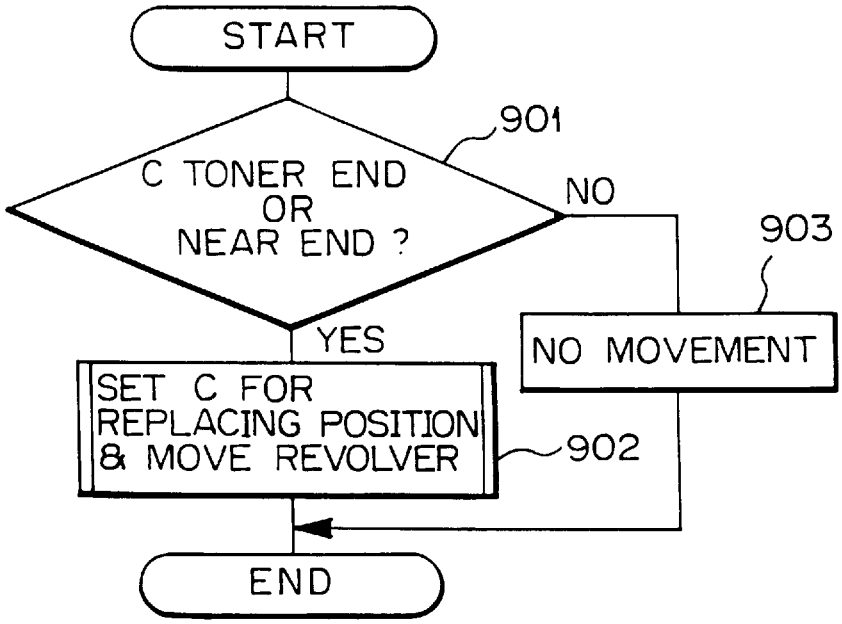

As shown in FIG. 23, in the cyan mode, the CPU 101 determines whether or not the color C has reached the toner end or toner near end condition (step 901). If the color C is in one of the two conditions, the CPU 101 determines that the color C should be brought to the replacing position, and then moves the revolver (step 902). If the answer of the step 901 is negative, the CPU 101 ends the processing without moving the revolver (step 903).

Figure 24:
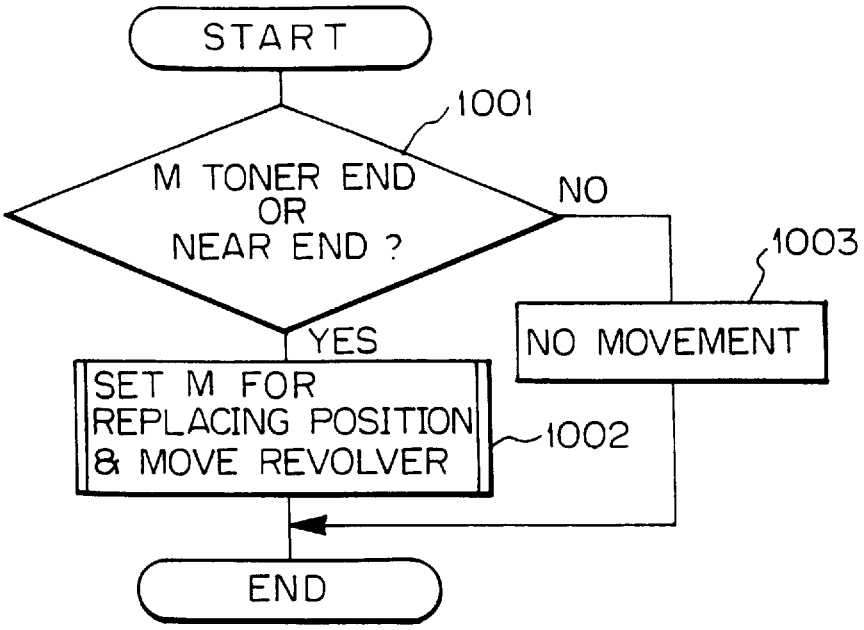

As shown in FIG. 24, in the magenta mode, the CPU 101 determines whether or not the color M has reached the toner end or toner near end condition (step 1001). If the color M is in one of the two conditions, the CPU 101 determines that the color M should be brought to the replacing position, and then moves the revolver (step 1002). If the answer of the step 1001 is negative, the CPU 101 ends the processing without moving the revolver (step 1003).

Figure 25:
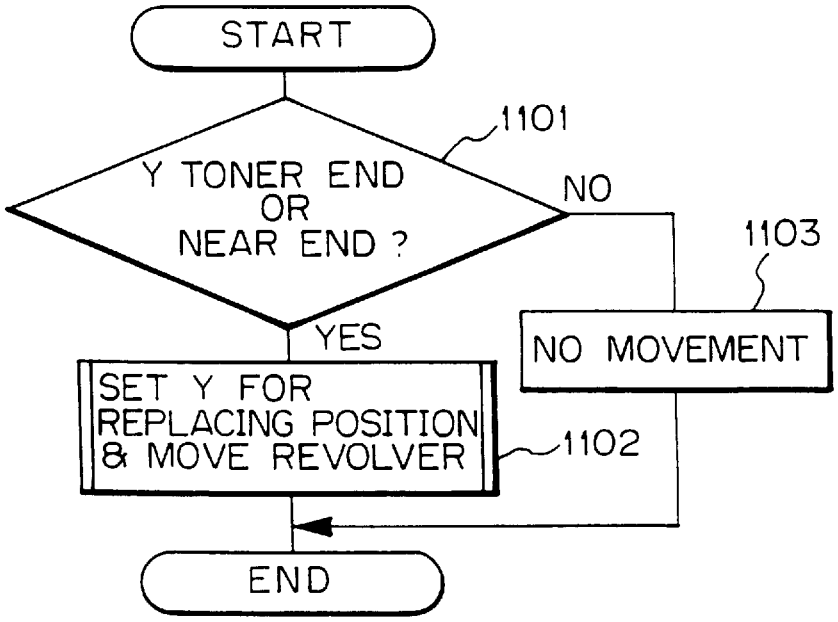

As shown in FIG. 25, in the yellow mode, the CPU 101 determines whether or not the color Y has reached the toner end or toner near end condition (step 1101). If the color Y is in one of the two conditions, the CPU 101 determines that the color Y should be brought to the replacing position, and then moves the revolver (step 1102). If the answer of the step 1101 is negative, the CPU 101 ends the processing without moving the revolver (step 1103).

As stated above, the CPU 101 searches for the cartridge reached the toner end or toner near end condition on the basis of the color mode key pressed, and then moves such a cartridge to the replacing position. Therefore, the operator intending to use the cartridge reached the toner end or toner near end condition and not located at the replacing position should only press the color mode key assigned to the cartridge. This frees the operator from manual operation and facilitates the replacement of the toner cartridge. This is also true with the other embodiments to be described.

Further, in the illustrative embodiment, the CPU 101 not only sequentially (toner end→toner near end) searches the cartridge of highest priority first, but also sequentially searches the colors in the order of priority (K→C→M→Y). This promotes efficient replenishment of the toner. Specifically, the CPU 101 searches the K, C, M and Y cartridges in this order as to the toner end condition, and then searches them in the same order as to the toner near end condition. When the operator presses desired one of the color mode keys, the cartridge storing the least amount of toner is brought to the replacing position. This is also true with the other embodiments to be described.

Moreover, when none of the cartridges is in the toner end or toner near end condition, the CPU 101 does not move the revolver. This saves time and reduces the waiting time up to the start of image formation, compared to the case wherein the revolver is moved even in the above condition. In addition, this extends the life of the revolver motor and minimizes noise. This is also true with the other embodiments to be described.

3rd Embodiment

In the second embodiment, the CPU 101 sequentially searches the cartridges in the order of priority on the basis of the color mode key pressed. Therefore, when any one of the color mode keys is pressed, the cartridge of highest priority is brought to the replacing position at all times. Assume that, e.g., two or more of the colors desired by the operator are in the toner end condition, and that one of them given lower priority has already been located at the replacing position before the operator presses the color mode key. Even in this condition, the cartridge of highest priority is brought to the replacing position first. Therefore, the operator must replace the cartridge of highest priority, then press the same color mode key again, and then replace the cartridge of lower priority. This undesirably increases the period of time up to the start of image forming operation. In light this, when the cartridge of desired color and needing replacement has already been located at the replacing position, the third embodiment does not move the revolver, as follows.

FIGS. 26–29 demonstrate processing which the CPU 101, FIG. 3, executes when the full-color mode key or any one of the two-color mode keys is pressed. The procedures shown in FIGS. 26–29 are subroutines belonging to the routine shown in FIG. 17.

Figure 26A:
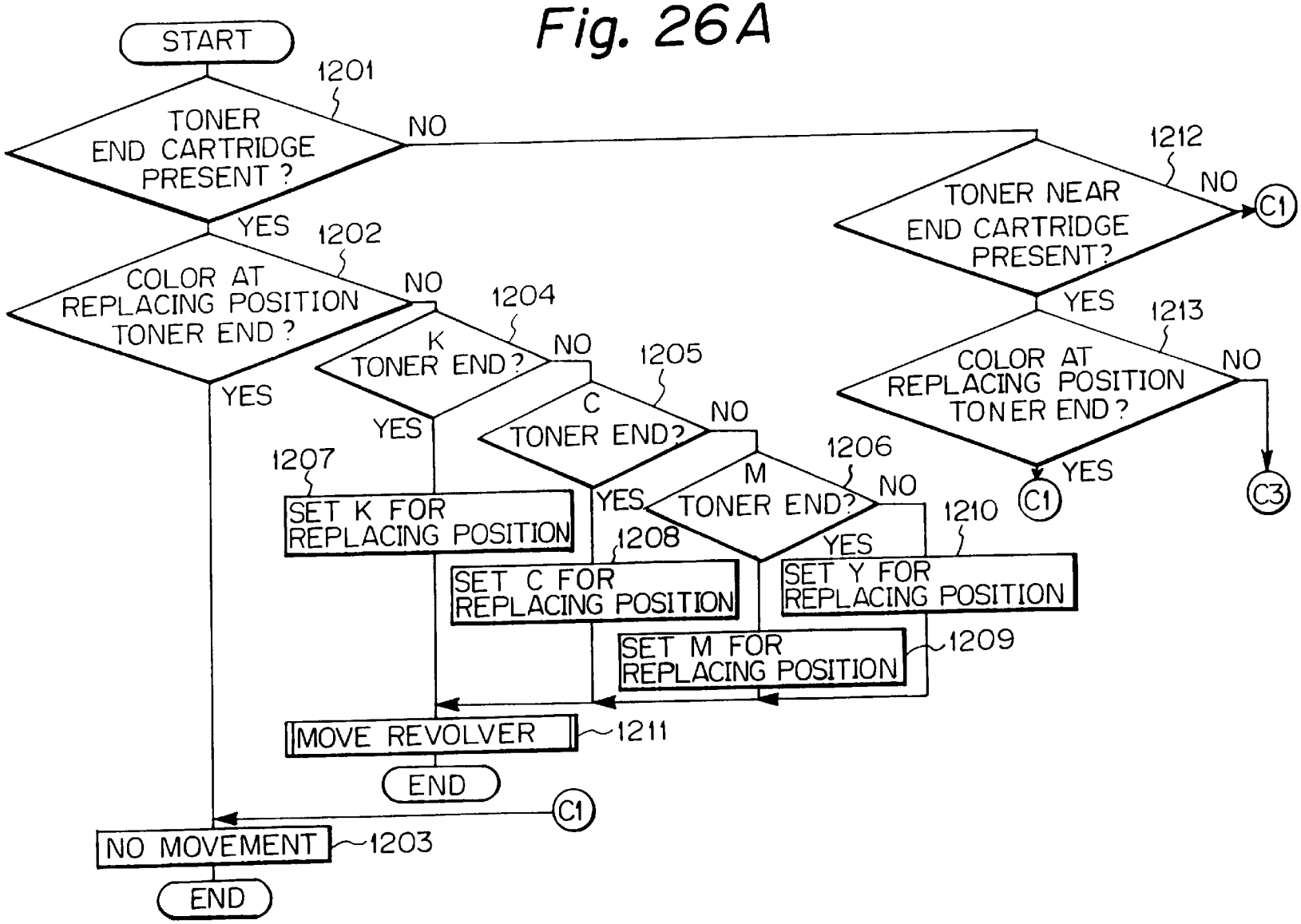
FIG. 26 is a flowchart showing a procedure for moving the cartridges in a full-color mode and representative of a third embodiment of the present invention.
Figure 26B:
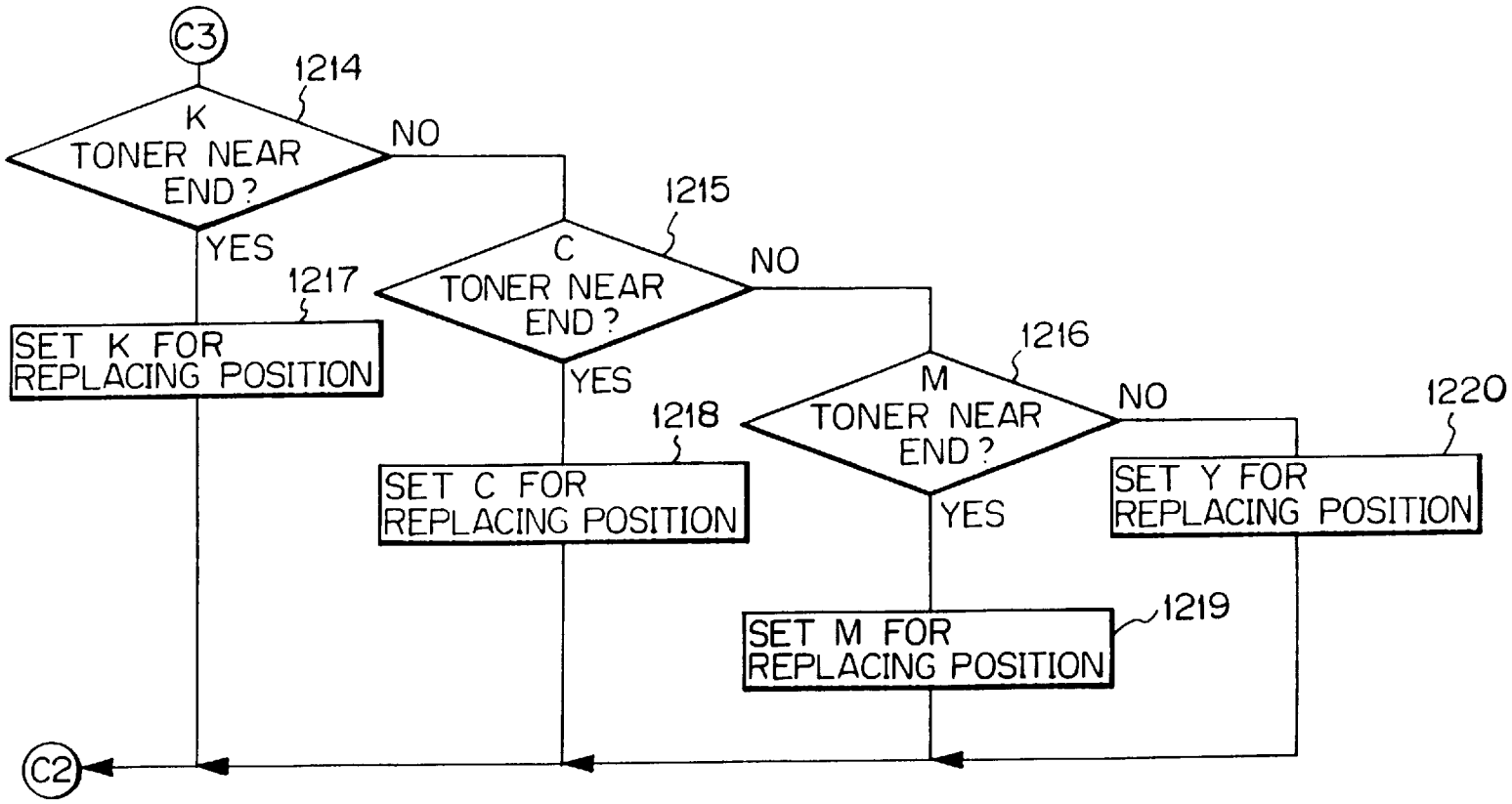

As shown in FIG. 26, when the full-color mode key is pressed, the CPU 101 determines whether or not any one of the colors is in the toner end condition (step 1201). If the answer of this step is positive, the CPU 101 determines whether or not the color located at the replacing position is in the toner end condition (step 1202). If the answer of the step 1202 is positive, the CPU 101 ends the processing without moving the revolver (step 1203). If the answer of the step 1202 is negative, the CPU determines whether or not the colors K, C and M are in the toner end condition in this order (steps 1204–1206). If any one of the colors K, C and M is in the toner end condition, the CPU 101 determines that it should be brought to the replacing position (steps 1207–1209). If the color M is not in the toner end condition, as determined in the step 1206, the CPU 101 determines that the color M should be brought to the replacing position (step 1210). Then the CPU 101 moves the revolver to bring the color in question to the replacing position (step 1211).

If none of the colors is in toner end condition, as determined in the step 1201, the CPU 101 determines whether or not any one of them is in the toner near end condition (step 1212). If the answer of this step is negative, the CPU 101 ends the processing without moving the revolver (step 1203). 1f the answer of the step 1212 is positive, the CPU 101 determines whether or not the color located at the replacing position is in the toner near end condition (step 1213). If the answer of the step 1213 is positive, the CPU 101 ends the processing without moving the revolver (step 1203)). If the answer of the step 1213 is negative, the CPU determines whether or not the colors K, C and M are in the toner near end condition in this order (steps 1214–1216). If any one of the colors K, C and M is in the toner end condition, the CPU 101 determines that it should be brought to the replacing position (steps 1217–1219). If the color M is not in the toner near end condition, as determined in the step 1216, the CPU 101 determines that the color M should be brought to the replacing position (step 1220). Then, the CPU 101 moves the revolver to bring the color in question to the replacing position (step 1211).

Figure 27A:
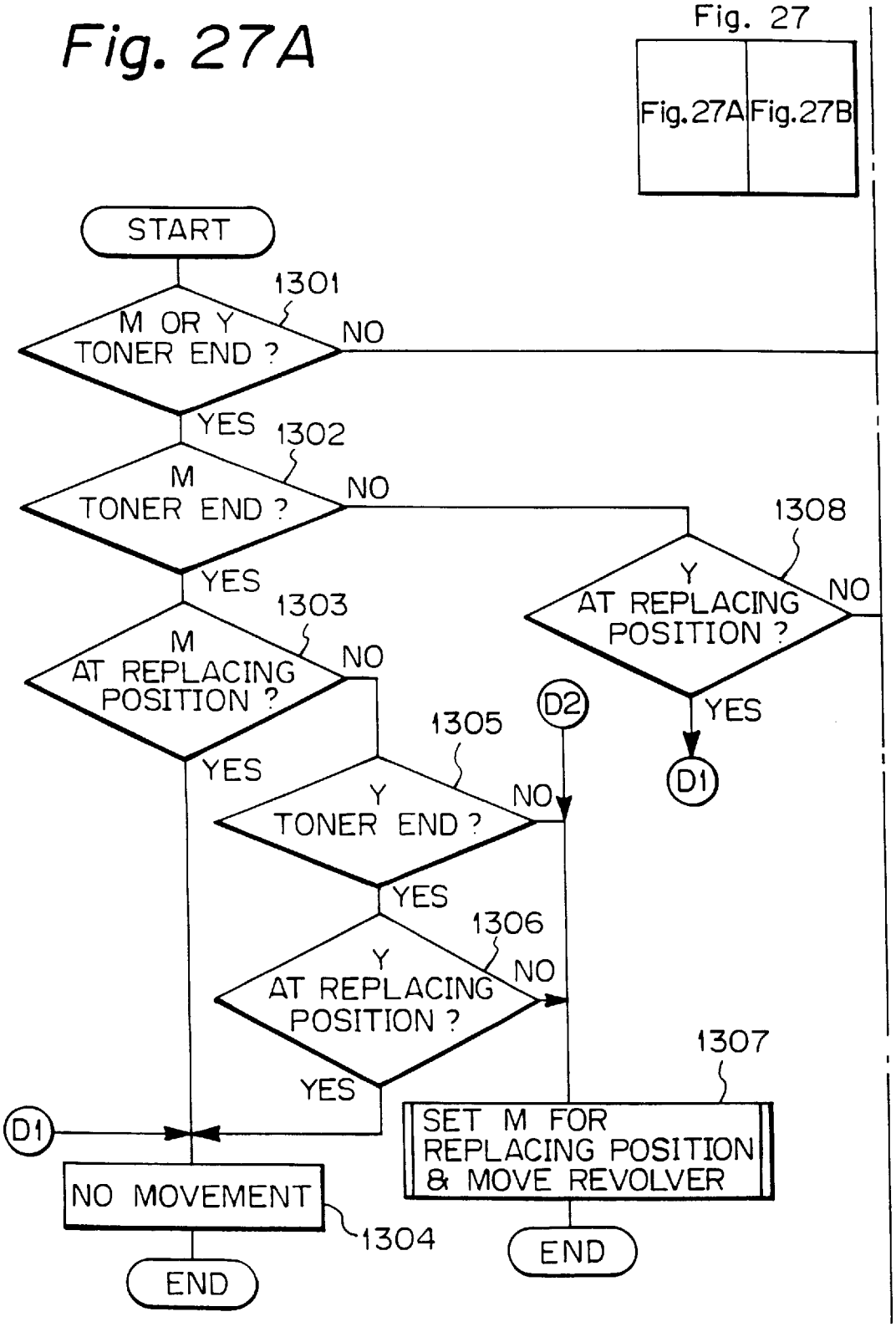
FIGS. 27–29 are flowcharts respectively demonstrating procedures included in the third embodiment for moving the cartridges in a red mode, green mode, and blue mode.
Figure 27B:
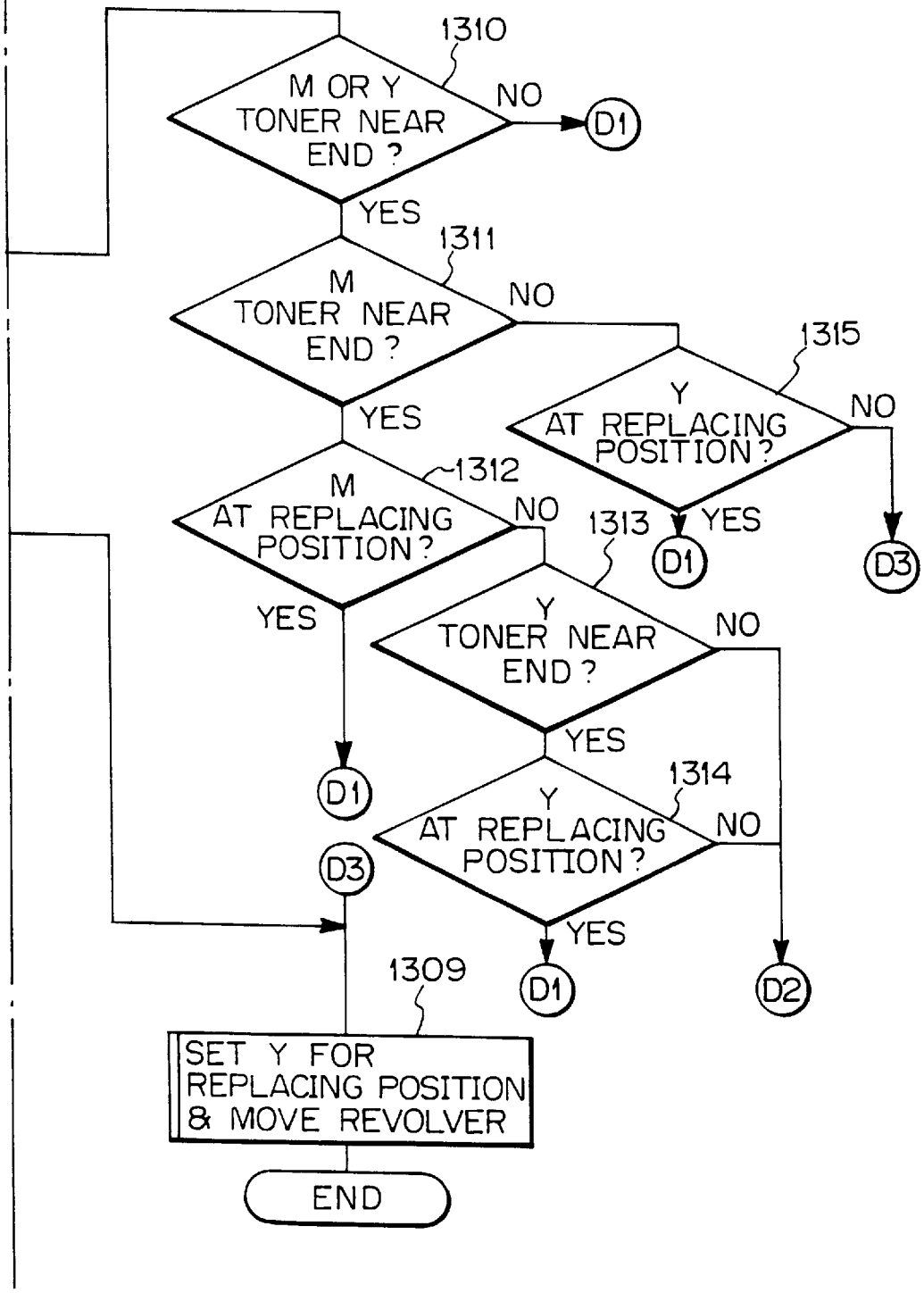

As shown in FIG. 27, when the red mode key is pressed, the CPU 101 determines whether or not the color M or Y is in the toner end condition (step 1301). If the answer of the step 1301 is positive, the CPU 101 determines whether or not the color M is in the toner end condition first (step 1302). If the answer of the step 1302 is positive, the CPU 101 determines whether or not the color M is located at the replacing position (step 1303). If the answer of the step 1303 is positive, the CPU 101 end the processing without moving the revolver (step 1304). If the answer of the step 1303 is negative, the CPU 101 determines whether or not the color Y is in the toner end condition (step 1305). If the answer of the step 1305 is positive, the CPU 101 determined whether or not the color Y is located at the replacing position (step 1306). If the answer of the step 1306 is positive, the CPU 101 ends the processing without moving the revolver (step 1304). If the answer of the step 1305 is negative and if the answer of the step 1306 is negative, the CPU 101 determines that the color M should be brought to the replacing position, and then moves the revolver (step 1307). If the answer of the step 1302 is negative, the CPU determines whether or not the color Y is located at the replacing position (step 1308). If the answer of the step 1308 is positive, the CPU 101 ends the processing without moving the revolver (step 1304). If the answer of the step 1308 is negative, the CPU 101 determines that the color Y should be brought to the replacing position, and then moves the revolver (step 1309).

On the other hand, if neither the color M nor the color Y is in the toner end condition, the CPU 101 determines whether or not M or Y is in the toner near end condition (step 1310). If the answer of the step 1310 is positive, the CPU 101 determines whether or not the color M is in the toner near end condition first (step 1311). If the answer of the step 1311 is positive, the CPU 101 determines whether or not the color M is located at the replacing position (step 1312). If the answer of the step 1312 is positive, the CPU 101 ends the processing without moving the revolver (step 1304). If the answer of the step 1312 is negative, the CPU 101 determines whether or not the color Y is in the toner near end condition (step 1313). If the answer of the step 1313 is positive, the CPU 101 determines whether or not the color Y is located at the replacing position (step 1314). If the answer of the step 1314 is positive, the CPU 101 ends the processing without moving the revolver (step 1304). If the answer of the step 1313 is negative and if the answer of the step 1314 is negative, the CPU 101 determines that the color M should be brought to the replacing position, and then moves the revolver (step 1307). if the answer of the step 1311 is negative, the CPU determines whether or not the color Y is located at the replacing position (step 1315). If the answer of the step 1315 is positive, the CPU 101 ends the processing without moving the revolver (step 1304). If the answer of the step 1315 is negative, the CPU 101 determines that the color Y should be brought to the replacing position, and then moves the revolver (step 1309).

Figure 28A:
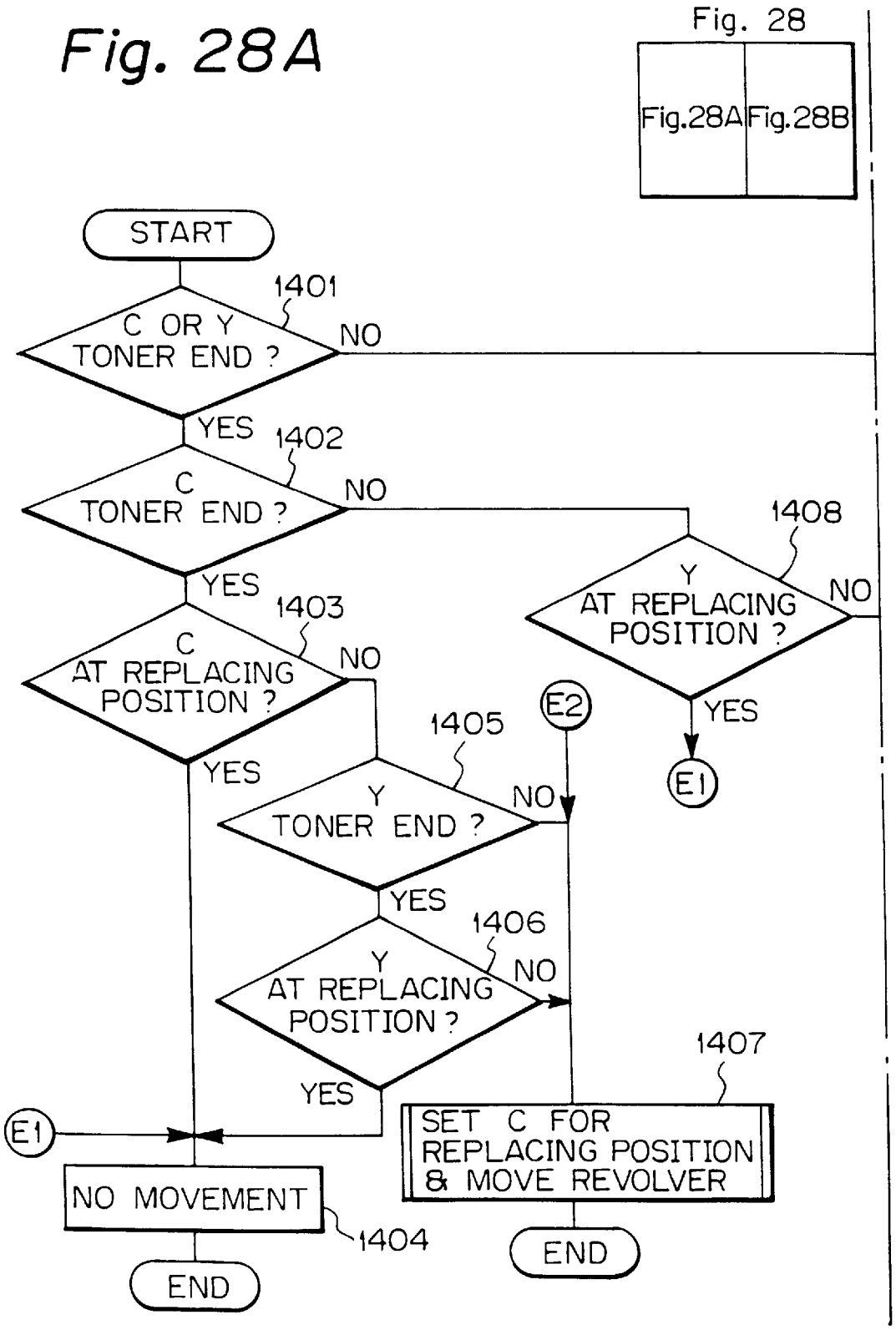
Figure 28B:
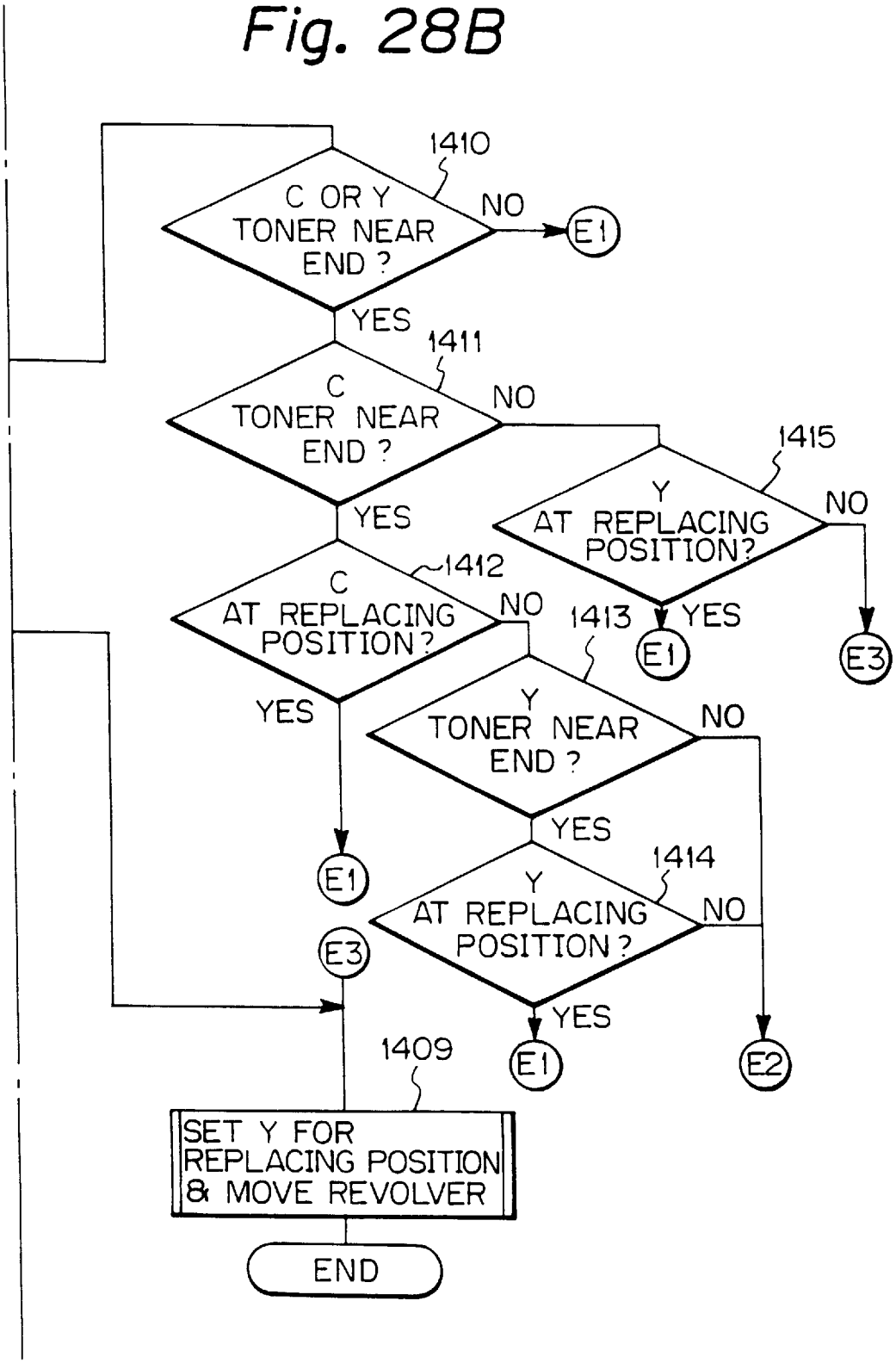

As shown in FIG. 28, when the green mode key is pressed, the CPU 10 determines whether or not the color C or Y is in the toner end condition (step 1401). If the answer of the step 1401 is positive, the CPU 101 determines whether or not the color C is in the toner end condition first (step 1402). If the answer of the step 1402 is positive, the CPU 101 determines whether or not the color C is located at the replacing position (step 1403). If the answer of the step 1403 is positive, the CPU 101 ends the processing without moving the revolver (step 1404). If the answer of the step 1403 is negative, the CPU 101 determines whether or not the color Y is in the toner end condition (step 1405). If the answer of the step 1405 is positive, the CPU 101 determines whether or not the color Y is located at the replacing position (step 1406). If the answer of the step 1406 is positive, the CPU 101 ends the processing without moving the revolver (step 1404). If the answer of the step 1405 is negative and if the answer of the step 1406 is negative, the CPU 101 determines that the color C should be brought to the replacing position, and then moves the revolver (step 1407). If the answer of the step 1402 is negative, the CPU determines w hether or not the color Y is located at the replacing position (step 1408). If the answer of the step 1408 is positive, the CPU 101 ends the processing without moving the revolver (step 1404). If the answer of the step 1408 is negative, the CPU 101 determines that the color Y should be brought to the replacing position, and then moves the revolver (step 1409).

On the other hand, if neither the color C nor the color Y is in the toner end condition, the CPU 101 determines whether or not C or Y is in the toner near end condition (step 1410). If the answer of the step 1410 is positive, the CPU 101 determines whether or not the color C is in the toner near end condition first (step 1411). If the answer of the step 1411 is positive, the CPU 101 determines whether or not the color C is located at the replacing position (step 1412). If the answer of the step 1412 is positive, the CPU 101 ends the processing without moving the revolver (step 1404). If the answer of the step 1412 is negative, the CPU 101 determines whether or not the color Y is in the toner near end condition (step 1413). If the answer of the step 1413 is positive, the CPU 101 determines whether or not the color Y is located at the replacing position (step 1414). If the answer of the step 1414 is positive, the CPU 101 ends the processing without moving the revolver (step 1404). If the answer of the step 1413 is negative and if the answer of the step 1414 is negative, the CPU 101 determines that the color C should be brought to the replacing position, and then moves the revolver (step 1407). If the answer of the step 1411 is negative, the CPU determines whether or not the color Y is located at the replacing position (step 1415). If the answer of the step 1415 is positive, the CPU 101 ends the processing without moving the revolver (step 1404). If the answer of the step 1415 is negative, the CPU 101 determines that the color Y should be brought to the replacing position, and then moves the revolver (step 1409).

Figure 29A:
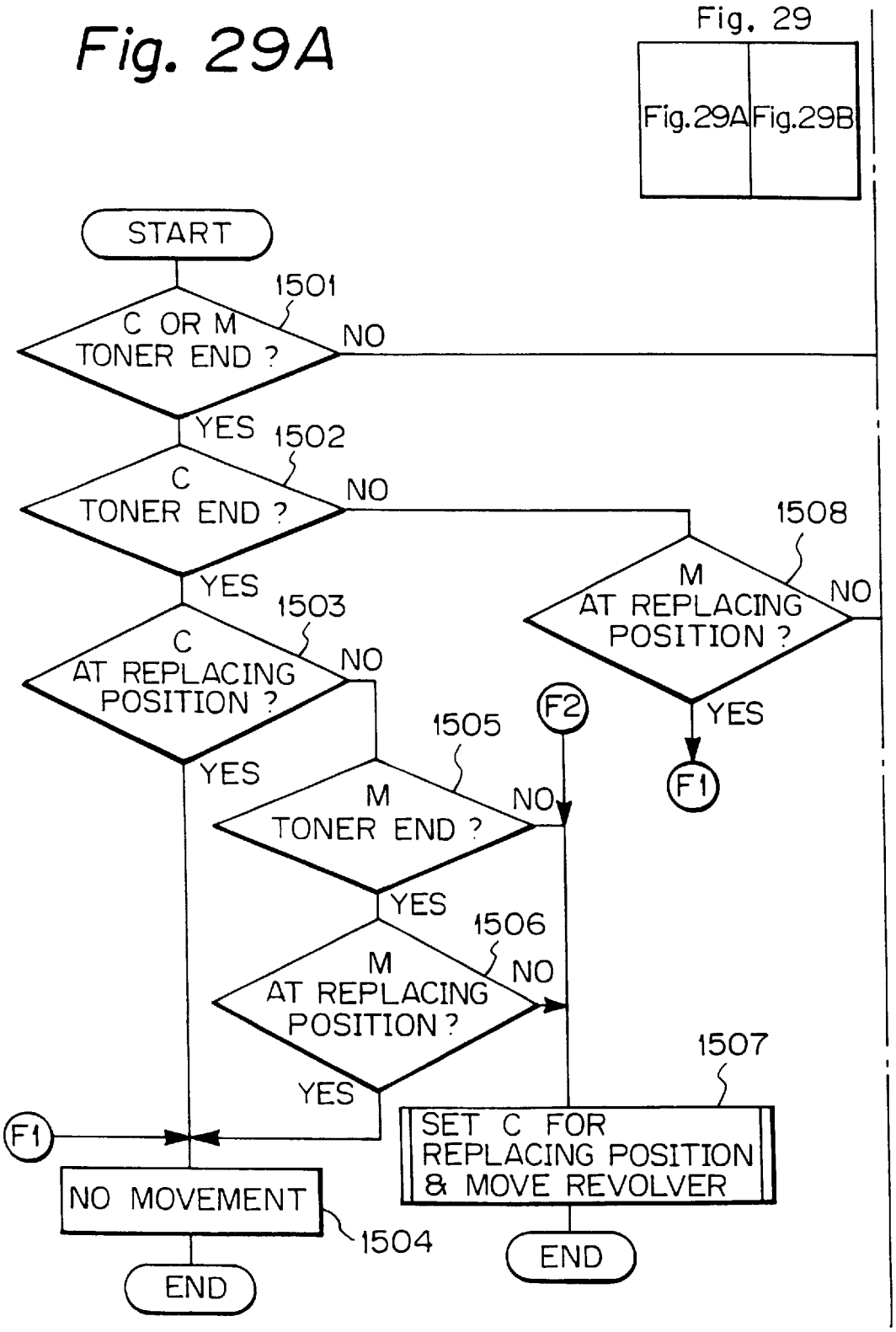
Figure 29B:
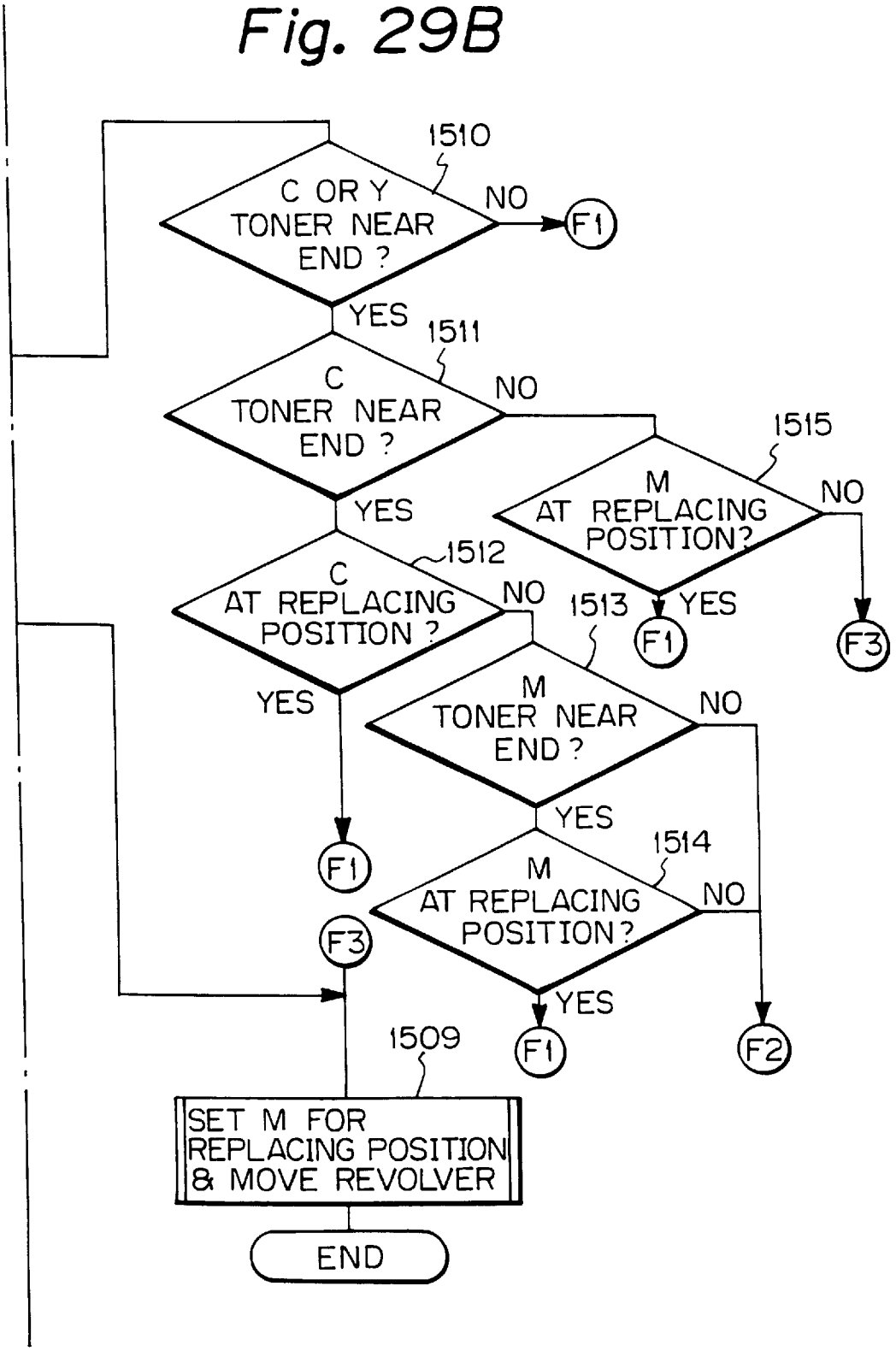

As shown in FIG. 29, when the blue mode key is pressed, the CPU 101 determines whether or not the color C or M is in the toner end condition (step 1501). If the answer of the step 1501 is positive, the CPU 101 determines whether or not the color C is in the toner end condition first (step 1502). If the answer of the step 1502 is positive, the CPU 101 determines whether or not the color C is located at the replacing position (step 1503). If the answer of the step 1503 is positive, the CPU 101 ends the processing without moving the revolver (step 1504). If the answer of the step 1503 is negative, the CPU 101 determines whether or not the color M is in the toner end condition (step 1505). If the answer of the step 1505 is positive, the CPU 101 determines whether or not the color M is located at the replacing position (step 1506). If the answer of the step 1506 is positive, the CPU 101 ends the processing without moving the revolver (step 1504). If the answer of the step 1505 is negative and if the answer of the step 1506 is negative, the CPU 101 determines that the color C should be brought to the replacing position, and then moves the revolver (step 1507). If the answer of the step 1502 is negative, the CPU determines whether or not the color M is located at the replacing position (step 1508). If the answer of the step 1408 is positive, the CPU 101 ends the processing without moving the revolver (step 1404). If the answer of the step 1508 is negative, the CPU 101 determines that the color M should be brought to the replacing position, and then moves the revolver (step 1509).

On the other hand, if neither the color C nor the color M is in the toner end condition, the CPU 101 determines whether or not C or M is in the toner near end condition (step 1510). If the answer of the step 1510 is positive, the CPU 101 determines whether or not the color C is in the toner near end condition first (step 1511). If the answer of the step 1511 is positive, the CPU 101 determines whether or not the color C is located at the replacing position (step 1512). If the answer of the step 1512 is positive, the CPU 101 ends the processing without moving the revolver (step 1504). If the answer of the step 1512 is negative, the CPU 101 determines whether or not the color M is in the toner near end condition (step 1513). If the answer of the step 1513 is positive, the CPU 101 determines whether or not the color M is located at the replacing position (step 1514). If the answer of the step 1514 is positive, the CPU 101 ends the processing without moving the revolver (step 1504). If the answer of the step 1513 is negative and if the answer of the step 1514 is negative, the CPU 101 determines that the color C should be brought to the replacing position, and then moves the revolver (step 1507). If the answer of the step 1511 is negative, the CPU determines whether or not the color M is located at the replacing position (step 1515). If the answer of the step 1515 is positive, the CPU 101 ends the processing without moving the revolver (step 1504). If the answer of the step 1515 is negative, the CPU 101 determines that the color M should be brought to the replacing position, and then moves the revolver (step 1509).

As stated above, when the full color mode key or the two-color mode key is pressed, the CPU 101 moves the revolver only if the toner cartridge reached the toner end or toner near end condition is not located at the replacing position. This obviates an occurrence that despite that the cartridge of color to be used and reached the toner end condition exists at the replacing position, another toner cartridge also reached the toner end condition, but of higher priority, is moved to the replacing position when the mode key is pressed. This frees the revolver from wasteful movement and reduces the waiting time up to the start of image formation. This is also true when the cartridge of color to be used and reached the toner near end condition exists at the replacing position.

4th Embodiment

In the third embodiment, among the cartridges designated by the color mode key pressed by the operator, one to be replaced is searched for in accordance with priority with respect to color and the amount of toner. Therefore, whenever the color mode key is pressed, the toner cartridge of higher priority is brought to the replacing position. It follows that when the colors C and M to be used in the blue mode, for example, both are in the toner end or toner near end condition, the toner cartridge of lower priority cannot be replaced unless the red mode (M and Y) key giving priority to M is pressed. However, when another color mode key is pressed for replacement, the color mode must be restored to the previous color mode. The operator is therefore likely to forget to return the color mode after the replacement of the cartridge, causing an image to be formed in an unexpected color.

In the fourth embodiment, when the color mode key identical with the color mode already selected is pressed, the cartridges to be replaced are sequentially moved to the replacing position every time the above key is pressed. Procedures particular to this embodiment will be described with reference to FIGS. 30–34.

Figures 30, 30A, 30B:
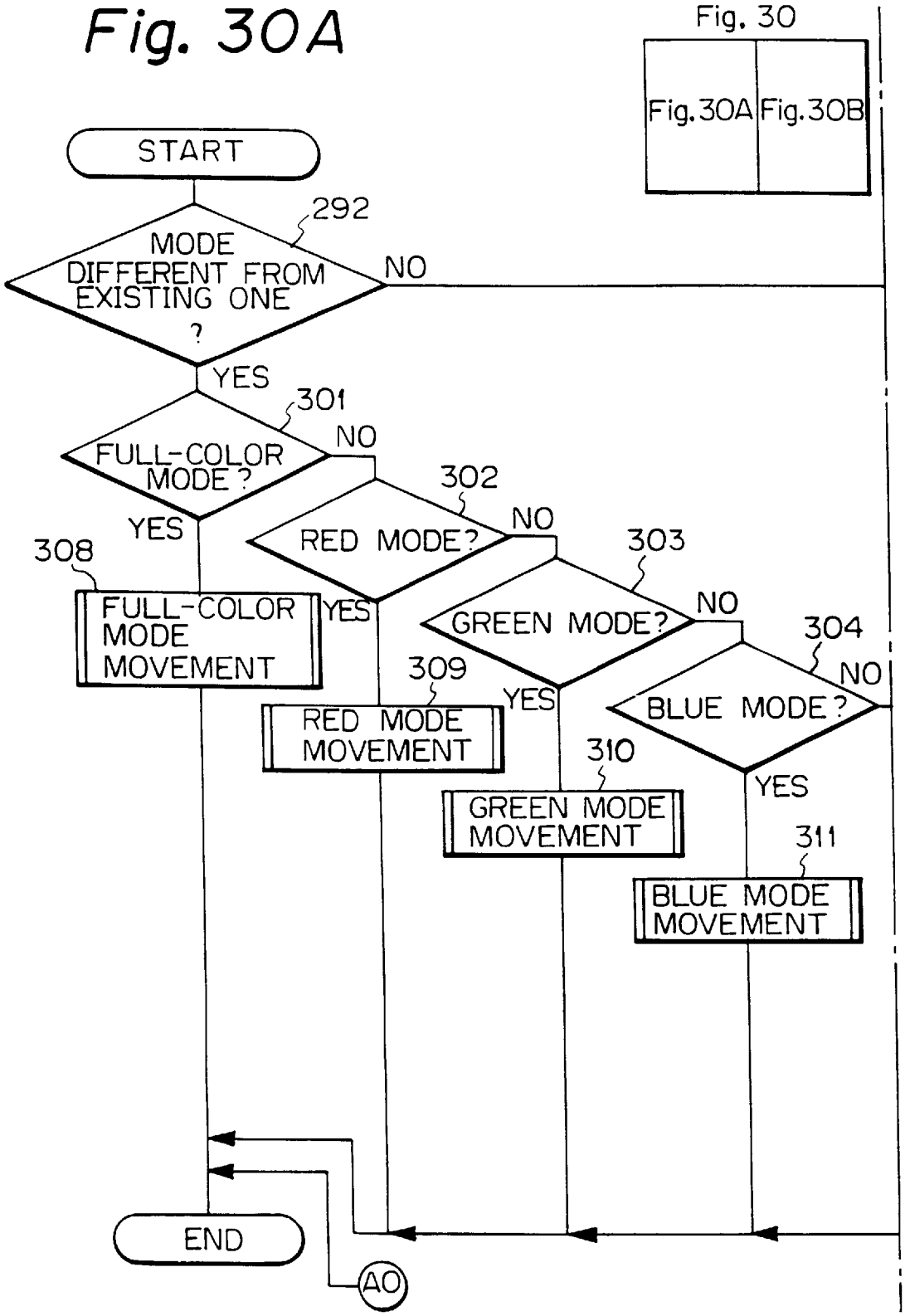
FIG. 30 is a flowchart representative of a fourth embodiment of the present invention and showing a procedure for executing a particular manner of movement, depending on the color mode key pressed by the operator.
Figure 30B:
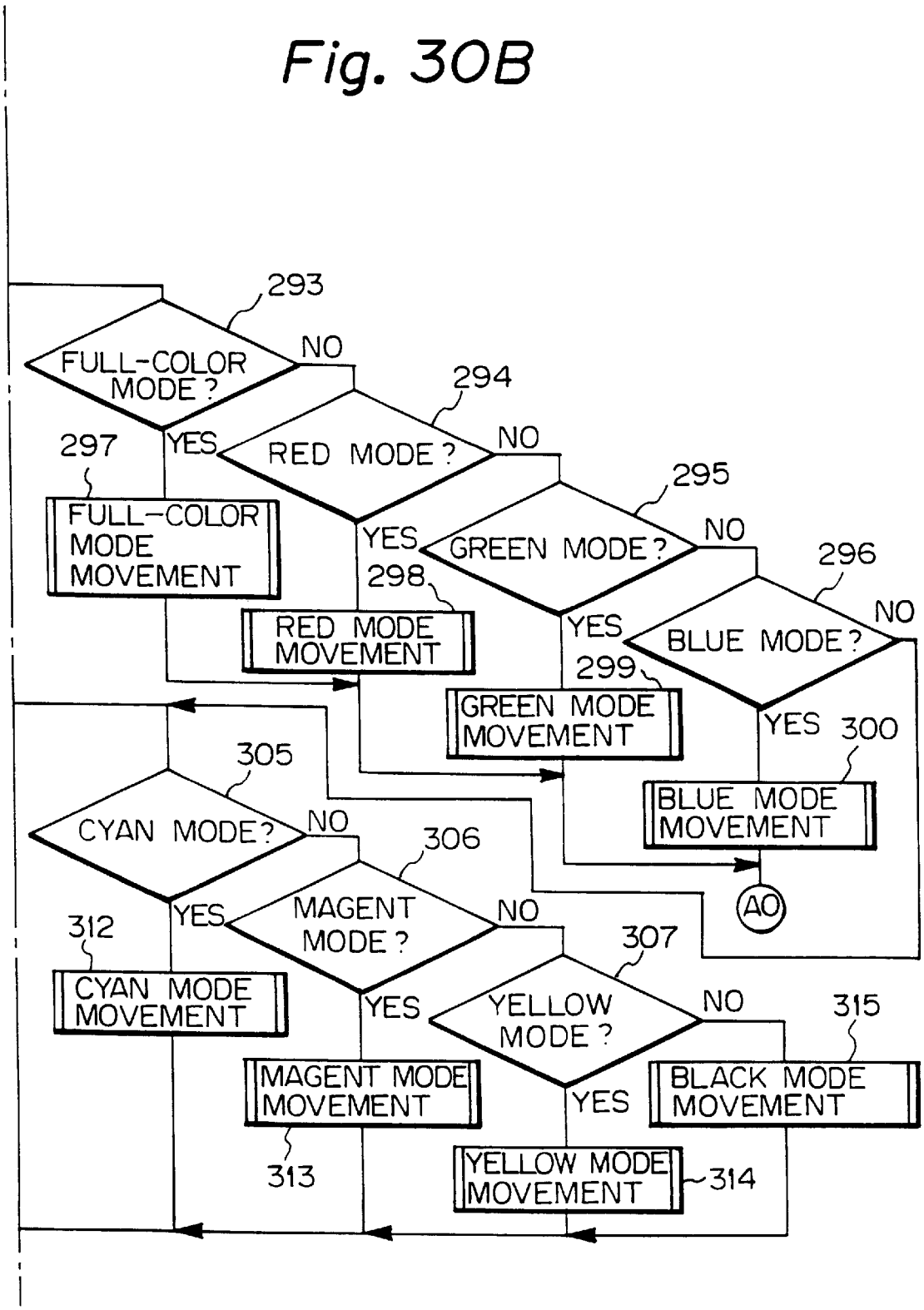

FIG. 30 demonstrates processing for moving the cartridges as designated via color mode keys. As shown, when the operator presses desired color mode key, the CPU 101 determines whether or not the mode selected is different from the mode already selected (step 292). If the mode designated by the key is identical with the existing mode, the CPU 101 identifies the mode (steps 292–296). Then, the CPU 101 executes processing assigned to the identified mode (steps 297–300). It is to be noted that if the mode is not the blue mode (N, step 296), i.e., if the existing mode is not the full-color mode or the two-color mode, then the CPU 101 executes a step 305. If the answer of the step 292 is positive, the CPU 101 determines the mode designated by the key (steps 301–307), and executes processing assigned to the designated mode (steps 308–315).

FIGS. 31–34 each shows particular processing to be executed in each mode as a subroutine belonging to the routine of FIG. 30. In the illustrative embodiment, the CPU 101 executes particular processing, depending on whether or not the mode designated by the pressed mode key is different from the mode already selected. The processing to be executed when the designated mode is different from the existing mode is identical with the processing shown in FIG. 17 (steps 308–315) and will not be described in order to avoid redundancy. The processing to be executed when the designated mode is identical with the existing mode will be described with reference to FIGS. 31–34.

Figure 31A:
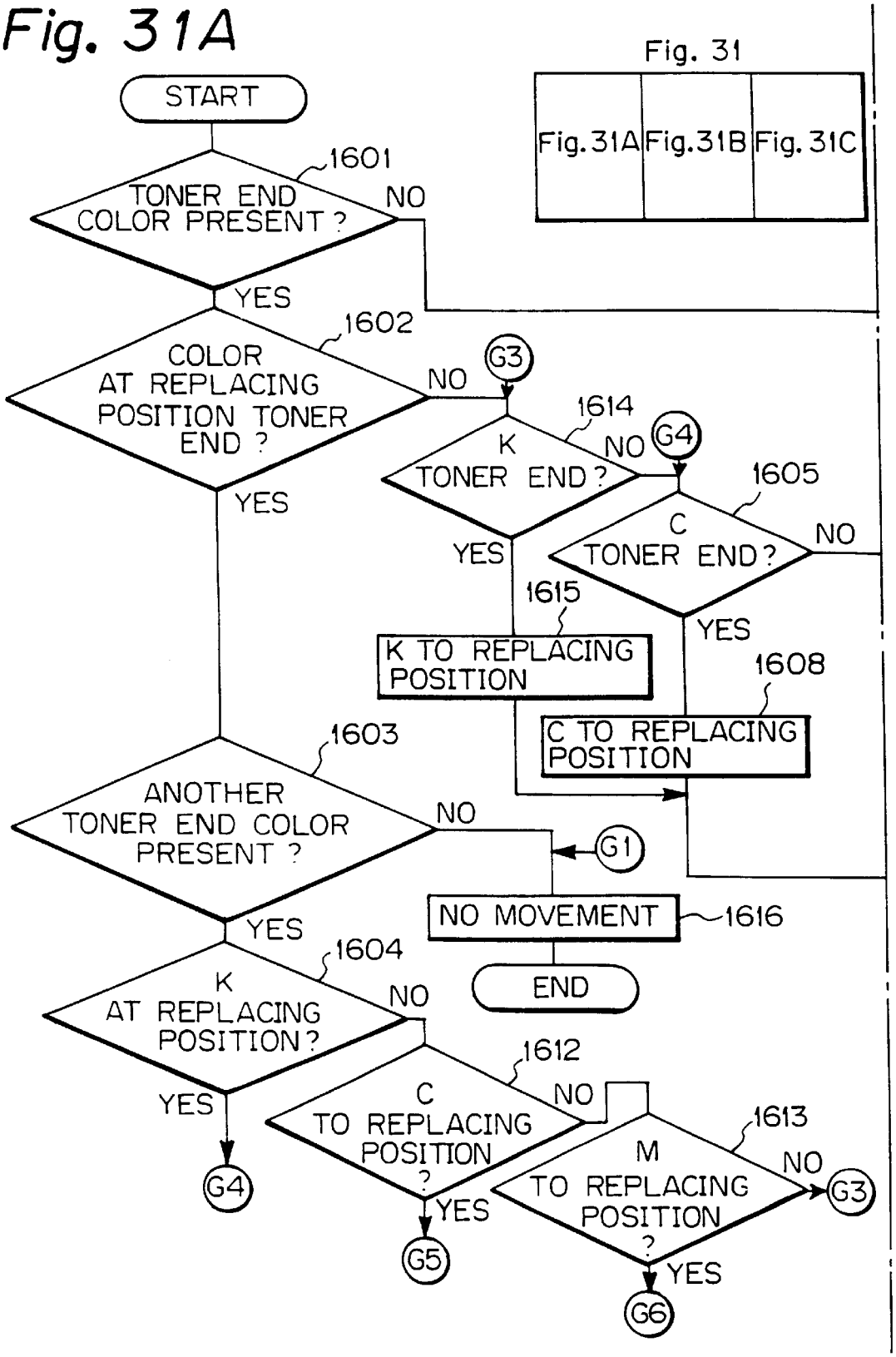
FIG. 31 is a flowchart showing a procedure for moving the cartridges in a full-color mode particular to the fourth embodiment.
Figure 31B:
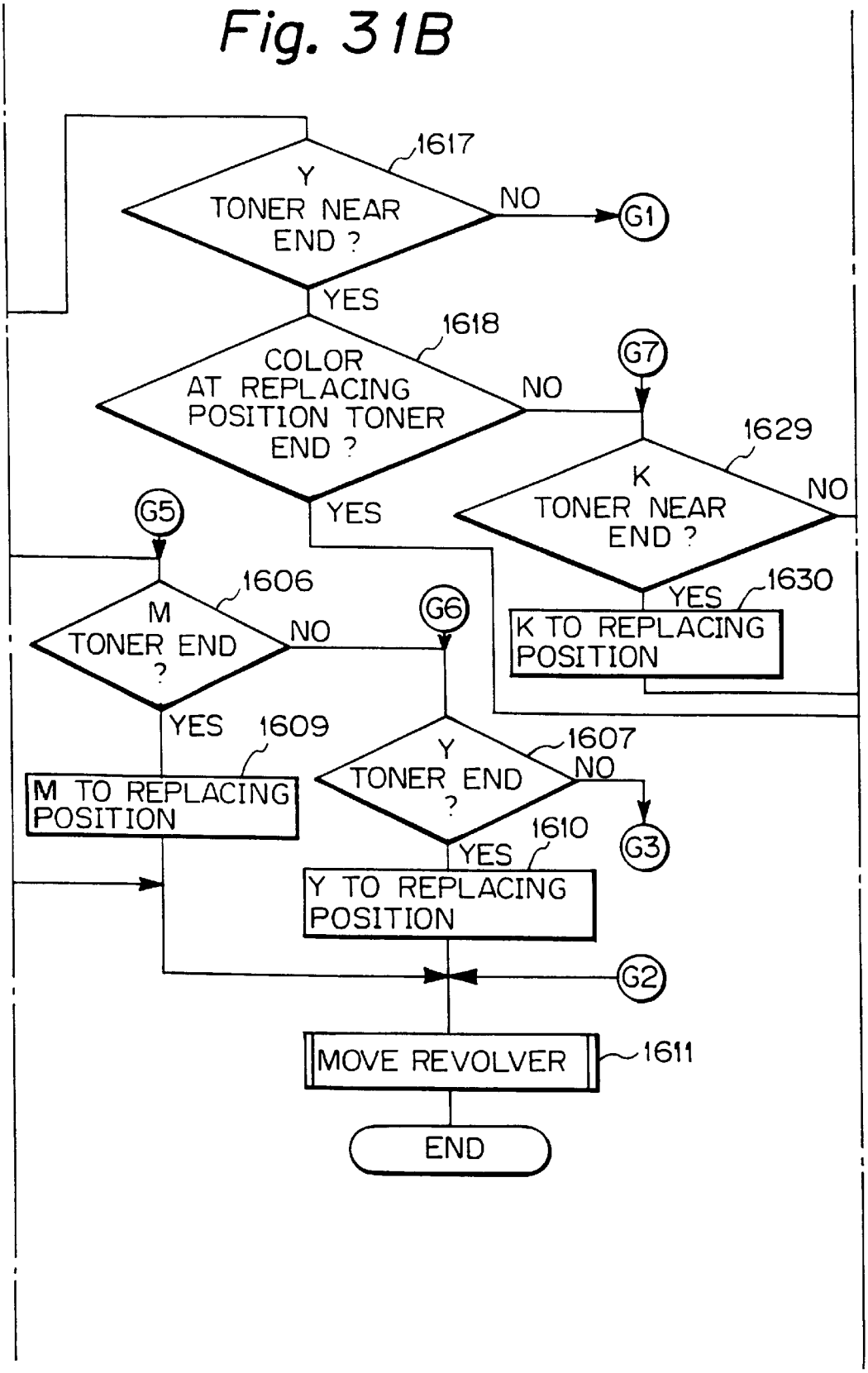
Figure 31C:
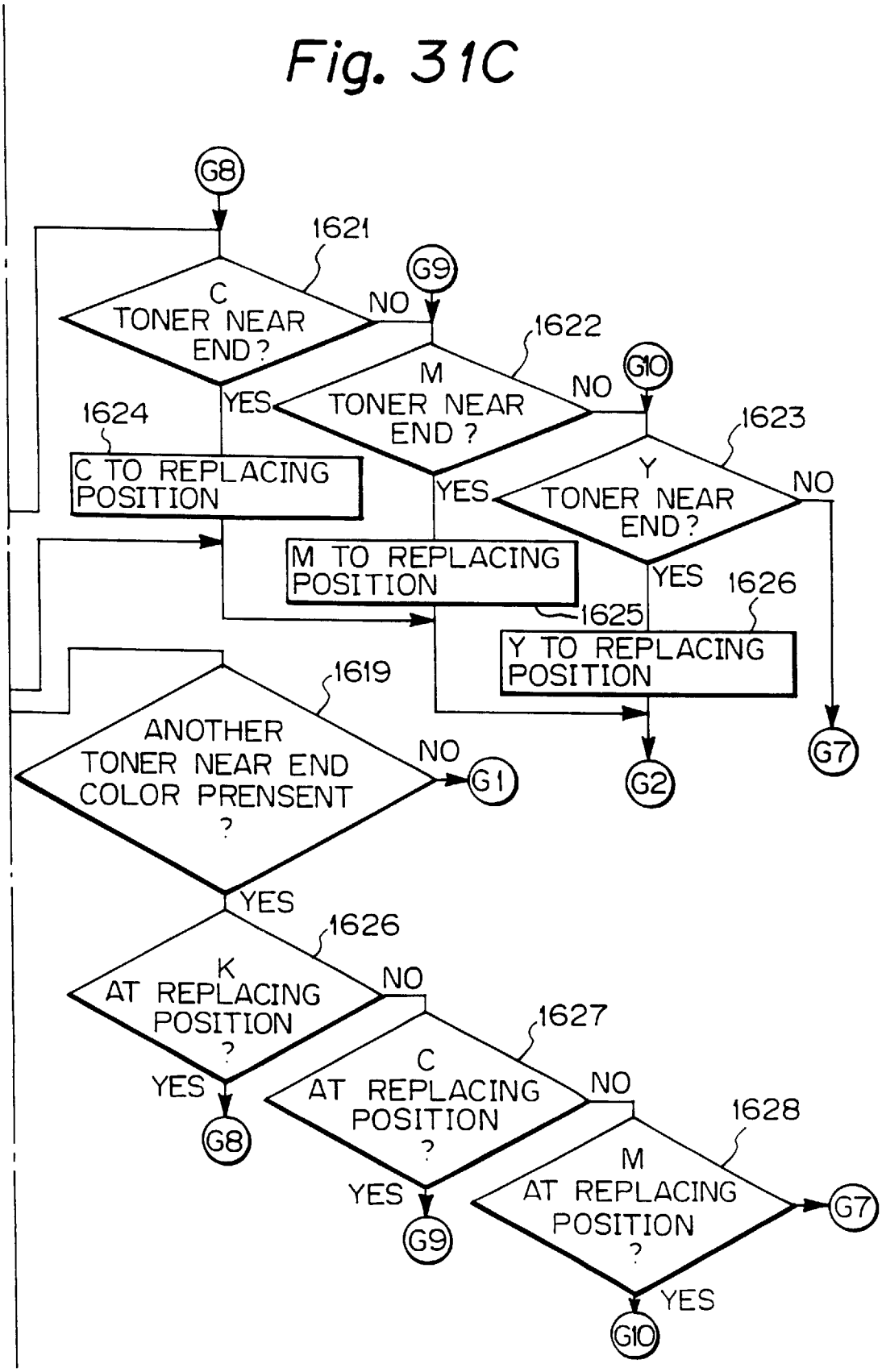

FIG. 31 shows processing for moving the cartridges in the full-color mode. As shown, when the mode designated by the color mode key is identical with the mode already selected, the CPU 101 determines whether or not any one of the colors is in the toner end condition (step 1601). If the answer of the step 1601 is positive, the CPU 101 determines whether or not the color existing at the replacing position is in the toner end condition (step 1602). If the answer of the step 1602 is negative, the CPU 101 searches the colors K, C, M and Y in this order to see if any one of them is in the toner end condition (steps 1614 and 1605–1607). If any one of the colors K–Y is in the toner end condition, the CPU 101 determines that it should be brought to the replacing position (steps 1615 and 1608–1610), and then moves the revolver (step 1611). If the color Y is not in the toner end condition, as determined in the step 1607, the CPU 101 returns to the step 1614.

As stated above, if the color existing at the replacing position when the same full color mode key is pressed again, the CPU 101 brings the cartridge of higher priority and reached the toner end condition to the replacing position.

If the color existing at the replacing position is in the toner end condition, as determined in the step 1602, the CPU 101 determines whether or not any other color is in the toner end condition (step 1603). If the answer of the step 1603 is positive, the CPU 101 determines whether or not the color K is present at the replacing position (step 1604). If the answer of the step 1604 is positive, the CPU 101 executes a step 1605; if otherwise, it determines whether or not the color C is present at the replacing position (step 1612). If the answer of the step 1612 is positive, the CPU 101 executes a step 1606; if otherwise, it determines whether or not the color M is present at the replacing position (step 1613). If the answer of the step 1613 is positive, the CPU 101 executes a step 1607; if otherwise, the CPU 101 returns to the step 1614. If the answer of the step 1603 is negative, the CPU 101 ends the processing without moving the revolver (step 1616).

As stated above, if the color existing at the replacing position is in the toner end condition when the same full-color mode key is pressed, the CPU 101 brings the cartridge of the next degree of priority and reached the toner end condition to the replacing position. That is, when the operator again presses the full-color mode key despite that the color reached the toner end condition exists at the replacing position, the CPU 101 determines that the user does not intend to replace such a color, but desires to replace another color also reached the toner end condition.

If no colors are in the toner end condition, as determined in the step 1601, the CPU 101 determines whether or not any one of the colors is in the toner near end condition (step 1617). If the answer of the step 1617 is positive, the CPU 101 determines whether or not the color existing at the replacing position is in the toner near end condition (step 1618). If the answer of the step 1618 is negative, the CPU 101 searches the colors K, C, M and Y in this order to see if any one of them is in the toner near end condition (steps 1629 and 1621–1623). If any one of the colors K–Y is in the toner end condition, the CPU 101 determines that it should be brought to the replacing position (steps 1630 and 1624–1626), and then moves the revolver (step 1611). If the color Y is not in the toner near end condition, as determined in the step 1623, the CPU 101 returns to the step 1629.

As stated above, if the color existing at the replacing position when the same full color mode key is pressed again is not in the toner end condition, the CPU 101 brings the cartridge of higher priority and reached the toner near end condition to the replacing position.

If the color existing at the replacing position is in the toner near end condition, as determined in the step 1618, the CPU 101 determines whether or not any other color is in the toner near end condition (step 1619). If the answer of the step 1619 is positive, the CPU 101 determines whether or not the color K is present at the replacing position (step 1626). If the answer of the step 1626 is positive, the CPU 101 executes a step 1621; if otherwise, it determines whether or not the color C is present at the replacing position (step 1627). If the answer of the step 1627 is positive, the CPU 101 executes a step 1622; if otherwise, it determines whether or not the color M is present at the replacing position (step 1628). If the answer of the step 1628 is positive, the CPU 101 executes a step 1623; if otherwise, the CPU 101 returns to the step 1629. If the answer of the step 1619 is negative, the CPU 101 ends the processing without moving the revolver (step 1616).

As stated above, if the color existing at the replacing position is in the toner near end condition when the same full-color mode key is pressed, the CPU 101 brings the cartridge of the next degree of priority and reached the toner near end condition to the replacing position. That is, when the operator again presses the full-color mode key despite that the color reached the toner near end condition exists at the replacing position, the CPU 101 determines that the user does not intend to replace such a color, but desires to replace another color also reached the toner near end condition.

Figure 32A:
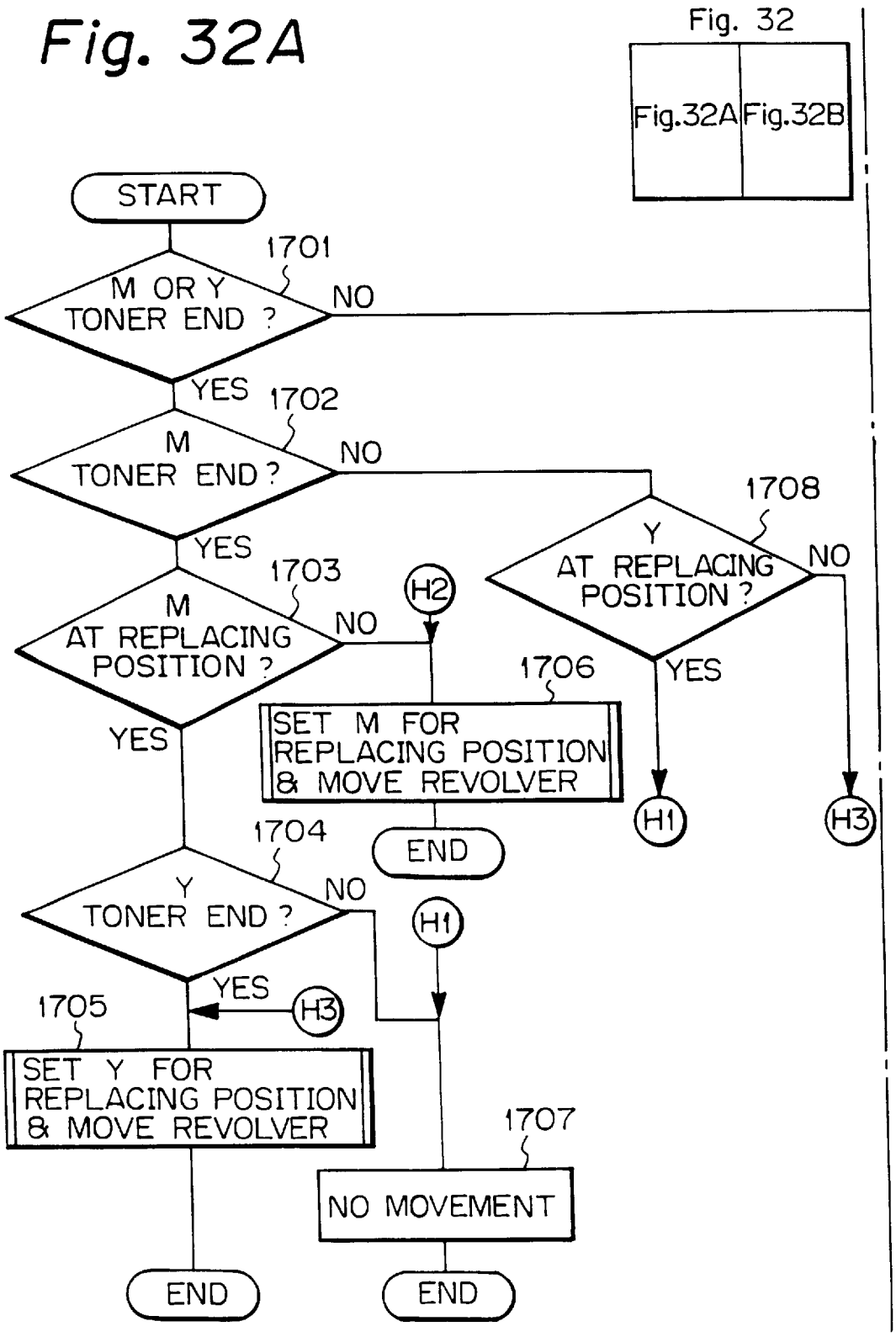
FIGS. 32–34 are flowcharts respectively demonstrating procedures included in the fourth embodiment for moving the cartridges in a red mode, green mode, and blue mode.
Figure 32B:
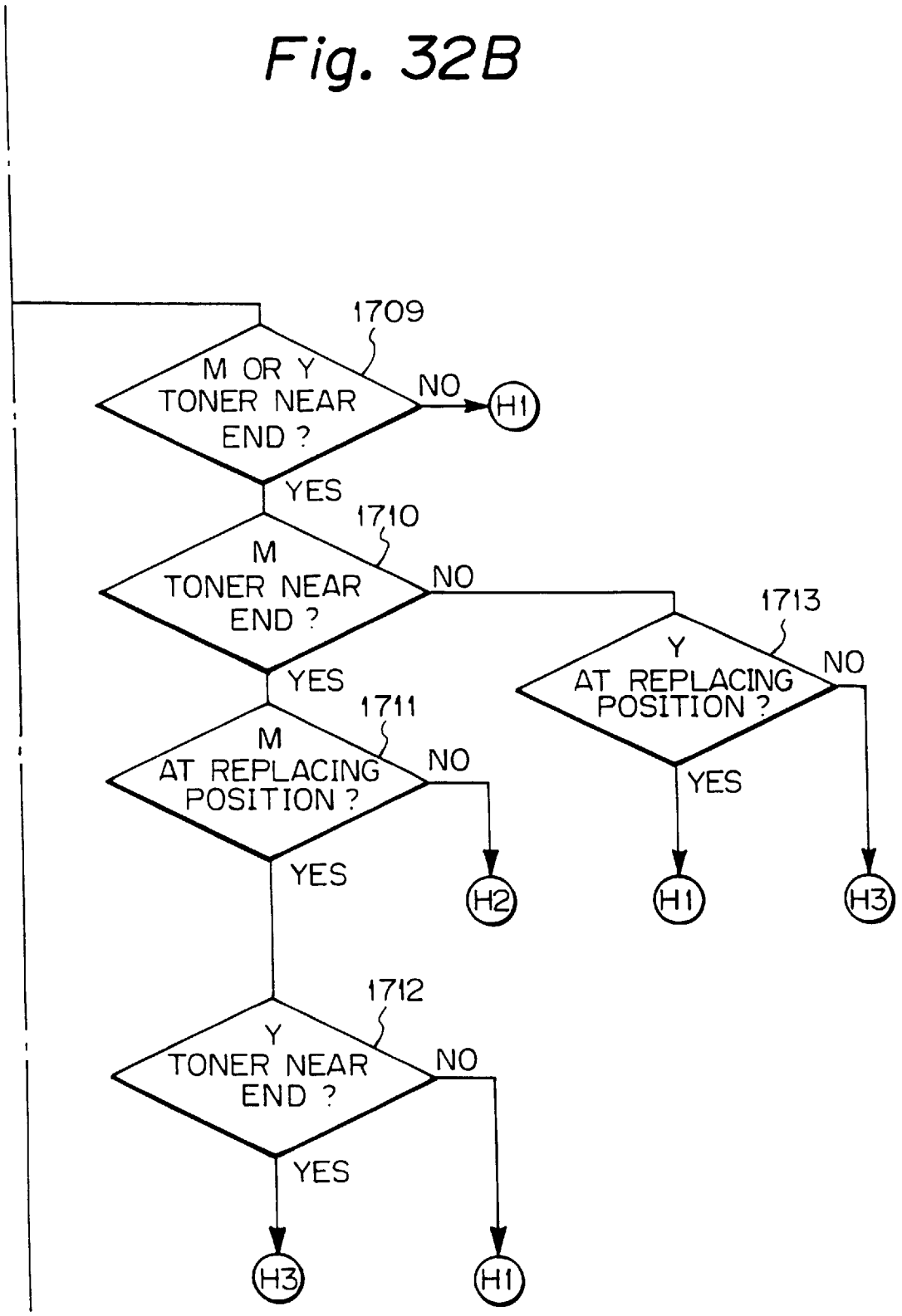

As shown in FIG. 32, when the red mode key is pressed, the CPU 101 determines whether or not the color M or Y is in the toner end condition (step 1701). If at least one of the colors M and Y is in the toner end condition, the CPU 101 determines whether or not the color M is in the toner end condition (step 1702). If the answer of the step 1702 is positive, the CPU 101 determines whether or not the color M is present at the replacing position (step 1703). If the answer of the step 1703 is negative, the CPU 101 determines that the color M should be brought to the replacing position, and the moves the revolver (step 1706).

As stated above, when the red mode key is pressed again, the CPU 101 brings the M toner cartridge of higher priority to the replacing position if the color M has reached the toner end condition and if the color M is absent at the replacing position.

If the color M is present at the replacing position, as determined in the step 1703, the CPU determines whether or not the color Y is in the toner near end condition (step 1704). If the answer of the step 1704 is positive, the CPU 101 determines that the color Y should be brought to the replacing position, and then moves the revolver (step 1705).

As stated above, if the colors M and Y are both in the toner end condition and if the color M is present at the replacing position, the CPU 101 brings the Y cartridge given the next degree of priority to the replacing position. That is, when the operator presses the red mode key again despite that the color M reached the toner end condition is present at the replacing position, the CPU 101 determines that the operator does not intend to replace the color M in the toner end condition, but desires to replace the color Y also in the toner end condition.

If the color M is not in the toner end condition, as determined in the step 1702, the CPU 101 determines whether or not the color Y is present at the replacing position (step 1708). If the answer of the step 1708 is negative, the CPU 101 executes a step 1705. That is, if only the color Y is in the toner end condition, but not located at the replacing position, the CPU 101 moves the color Y to the replacing position in response to the operation of the key. Further, if the color Y is present at the replacing position, as determined in the step 1708, the CPU 101 ends the processing without moving the revolver (step 1707).

If neither the color M nor the color Y is in the toner end condition, as determined in the step 1701, the CPU 101 determines whether or not the color M or Y is in the toner near end condition (step 1709). If at least one of the colors M and Y is in the toner near end condition, the CPU 101 determines whether or not the color M is in the toner near end condition (step 1710). If the answer of the step 1710 is positive, the CPU 101 determines whether or not the color M is present at the replacing position (step 1711). If the answer of the step 1711 is negative, the CPU 101 determines that the color M should be brought to the replacing position, and then moves the revolver (step 1706).

As stated above, when the red mode key is pressed again and when no colors are in the toner end condition, but some color is in the toner near end condition, the CPU 101 brings the M cartridge of higher priority to the replacing position if the color M has reached the toner near end condition and if the color M is absent at the replacing position.

If the color M is present at the replacing position, as determined in the step 1711, the CPU 101 determines whether or not the color Y is in the toner near end condition (step 1712). If the answer of the step 1712 is positive, the CPU 101 determines that the color Y should be brought to the replacing position, and then moves the revolver (step 1705).

As stated above, if no colors are in the toner end condition when the red mode key is pressed again, and if the colors M and Y are both in the toner near end condition, and if the color M is present at the replacing position, the CPU 101 brings the Y cartridge given the next degree if priority to the replacing position. That is, when the operator presses the red mode key again despite that the color M reached the toner near end condition is present at the replacing position, the CPU 101 determines that the operator does not intend to replace the color M in the toner end condition, but desires to replace the color Y also in the toner end condition.

If the color M is not in the toner end condition, as determined in the step 1710, the CPU 101 determines whether or not the color Y is present at the replacing position (step 1713). If the answer of the step 1713 is negative, the CPU 101 executes a step 1705. That is, if only the color Y is in the toner end condition, but not located at the replacing position, the CPU 101 moves the color Y to the replacing position in response to the operation of the key. Further, if neither the color M nor the color Y is in the toner near end condition, as determined in the step 1709, and if the color is not in the toner near end condition, as determined in the step 1712, and if the color Y is present at the replacing position, as determined in the step 1713, the CPU 101 ends the processing without moving the revolver (step 1707).

Figure 33A:
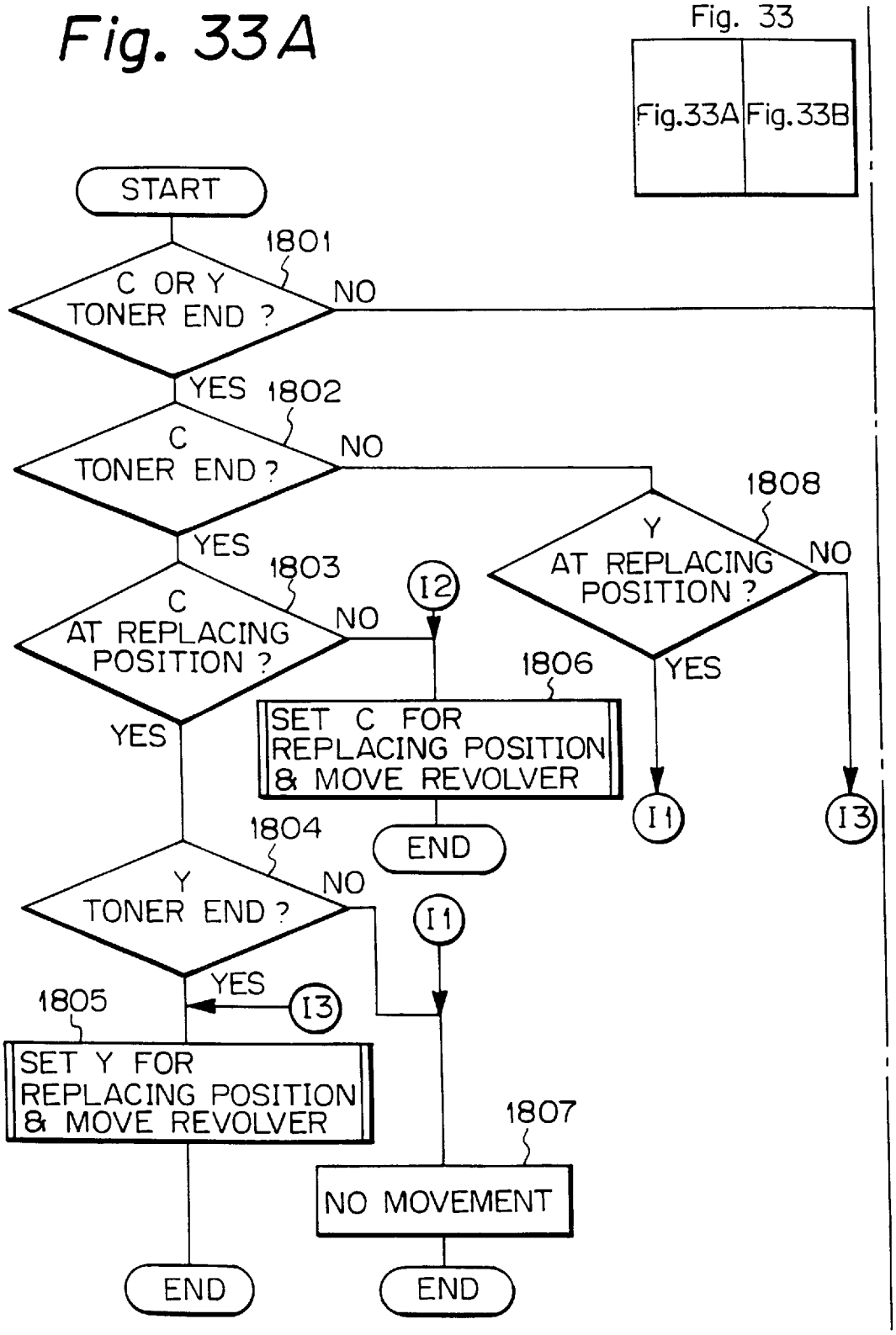
Figure 33B:
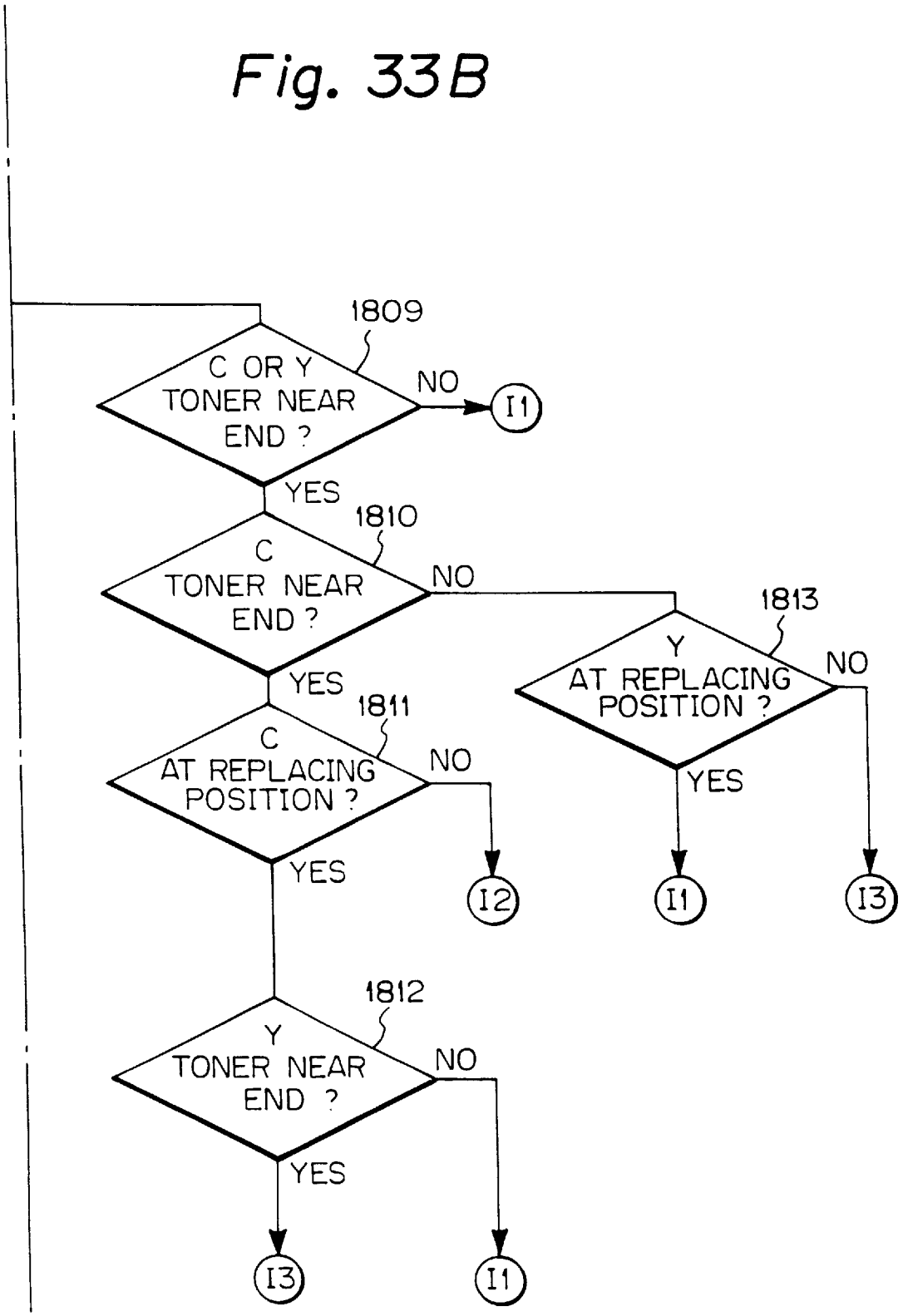

As shown in FIG. 33, when the green mode key is pressed, the CPU 101 determines whether or not the C or Y is in the toner end condition (step 1801). If at least one of the colors C and Y is in the toner end condition, the CPU 101 determines whether or not the color C is in the toner end condition (step 1802). If the answer of the step 1802 is positive, the CPU 101 determines whether or not the color C is present at the replacing position (step 1803). If the answer of the step 1803 is negative, the CPU 101 determines that the color C should be brought to the replacing position, and then moves the revolver (step 1806).

As stated above, when the green mode key is pressed again, the CPU 101 brings the C toner cartridge of higher priority to the replacing position if the color C has reached the toner end condition and if the color C is absent at the replacing position.

If the color C is present at the replacing position, as determined in the step 1803, the CPU determines whether or not the color Y is in the toner near end condition (step 1804). If the answer of the step 1804 is positive, the CPU 101 determines that the color Y should be brought to the replacing position, and then moves the revolver (step 1805).

As stated above, if the colors C and Y are both in the toner end condition when the green mode key is pressed again, and if the color C is present at the replacing position, the CPU 101 brings the Y cartridge given the next degree of priority to the replacing position. That is, when the operator presses the green mode key again despite that the color C reached the toner end condition is present at the replacing position, the CPU 101 determines that the operator does not intend to replace the color C in the toner end condition, but desires to replace the color Y also in the toner end condition.

If the color C is not in the toner end condition, as determined in the step 1802, the CPU 101 determines whether or not the color Y is present at the replacing position (step 1808). If the answer of the step 1808 is negative, the CPU 101 executes a step 1805. That is, if only the color Y is in the toner end condition, but not located at the replacing position, the CPU 101 moves the color Y to the replacing position in response to the operation of the key. Further, if the color Y is present at the replacing position, as determined in the step 1808, the CPU 101 ends the processing without moving the revolver (step 1807).

If neither the color C nor the color Y is in the toner end condition, as determined in the step 1801, the CPU 101 determines whether or not the color C or Y is in the toner near end condition (step 1809). If at least one of the colors C and Y is in the toner near end condition, the CPU 101 determines whether or not the color C is in the toner near end condition (step 1810). If the answer of the step 1810 is positive, the CPU 101 determines whether or not the color C is present at the replacing position (step 1811). If the answer of the step 1811 is negative, the CPU 101 determines that the color C should be brought to the replacing position, and then moves the revolver (step 1806).

As stated above, when the green mode key is pressed again and when no colors are in the toner end condition, but some color is in the toner near end condition, the CPU 101 brings the C toner cartridge of higher priority to the replacing position if the color C has reached the toner near end condition and if the color C is absent at the replacing position.

If the color C is present at the replacing position, as determined in the step 1811, the CPU 101 determines whether or not the color Y is in the toner near end condition (step 1812). If the answer of the step 1812 is positive, the CPU 101 determines that the color Y should be brought to the replacing position, and then moves the revolver (step 1805).

As stated above, if no colors are in the toner end condition when the green mode key is pressed again, and if the colors C and Y are both in the toner near end condition, and if the color C is present at the replacing position, the CPU 101 brings the Y toner cartridge given the next degree of priority to the replacing position. That is, when the operator presses the green mode key again despite that the color C reached the toner near end condition is present at the replacing position, the CPU 101 determines that the operator does not intend to replace the color C in the toner near end condition, but desires to replace the color Y also in the toner end condition.

If the color C is not in the toner near end condition, as determined in the step 1810, the CPU 101 determines whether or not the color Y is present at the replacing position (step 1813). If the answer of the step 1813 is negative, the CPU 101 executes a step 1805. That is, if only the color Y is in the toner near end condition, but not located at the replacing position, the CPU 101 moves the color Y to the replacing position in response to the operation of the key. Further, if neither the color C nor the color Y is in the toner near end condition, as determined in the step 1809 and if the color Y is not in the toner near end condition, as determined in the step 1812, and if the color Y is present at the replacing position, as determined in the step 1813, the CPU 101 ends the processing without moving the revolver (step 1807).

Figure 34A:
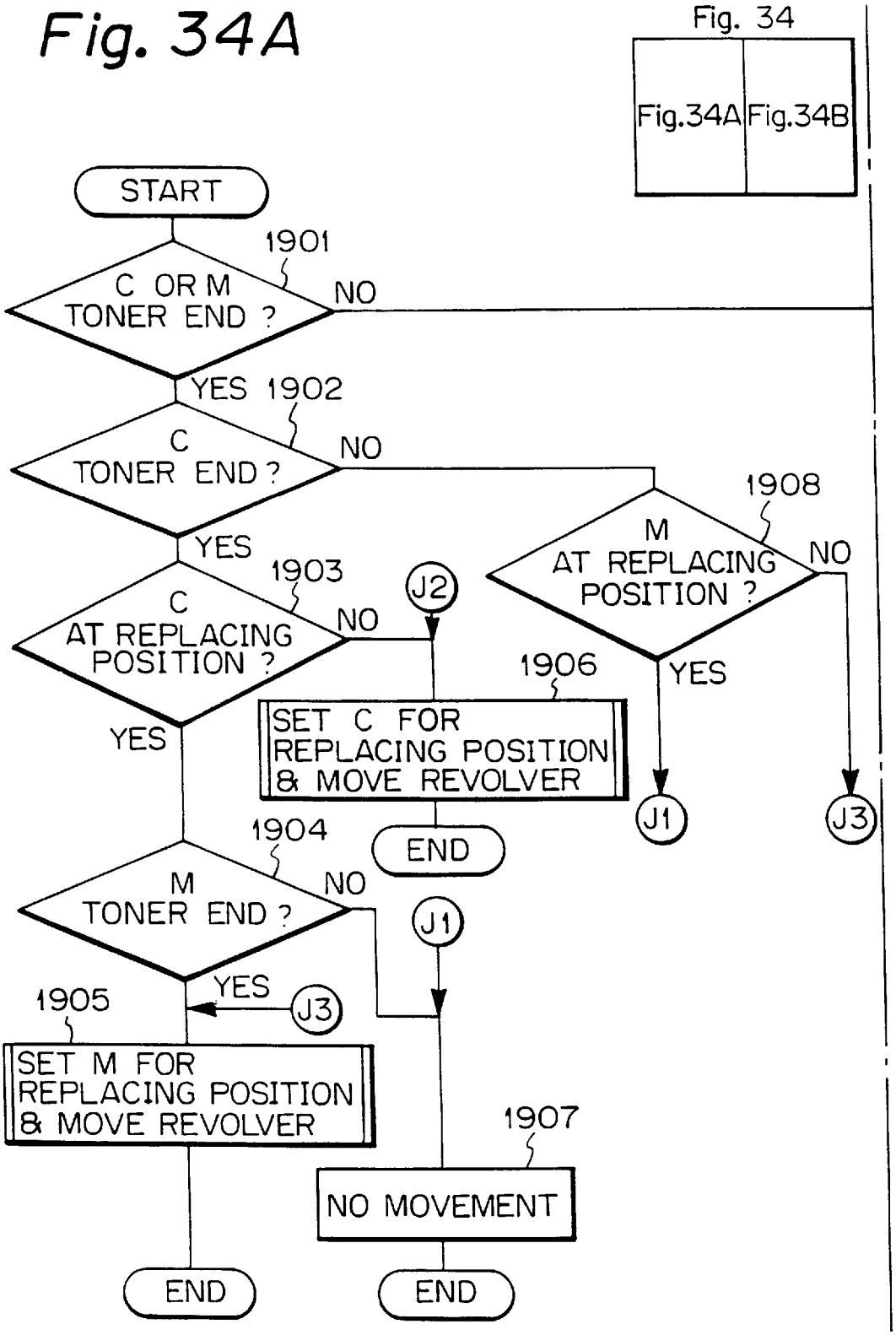
Figure 34B:
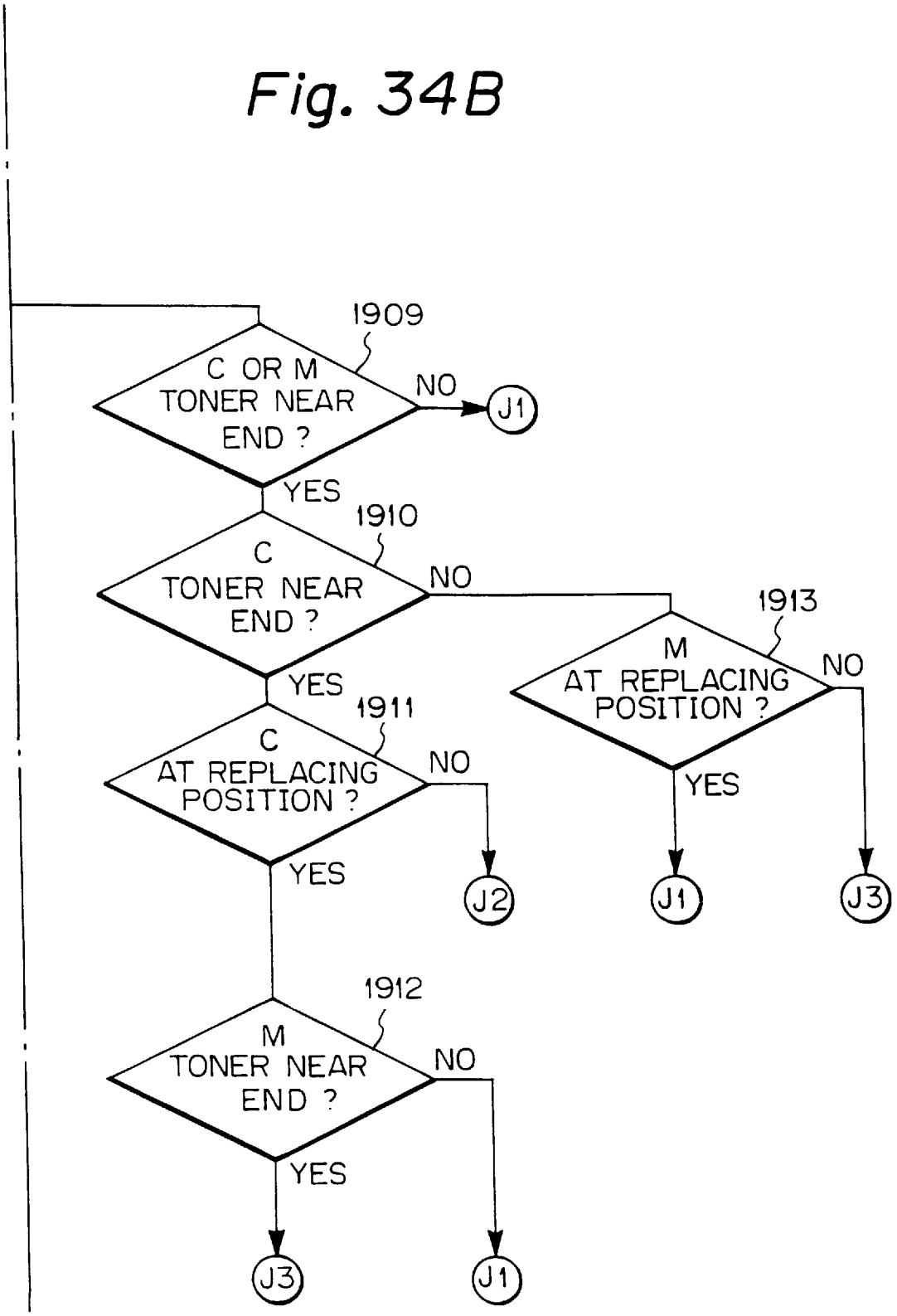

As shown in FIG. 34, when the blue mode key is pressed, the CPU 101 determines whether or not the C or M is in the toner end condition (step 1901). If at least one of the colors C and M is in the toner end condition, the CPU 101 determines whether or not the color C is in the toner end condition (step 1902). If the answer of the step 1902 is positive, the CPU 101 determines whether or not the color C is present at the replacing position (step 1903). If the answer of the step 1903 is negative, the CPU 101 determines that the color C should be brought to the replacing position, and then moves the revolver (step 1906).

As stated above, when the blue mode key is pressed again, the CPU 101 brings the C cartridge of higher priority to the replacing position if the color C has reached the toner end condition and if the color C is absent at the replacing position.

If the color C is present at the replacing position, as determined in the step 1903, the CPU determines whether or not the color M is in the toner near end condition (step 1904). If the answer of the step 1904 is positive, the CPU 101 determines that the color M should be brought to the replacing position, and then moves the revolver (step 1905).

As stated above, if the colors C and M are both in the toner end condition when the blue mode is pressed again, and if the color C is present at the replacing position, the CPU 101 brings the M cartridge given the next degree of priority to the replacing position. That is, when the operator presses the blue mode key again despite that the color C reached the toner end condition is present at the replacing position, the CPU 101 determines that the operator does not intend to replace the color C in the toner end condition, but desires to replace the color M also in the toner end condition.

If the color C is not in the toner end condition, as determined in the step 1902, the CPU 101 determines whether or not the color M is present at the replacing position (step 1908). If the answer of the step 1908 is negative, the CPU 101 executes a step 1905. That is, if only the color M is in the toner end condition, but not located at the replacing position, the CPU 101 moves the color M to the replacing position in response to the operation of the key. Further, if the color M is present at the replacing position, as determined in the step 1908, the CPU 101 ends the processing without moving the revolver (step 1907).

If neither the color C nor the color M is in the toner end condition, as determined in the step 1O8, the CPU 101 determines whether or not the color C or M is in the toner near end condition (step 1909). If at least one of the colors C and M is in the toner near end condition, the CPU 101 determines whether or not the color C is in the toner near end condition (step 1910). If the answer of the step 1910 is positive, the CPU 101 determines whether or not the color C is present at the replacing position (step 1911). If the answer of the step 1911 is negative, the CPU 101 determines that the color C should be brought to the replacing position, and then moves the revolver (step 1906).

As stated above, when the blue mode key is pressed again and when no colors are in the toner end condition, but some color is in the toner near end condition, the CPU 101 brings the C toner cartridge of higher priority to the replacing position if the color C has reached the toner near end condition and if the color C is absent at the replacing position.

If the color C is present at the replacing position, as determined in the step 1911, the CPU 101 determines whether or not the color M is in the toner near end condition (step 1912). If the answer of the step 1912 is positive, the CPU 101 determines that the color M should be brought to the replacing position, and then moves the revolver (step 1905).

As stated above, if no colors are in the toner end condition when the blue mode key is pressed again, and if the colors C and M are both in the toner near end condition, and if the color C is present at the replacing position, the CPU 101 brings the M cartridge given the next degree of priority to the replacing position. That is, when the operator presses the blue mode key again despite that the color C reached the toner near end condition is present at the replacing position, the CPU 101 determines that the operator does not intend to replace the color C in the toner near end condition, but desires to replace the color M also in the toner end condition.

If the color C is not in the toner near end condition, as determined in the step 1910, the CPU 101 determines whether or not the color M is present at the replacing position (step 1913). If the answer of the step 1913 is negative, the CPU 101 executes a step 1905. That is, if only the color M is in the toner near end condition, but not located at the replacing position, the CPU 101 moves the color M to the replacing position in response to the operation of the key. Further, if neither the color C nor the color M is in the toner near end condition, as determined in the step 1909, and if the color M is not in the toner near end condition, as determined in the step 1912, and if the color M is present at the replacing position, as determined in the step 1913, the CPU 101 ends the processing without moving the revolver (step 1907).

As described above, assume that the full-color mode key or any one of the two-color mode keys is pressed when the full-color mode or the bicolor mode associated with the above key exists. Then, every time the key is pressed, the CPU 101 sequentially moves the cartridges reached the toner end or toner near end condition to the replacing position. In this condition, assume that two or more of the cartridges to be used for the color mode selected on the key are in the toner end or toner near end condition, and that the cartridge of higher priority is present at the replacing position. Then, to replace the cartridge of lower priority, the operator should only press the key designating a color mode identical with the existing color mode. This may be repeated until the desired cartridge arrives at the replacing position. Therefore, the operator can replace the cartridge of lower priority without pressing any other color mode key. As a result, the operator is prevented from forgetting to return the color mode and causing an image to be formed in an unexpected color.

5th Embodiment

The decision included in the fourth embodiment for determining whether or not the color mode designated by the key is identical with the existing mode is not essential. Alternatively, when a preselected key is pressed, the cartridges to be replaced may be immediately brought to the replacing position one after another. Specifically, when one of the full-color mode key and two-color mode keys is pressed, one of the procedures shown in FIGS. 31–34 is executed as a subroutine belonging to the steps 301–311.

The second to fifth embodinments may each be combined with the first embodiment which searches for a cartridge in the toner end or toner near end condition at the end of image formation, and brings such a cartridge to the replacing position before ending the operation. The control of any one of the second to fifth embodiments eliminates the need for a mechanism for causing the operator to move the revolver by hand.

6th Embodiment

In the second to fifth embodiments, when any one of the color mode keys is pressed, the cartridge or cartridges assigned to the color mode are moved. It may occur that before the revolver ends its movement, another color mode key is pressed. In such a case, the contents associated with the key pressed next will be stored in a buffer memory and executed later. The problem with this kind of control is that when the revolver ends its first movement, it is caused to move again immediately. As a result, when the keys are pressed repeatedly, the revolver simply rotated over a long period of time without allowing any toner cartridge to be replaced. In the sixth embodiment, while the revolver is in rotation, an input on any color mode key is invalidated, as follows.

Figure 35:
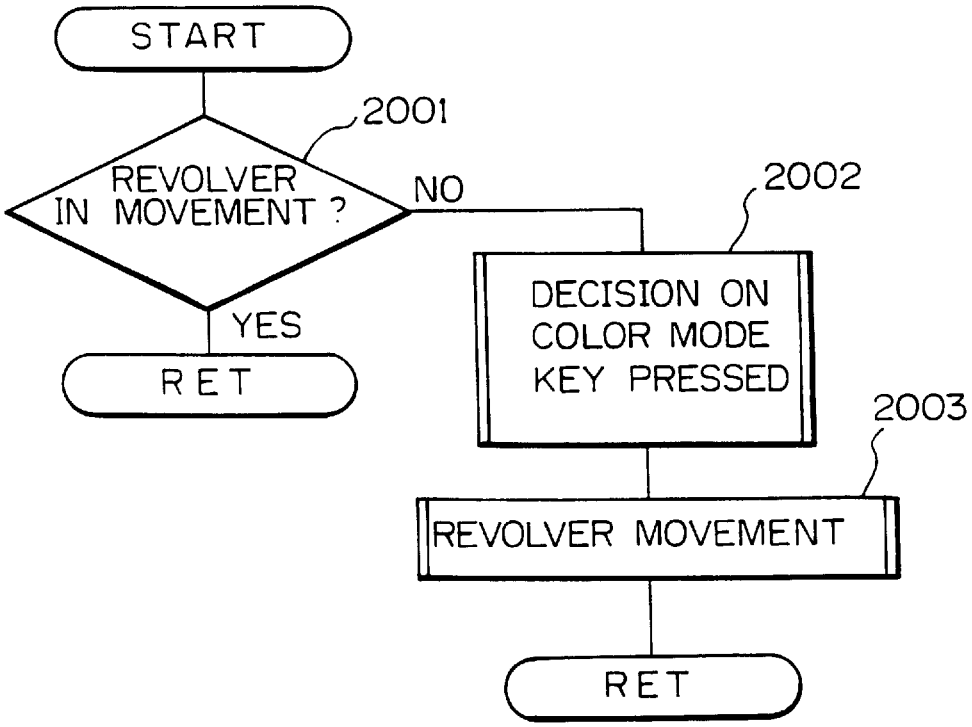
FIG. 35 is a flowchart representative of a sixth embodiment of the present invention and showing a procedure for dealing with color mode keys.

FIG. 35 demonstrates processing executed by the CPU 101, FIG. 3, for controlling inputs on the color mode keys. As shown, the CPU 101 determines whether or not the revolver is in rotation (step 2001). If the answer of the step 2001 is positive, the CPU 101 repeats a return (RET) loop. When the revolver ends its rotation, as determined in the step 2001, the CPU 101 identifies the contents of a color mode key pressed (step 2002), and then moves the revolver (2003) accordingly.

This embodiment prevents the revolver from rotating continuously over a long period of time, and thereby prevents the operator from wasting time. In addition, because the revolver is free from wasteful rotation, the life of the revolver motor is extended while noise is minimized.

The first to sixth embodiments shown and described have various unprecedented advantages as enumerated below.

(1) When image formation ends, a toner cartridge to be replaced is searched for and then moved to a preselected replacing position. This makes it needless for the operator to move such a cartridge to the replacing position by hand, and allows the operator to replace it rapidly after the image formation.

(2) When a desired color mode is input, a cartridge to be replaced is selected out of cartridges to be used in the above mode and brought to the replacing position. Therefore, only if the operator inputs a desired color mode, the cartridge to be replaced can be moved to the replacing position.

(3) Cartridges to be replaced are sequentially searched in a preselected priority order. Therefore, at the end of image formation or when a color mode is input, the cartridge of higher priority is moved to the replacing position first. This successfully facilitates the replacement of the cartridge.

(4) When a desired color mode is input and if one of the cartridges searched for is present at the replacing position, the cartridges are not moved. This obviates the wasteful movement of the cartridges and reduces waiting time up to the start of image formation.

(5) Assume that after a desired color mode has been input, the same color mode is input again. Then, every time the same color mode is input, the cartridges searched for and to be replaced are sequentially moved to the replacing position. The operator therefore does not have to input any other color mode and is prevented from forgetting to return the mode; otherwise, an image would be formed in an unexpected color.

(6) When any one of the cartridges is moving toward the replacing position, the input of any other color mode is invalidated. This prevents, when different color modes are continuously input, moving means from being continuously operated over a long period of time.

The revolver of the type allowing only the cartridge located at the replacing position to be replaced has the previously discussed [Problem 2] also. Specifically, with this type of revolver, the operator cannot replace two or more cartridges by a single replacing operation. To replace two or more cartridges, the operator must open and close the front cover of the printer body every time the operator replaces one cartridge, i.e., a recovery operation is executed cartridge by cartridge. As a result, the operator cannot leave the printer until the recovery operation has been completed with all the cartridges, resulting in inefficient replacement.

In light of the above, the printer of the present invention performs such control that when a plurality of toner cartridges are replaced, a recovery operation is executed continuously with the developing sections associated with the cartridges, as follows.

7th Embodiment

Figure 36A:
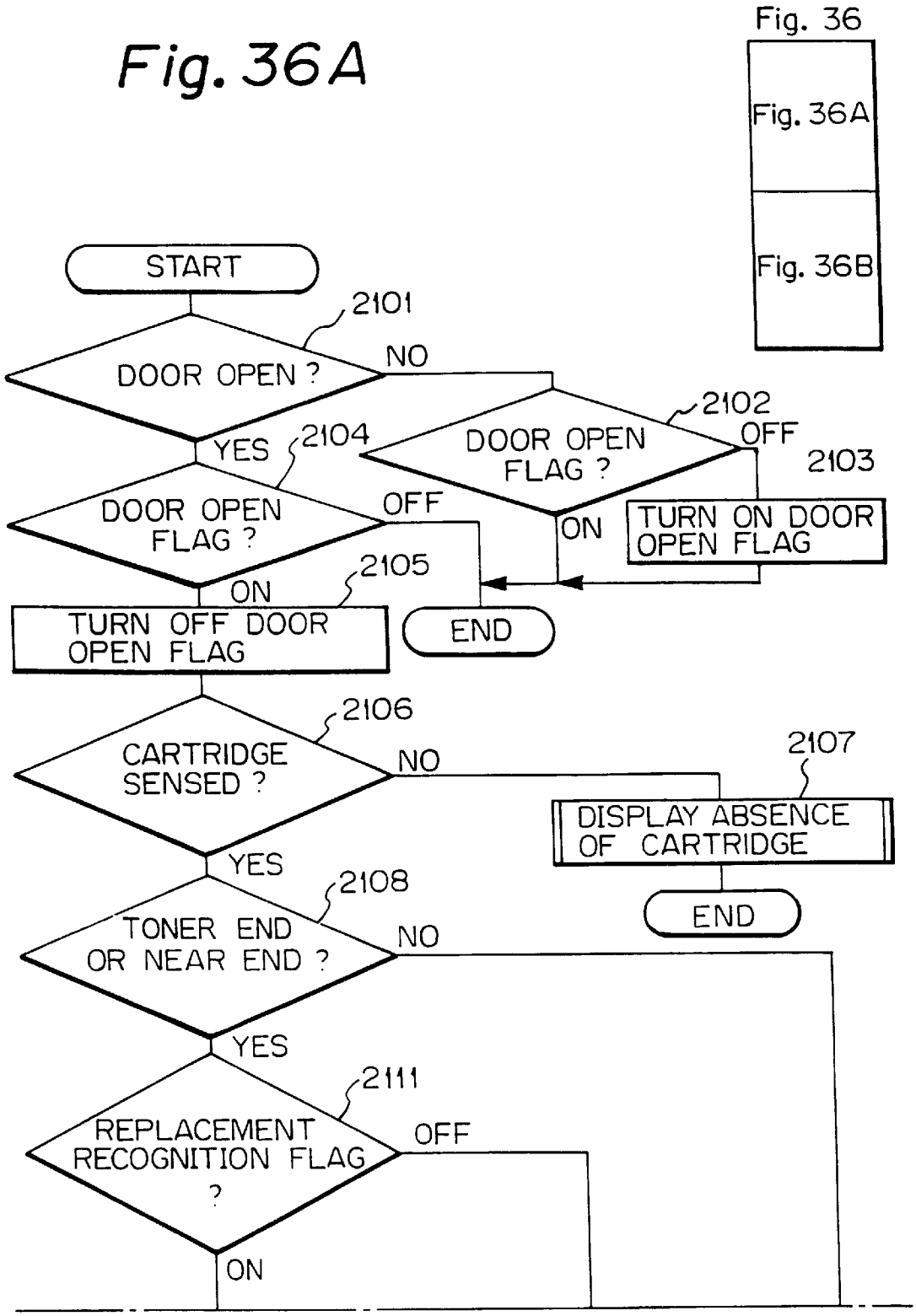
FIG. 36 is a flowchart representative of a seventh embodiment of the present invention and showing a recovery operation.
Figure 36B:
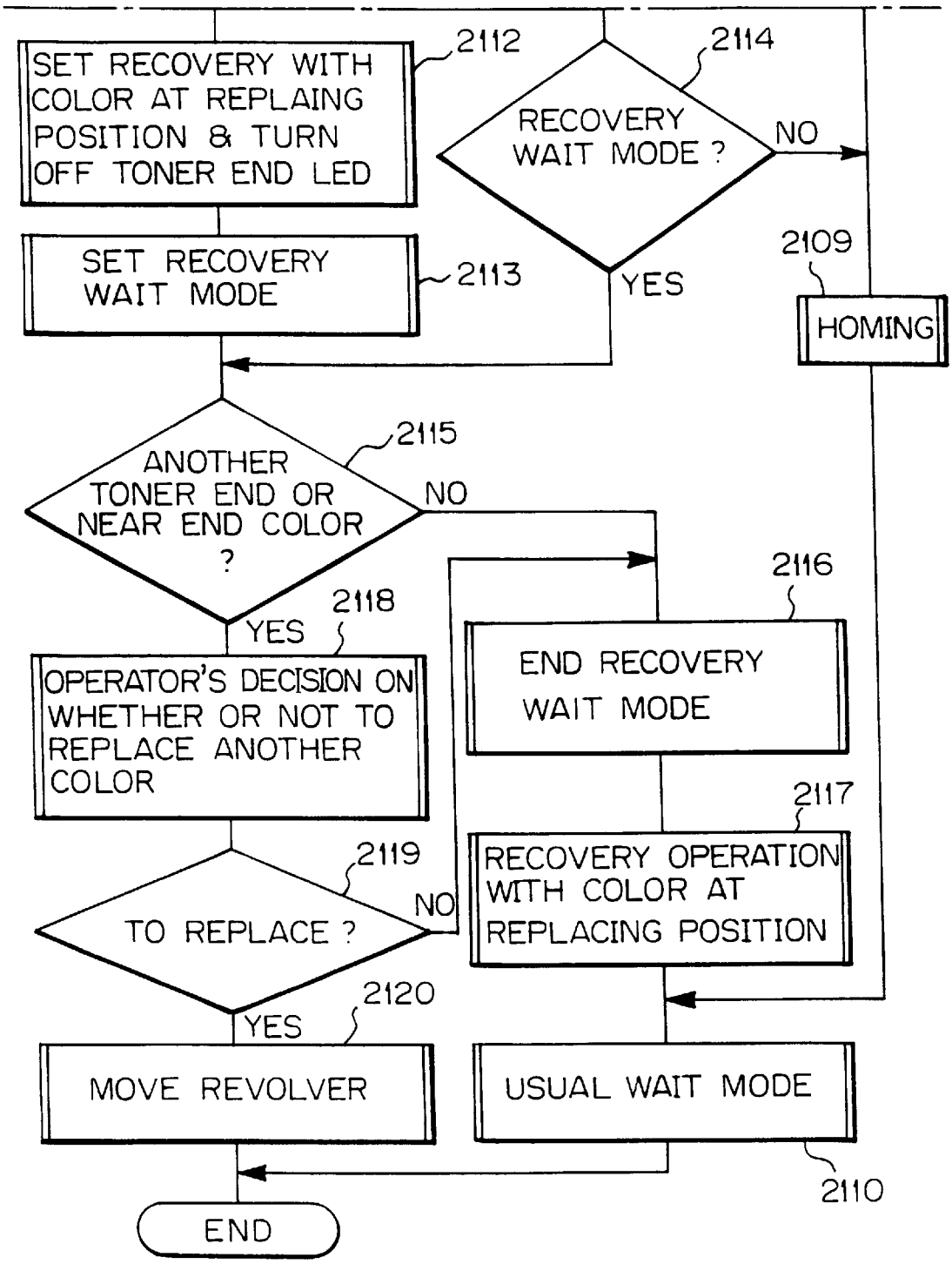

FIG. 36 demonstrates recovery processing, particularly processing including a recovery wait mode and to be executed when the front door is opened and closed, to be executed by the CPU 101, FIG. 3. Assume that the turn-on of LEDs indicative of the statuses of the printer, the display of messages meant for the operator, and the input of operator's commands are effected via the control panel, not shown.

When a plurality of cartridges are in the toner end or toner near end condition, the CPU 101 determines whether or not any one of them has been replaced when the door has been opened and then closed. First, the CPU 101 checks the door switch 144, FIG. 4, to see if the door is in its closed position (step 2101). If the door is open, the CPU 101 determines the status of a door open flag (step 2102). If the door open flag has been turned on, the CPU 101 ends the processing; if otherwise, it turns on the flag and then ends the processing (step 2103). If the door is closed, as determined in the step 2101, the CPU 101 determines the status of the door open flag (step 2104). If the door open flag has been turned off, the CPU 101 ends the processing; if otherwise, turns it off (step 2105) and then checks the cartridge sensor 143, FIG. 12, to see if any cartridge is present at the replacing position (step 2106).

If no cartridges are present at the replacing position, the CPU 101 displays a message alerting the operator to the absence of a cartridge on the control panel (step 2107). If any cartridge is present at the replacing position, the CPU 101 determines whether or not the cartridge is in the toner end or toner near end condition (step 2108). If the answer of the step 2108 is positive, a toner end (toner near end) LED provided on the control panel turns on. If the answer of the step 2108 is negative, the CPU 101 executes a homing operation which will be described later (step 2109) and enters a usual wait mode (step 2110). The usual wait mode refers to a condition wherein the developing sections are ready to perform development. Therefore, when a recovery wait mode is set up in a step 2113, image formationL is inhibited until the recovery wait mode has been ended in a step 2116 and replaced with the usual wait mode in the step 2110.

Figure 37:
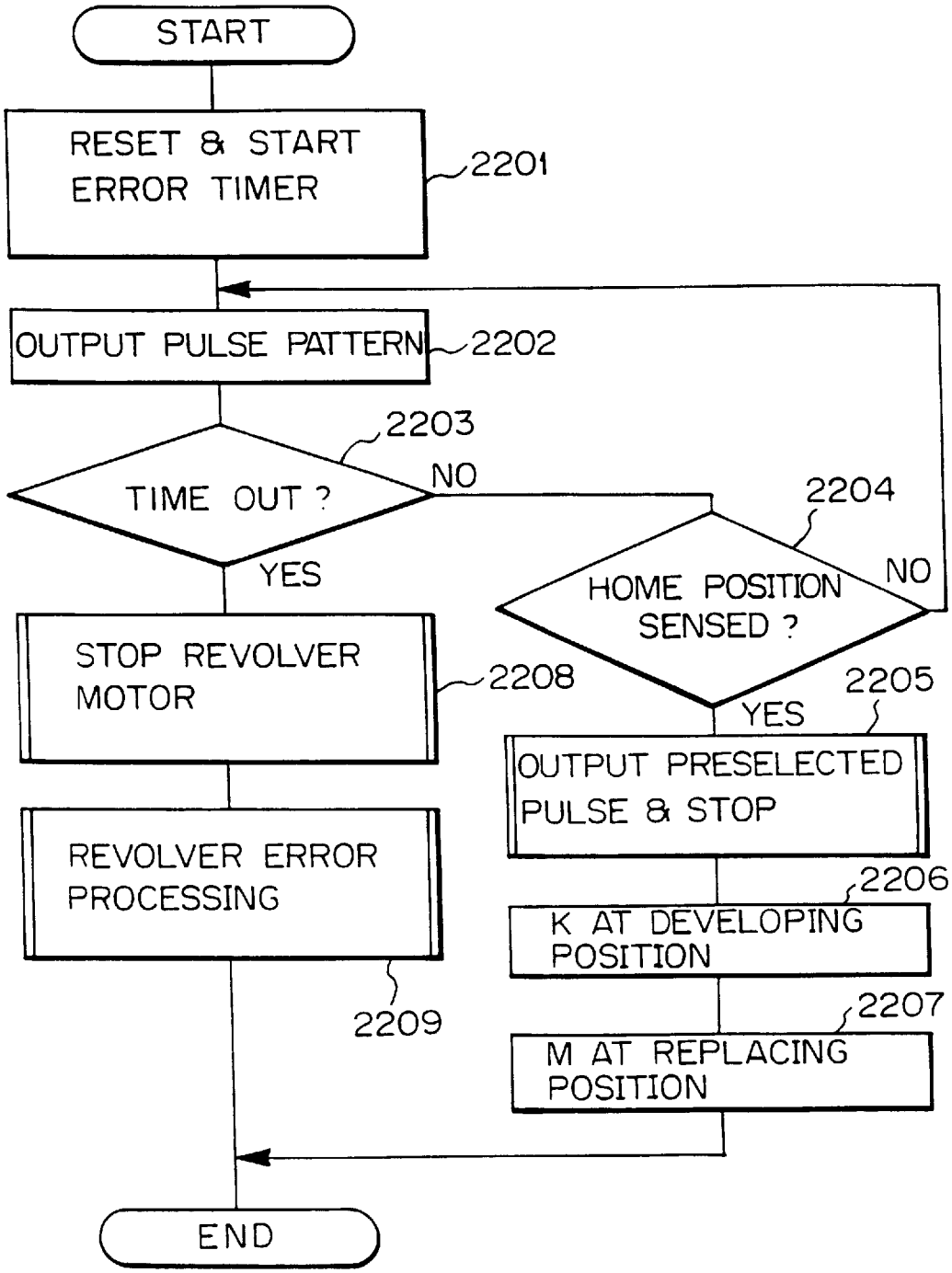
FIG. 37 is a flowchart showing a homing operation included in the seventh embodiment.

The homing step 2109 to be executed by the CPU 101 will be described with reference to FIG. 37. The homing processing refers to the processing for identifying the colors of two toner cartridges located at the developing position and replacing position, respectively. As shown, the CPU 101 sets (resets and then starts) an error timer (step 2201). Then, the CPU 101 sends a pulse pattern to the revolver motor, FIG. 3, in order to rotate the revolver (step 2202). If the home position is not sensed before the time-out of the error timer (negative or N, step 2203), the CPU 101 repeats the loop consisting of the steps 2202, 2203 and 2204. If the home position is sensed before the time-out of the error timer (positive or Y, step 2203), the CPU 101 outputs a preselected pulse in order to stop the K developing section at the developing position (step 2205). Subsequently, the CPU 101 confirms the K and M developing sections respectively located at the developing position and replacing position (steps 2206 and 2207), and then ends the processing. If the time of the error timer expires in the step 2203, i.e., if the home position is not sensed even after the time-out of the error timer, the CPU 101 executes processing for stopping the revolver (step 2208) and revolver error processing (step 2209).

Referring again to FIG. 36, the recovery operation will be described. If the cartridge present at the replacing position is in the toner end or toner near end condition, as determined in the step 2108, the CPU 101 determines the status of a replacement recognition flag (step 2111). This flag is an identifier for determining whether or not the cartridge h as been replaced. If the recognition flag has been turned on, the CPU 101 sets recovery for the color located at the replacing position, and turns off the toner end LED associated with the above color (step 2112). To set recovery for the color at the replacing position means to set the color present at the replacing position as a color for which the recovery operation to be described is meant. As for the cartridge in the toner near end condition, a toner near end LED will be turned off. Let the following description concentrate on the toner end LED.

Subsequently, the CPU 101 sets up the recover wait mode (step 2113), i.e., inhibits the image forming operation of the printer body and causes it to wait for the replacement of the cartridge. The CPU 101 waits for the recovery operation when the recovery mode is set, and then starts the recovery operation when the mode ends. Further, if the replacement recognition flag has been turned off, as determined in the step 2111, the CPU determines whether or not the recovery wait mode has been set (step 2114). If the answer of the step 2114 is negative, the CPU 101 executes homing (step 2109).

After the step 2113 or if the answer of the step 2114 is positive, the CPU 101 determines whether or not any color other than the color present at the replacing position is in the toner end or toner near end condition (step 2115). If the answer of the step 2115 is negative, the CPU 101 ends the recovery wait mode set in the step 2113 (step 2116), and then executes the recovery operation with the color set at the step 2112 (step 2117). After the recovery operation, the CPU 101 advances to the usual wait mode (step 2110).

If the answer of the step 2115 is positive, the CPU 101 displays a message on the control panel for urging the operator to determine whether or not to replace the color other than the color present at the replacing position (step 2118). The CPU 101 determines whether or not the operator has made the above decision (step 2119). If the answer of the step 2119 is positive, the CPU 101 rotates the revolver until the next cartridge reached the toner end or toner near end condition arrives at the replacing position (step 2120). Then, the CPU 101 displays a message urging the operator to replace the cartridge brought to the replacing position. If the answer of the step 2115 is negative or if the answer of the step 2119 is negative, the CPU 101 executes the recovery operation with the color set for recovery, and then starts the usual wait mode operation (steps 216, 217 and 210).

Figures 1, 38:
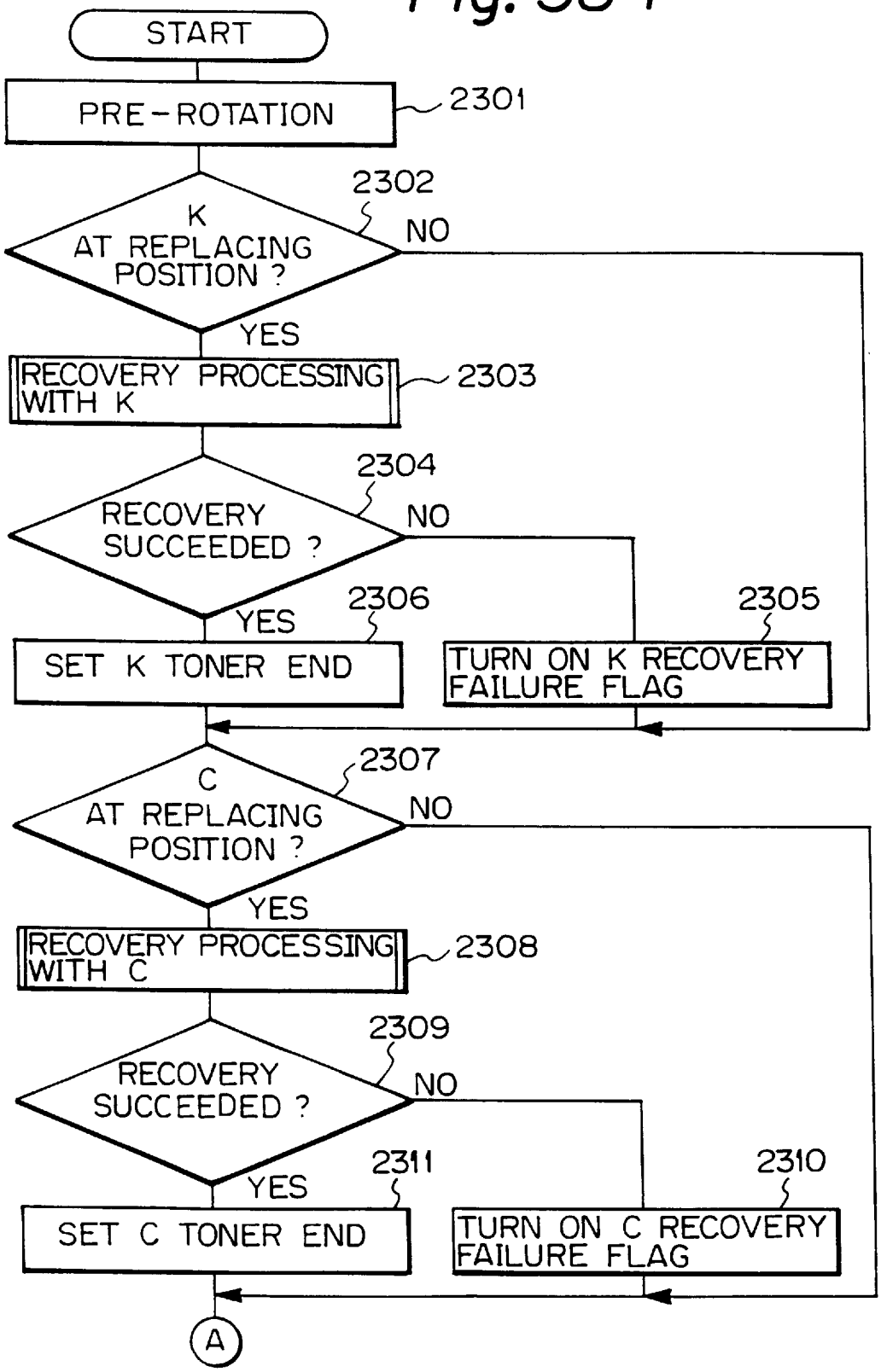
FIG. 38 is a flowchart showing a procedure included in the seventh embodiment for effecting the recovery operation with a color located at the replacing position.
Figures 2A, 38:
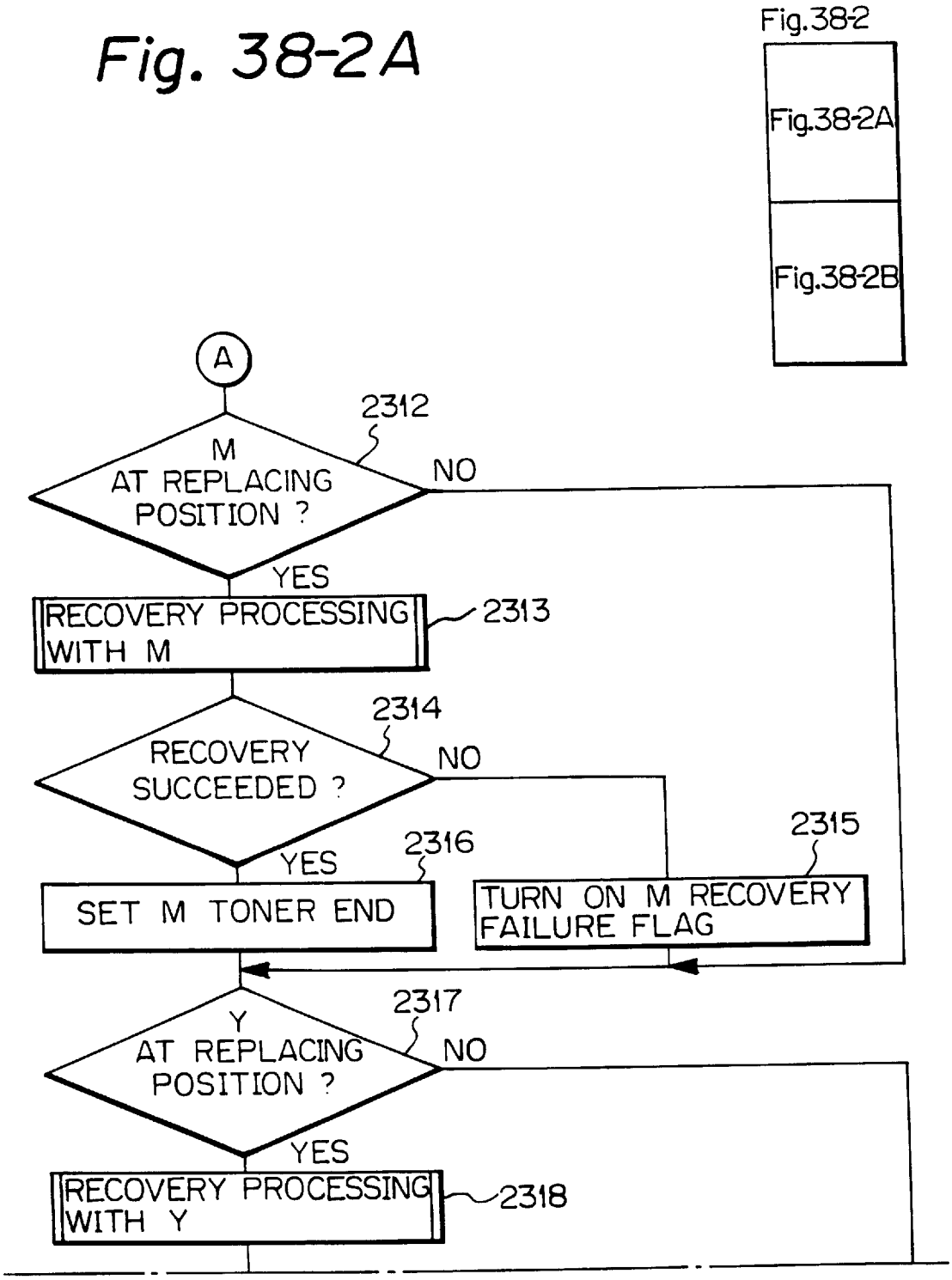
Figures 2B, 38:
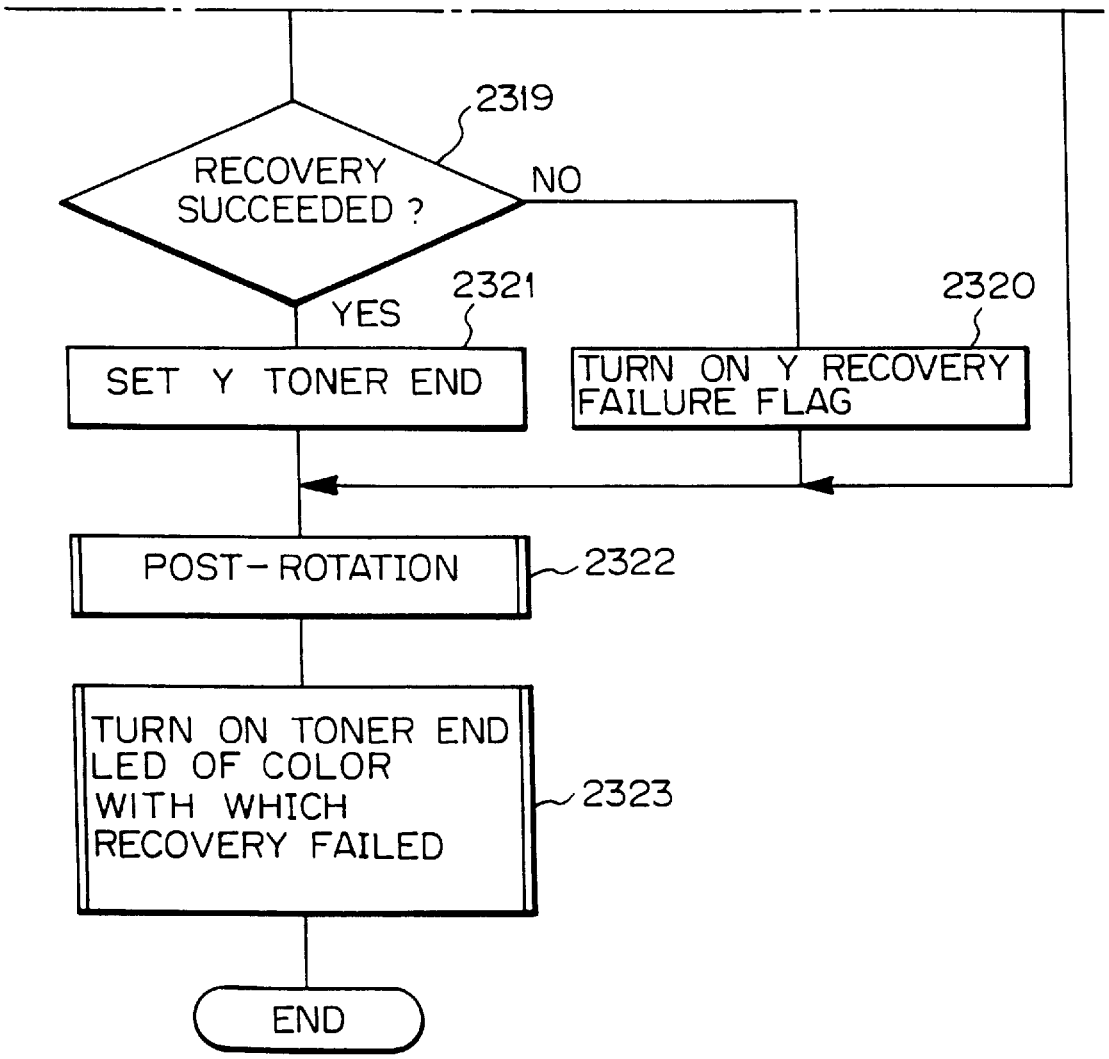

The recovery operation executed in the step 2117 will be described in detail with reference to FIG. 38. As shown, the CPU 101 executes pre-rotation forming part of the recovery operation (step 2301). Subsequently, in the step 2112 shown in FIG. 36, the CPU 101 determines whether or not the color located at the replacing position and set for recovery is K (step 2302). If the answer of the step 2302 is positive, the CPU 101 executes recovery processing for the K developing unit (step 2303). Then, the CPU 101 determines whether or not the recovery has succeeded (step 2304). If the recovery has failed, the CPU 101 turns on a K recovery failure flag (step 2305). if the recovery has succeeded, the CPU 101 resets the K toner end (or toner near end) condition (step 2306). If the color present at the replacing position is not K (N, step 2302) or when the K recovery failure flag is turned on in the step 2305, the CPU 101 determines whether or not the color located at the replacing position and set for recovery is C, and then executes the same processing with C as with K (steps 2307–2311). This is also repeated with M (steps 2312–2316) and Y (steps 2317–2321). Subsequently, the CPU 101 executes post-rotation also forming part of the recovery operation (step 2322). Finally, the CPU 101 again turns on the toner end LED assigned to the color with which the recovery has failed.

As stated above, with the revolver of the type allowing only the toner cartridge located at the replacing position to be replaced, the CPU 101 continuously executes recovery processing for a plurality of developing sections after the replacement of the cartridge. Therefore, the user can leave the printer body after replacing the cartridge present at the replacing position. This reduces the restriction time of the operator to the printer body and thereby enhances efficient operation.

In the illustrative embodiment, if any cartridge other than the cartridge replaced is in the toner end or toner near end condition, the CPU 101 urges the operator to decide whether or not to replace it. If the operator decides to replace the cartridge and commands replacement, the CPU 101 sets up the recovery wait mode. If the operator does not desire to replace the cartridge and commands the end of replacement, the CPU 101 clears the recovery wait mode and starts the recovery operation. Therefore, the recovery operation is executed only with the color of the cartridge which the operator has desired to replace, so that the time for recovery operation with the other colors is saved. For example, when K is in the toner end condition while C is in the toner near end condition, it is desirable to replace both of them. However, when the desired number of printing is small or when the printing operation is urgent, it is more desirable for the operator to replace only the K toner cartridge as an immediate measure. Then, the CPU 101 executes the recovery operation only with K and saves time.

The CPU 101 executes the pre-rotation and post-rotation only once each at the beginning and the end of continuous recovery processing. Should the recovery operation be executed at the end of replacement of each toner cartridge, the pre-rotation and post-rotation would occur between the consecutive recovery operations. The embodiment therefore reduces the overall recovery time and prevents the operator from waiting a long period of time until the start of image formation.

When the recovery wait mode is set, the recovery operation is executed after the recovery wait mode. Image formation is inhibited until the usual wait mode has been set after the recovery operation. This successfully obviates defective images. Specifically, if image formation is permitted just after the replacement of the cartridge, it is likely that toner replenishment to the developing section cannot follow the actual consumption due to repeated image formation, causing the toner near end LED to turn on again or lowering the image density. In the illustrative embodiment, image formation can be performed only after the expected toner content has been restored in the developing section.

While the embodiment executes the recovery processing continuously with the developing sections whose cartridges have been replaced, it may execute the recovery processing with all the developing sections at the end of replacement without regard to whether or not their cartridges have been replaced.

Further, in the embodiment, the pre-rotation and post-rotation are effected only once each at the beginning and the end of continuous recovery processing. Alternatively, after the replacement of each cartridge, the pre-rotation, recovery processing and post-rotation may be sequentially executed in this order. Although this alternative scheme needs as much time as the scheme which executes recovery every time a toner cartridge is replaced, it allows the operator to leave the printer just after the replacement of the cartridge.

8th Embodiment

If any one of the cartridges has been replaced while a power switch provided on the printer has been in its OFF state, then the printer cannot see, when the power switch is turned on later, which of the cartridges has been replaced. Performing the recovery operation with all the colors wastes time. To solve this problem, the eighth embodiment executes control such that when the power switch is turned on, the recovery operation is performed only with the color located at the replacing position when the power switch was in its OFF state, as follows.

Figure 39:
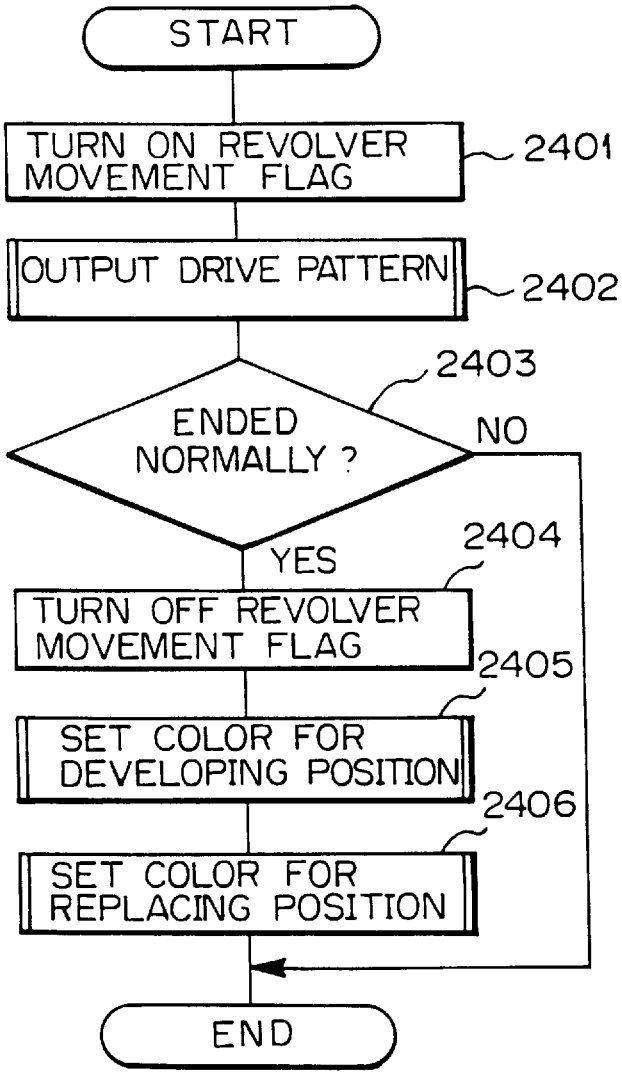
FIG. 39 is a flowchart representative of an eighth embodiment of the present invention and showing a procedure for setting colors at the end of the movement of the revolver.

FIG. 39 demonstrates a procedure to be executed by the CPU 101, FIG. 3, for identifying the colors at the end of movement of the revolver, particularly the colors located at the developing position and replacing position. As shown, when a revolver movement flag is turned on (step 2401), the CPU 101 sends a drive pattern to the revolver motor 113, FIG. 3, (step 2402). Then, the CPU 101 determines whether or not the revolver has successfully ended its movement (step 2403). If the answer of the step 2403 is positive, the CPU 101 turns off the revolver movement flag (step 2404). Thereafter, the CPU 101 sets the colors at the developing position and replacing position (steps 2405 and 2406). These colors are written to the nonvolatile RAM 103, FIG. 3. Even if the answer of the step 2403 is negative, e.g., if the revolver stops moving due to the opening of the door, the homing procedure shown in FIG. 37 is executed and allows the colors to be set.

Figure 40:
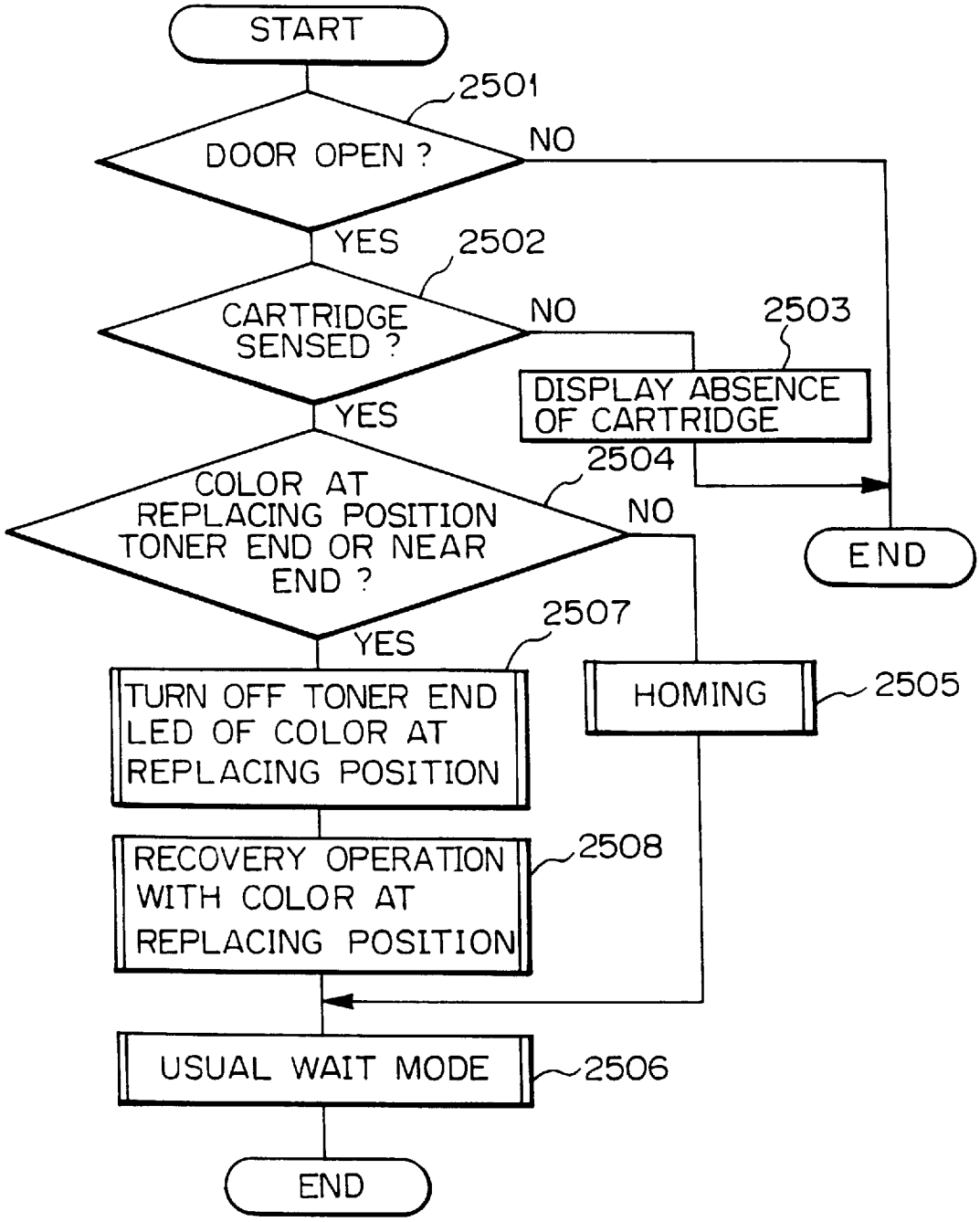

FIG. 40 shows recovery processing to be executed when the power switch of the printer is turned on. Again, assume that the revolver is of the type allowing only the toner cartridge present at the replacing position to be replaced. As shown, on the turn-on of the power switch, the CPU 101 checks the door switch 144, FIG. 4, to see if the door of the printer body is closed (step 2501). If the door is open, the CPU 101 ends the processing. If the door is closed, the CPU checks the cartridge sensor 143, FIG. 12, to see if any toner cartridge is present at the replacing position (step 2502). If no cartridges are present at the above position, the CPU 101 displays a message alerting the operator to the absence of a cartridge on the control panel (step 2503). If any cartridge is present at the replacing position, the CPU 101 determined whether or not the color at the replacing position is in the toner end or toner near end condition (step 2504). If the answer of the step 2504 is negative, the CPU 101 executes the homing procedure (step 2505) and then sets up the usual wait mode (step 2506). If the answer of the step 2504 is positive, the CPU 101 turns off the toner end (or toner near end) LED assigned to the color present at the replacing position (step 2507). Then, the CPU 101 executes the recovery operation with the color located at the replacing position and set in the step 2406 of FIG. 39, i.e., the color located at the above position before the turn-off of the power switch (step 2508).

As stated above, when the color present at the replacing position at the time of the turn-on of the power switch is in the toner end or toner near end condition, the color located at the above position while the switch was in its OFF state is identified. The recovery operation is executed only with the identified color. Therefore, even when any one of the toner cartridges is replaced while the power switch is in its OFF state, the usual wait mode can be set up if a minimum necessary recovery procedure is executed. For example, even if two or more colors are in the toner end condition at the time of the turn-on of the power switch, the usual wait mode can be set up if the recovery operation is executed with only one of the above colors, because only one color is replaceable at a time. This reduces the overall recovery time and prevents the operator from waiting a long period of time until the start of image formation, compared to the case wherein the recovery operation is executed with all the colors.

In the illustrative embodiment, if the color present at the replacing position when the power switch is turned on is in the toner end or toner near end condition, the recovery operation is performed on the assumption that some toner cartridge was replaced when the power switch was in its OFF state. Alternatively, in the above condition, the CPU 101 may determine the status of the replacement recognition flag (see FIG. 36) as to the cartridge present at the replacing position, and execute the recovery operation only if the flag has been turned on.

The following advantages are achievable with the eighth embodiment.

(1) After a plurality of toner cartridges have been replaced, a recovery operation is continuously executed with a plurality of developing sections. This allows the operator to leave the printer just after the replacement of the cartridges and thereby promotes efficient operation.

(2) The continuous recovery operation effected only with the developing sections whose cartridges have been replaced saves time otherwise allocated to the other developing sections. This reduces the overall recovery time, compared to the case wherein the recovery operation is executed with all the colors without regard to the replacement.

(3) Preprocessing and postprocessing included in the recovery operation are effected once each at the beginning and the end of recovery processing. This makes it needless to repeat the postprocessing and preprocessing between consecutive recovery processing, thereby reducing the overall recovery time.

(4) Image formation is inhibited until the recovery operation ends. This prevents image formation from being effected under the incomplete restoration of toner content.

(5) When the power switch of the printer is turned on, the recovery operation is executed only with the developing section corresponding to the cartridge located at the replacing position when the switch was in its OFF state.

With the revolver of the type allowing only the toner cartridge located at the replacing position to be replaced, the operator can replace only one cartridge at a time. To replace two or more cartridges, the operator must rotate the revolver after replacing each cartridge. The rotation of the revolver may be automated by one of two different systems, i.e., a system sequentially effecting the replacement of a cartridge, recovery operation and the rotation of the revolver every time a cartridge is replaced, and a system effecting the replacement of a cartridge and the rotation of the revolver with each cartridge and effecting, after the replacement of all the cartridges, the recovery operation continuously with the replaced cartridges. In either one of the two systems or in the case of replacement and recovery operation to be effected when only one cartridge is in the toner end or toner near end condition, an arrangement may be made such that when the door is opened and then closed, the recovery operation is executed on the assumption that the cartridge in the toner end or toner near end condition has been replaced. Specifically, toner end or toner near end information may be stored together with information representative of the cartridges in the toner end or toner near end condition. In such a case, the printer will remain in a stand-by state with the information stored therein and will execute the recovery operation and so forth when the opening and closing of the door is sensed.

However, it sometimes occurs that no cartridges are replaced although the door is opened and then closed. Therefore, if the printer determines that a cartridge has been replaced only on the basis of the opening and closing of the door performed in the presence of the toner end or toner near end condition, it is likely that the recovery operation and other operations are wastefully executed, inhibiting the use of the printer.

In light of the above, the printer of the present invention determines that a cartridge has been replaced only if the output of the cartridge sensor 143 indicates a change in the presence/absence of a cartridge. Specifically, the printer identifies the replacement by use of the output of the cartridge sensor 143 and that of the door switch 144, i.e., only if the door is opened in the presence of the toner end or toner near end condition, and then a cartridge is removed and then set.

The replacement of a cartridge must allow a person to recognize it. Otherwise, a person other than the person replaced a cartridge is apt to replace it again. To eliminate this problem, the printer of the present invention displays the displacement of a cartridge on determining that a cartridge has been replaced. This is done by turning off a toner end LED and allows every person to see the replacement of a cartridge.

Moreover, when the door is opened and closed, the printer of the present invention stops the developing sections at their preselected positions and stops the mark of the intermediate transfer belt 30 at a position spaced by a preselected distance from the mark sensor 150 (homing). This allows the next image formation to be performed accurately without regard to the condition of the stop. When the revolver is rotated during the homing operation in order to stop the developing sections at their preselected positions, it is likely that the toner remaining at the portion where the revolver and cartridge join each other is scattered around. In light of this, in accordance with the present invention, when the printer determines that a cartridge is absent, it does not move the revolver, i.e., does not perform the homing operation or execute the recovery operation. The printer simply displays the absence of a cartridge and urges the operator to mount a cartridge.

An embodiment capable of solving [Problem 3] through [Problem 7] discussed earlier will be described hereinafter.

9th Embodiment

Figure 41:
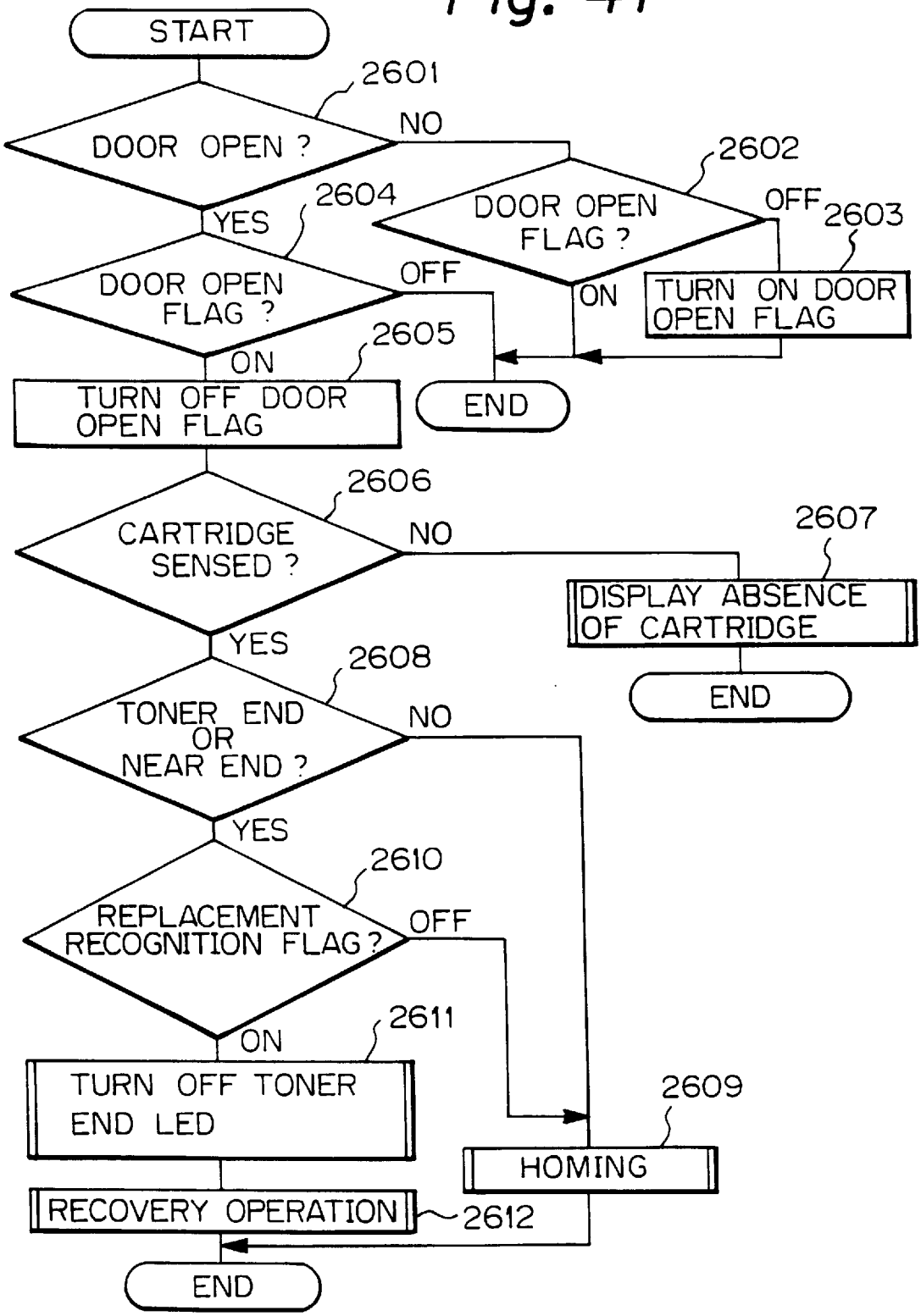
FIG. 41 is a flowchart representative of a ninth embodiment of the present invention and showing a specific control procedure to be executed when a door is opened and closed.

FIG. 41 demonstrates specific control representative of a ninth embodiment of the present invention and to be executed by the CPU 101 when the door is opened and closed. As shown, the CPU 101 checks the output of the door switch 144, FIG. 4, to see if the door of the printer body is closed (step 2601). If the door is open, the CPU 101 determines the status of a door open flag (step 2602). If the door open flat has been turned on, the CPU 101 ends the routine. if the door is closed, as determined in the step 2601, the CPU 101 determines the status of the door open flag (step 2604). If the door open flag has been turned off, the CPU 101 ends the routine. If the door open flag has been turned on, the CPU 101 tuns it off (step 2605) and then checks the output of the cartridge sensor 143, FIG. 12, to see if a cartridge is present at the replacing position (step 2606).

If the answer of the step 2606 is negative, the CPU 101 displays the absence of a cartridge on the control panel (step 2607). If the answer of the step 2606 is positive, the CPU 101 determines whether or not the cartridge present at the replacing position is in the toner end or toner near end condition (step 2608). it is to be noted that if the cartridge at the replacing position is in the toner end or toner near end condition, the toner end (or toner near end) LED assigned to the color of the cartridge has been turned on. If the cartridge at the replacing position is not in the toner end or toner near end condition, the CPU 101 executes a homing procedure to be described (step 2609), and then ends the routine.

The homing processing to be executed in the above step 2609 will be described with reference to FIG. 42. This processing is executed to specify the colors to be located at the developing position and replacing position. As shown, the CPU 101 sets (resets and starts) an error timer (step 2701), and then sends a pulse pattern to the revolver motor, FIG. 3, in order to rotate the revolver (step 2702). If the home position is not sensed (N, step 2704) before the time of the error timer expires (N, step 2703), the CPU 101 executes the loop consisting of the steps 2702, 2703 and 2704. If the home position is sensed (Y, step 2704) before the time of the error timer expires, the CPU 101 outputs a preselected pulse in order to stop the K developing section at the developing position (step 2705). Then, the CPU 101 confirms the K developing section and M developing section respectively located at the developing position and replacing position (steps 2706 and 2707), and ends the routine. However, if the time of the error timer expires in the step 2703, i.e., if the home position is not sensed before the time-out of the timer, the CPU 101 deenergizes the revolver motor 113, FIG. 3, (step 270-8) and executes revolver error processing (step 2709).

Referring again to FIG. 41, if the cartridge at the replacing position is in the toner end or toner near end condition (Y, step 2608), the CPU 101 determines the status of the replacement confirmation flag (step 2611). This flag is an identifier showing whether or not a cartridge has been replaced, as stated earlier. The CPU 101 turns on the confirmation flag when the output of the cartridge sensor 143 indicates a change in the presence/absence of a cartridge, as will be described with reference to FIG. 43.

Figure 43:
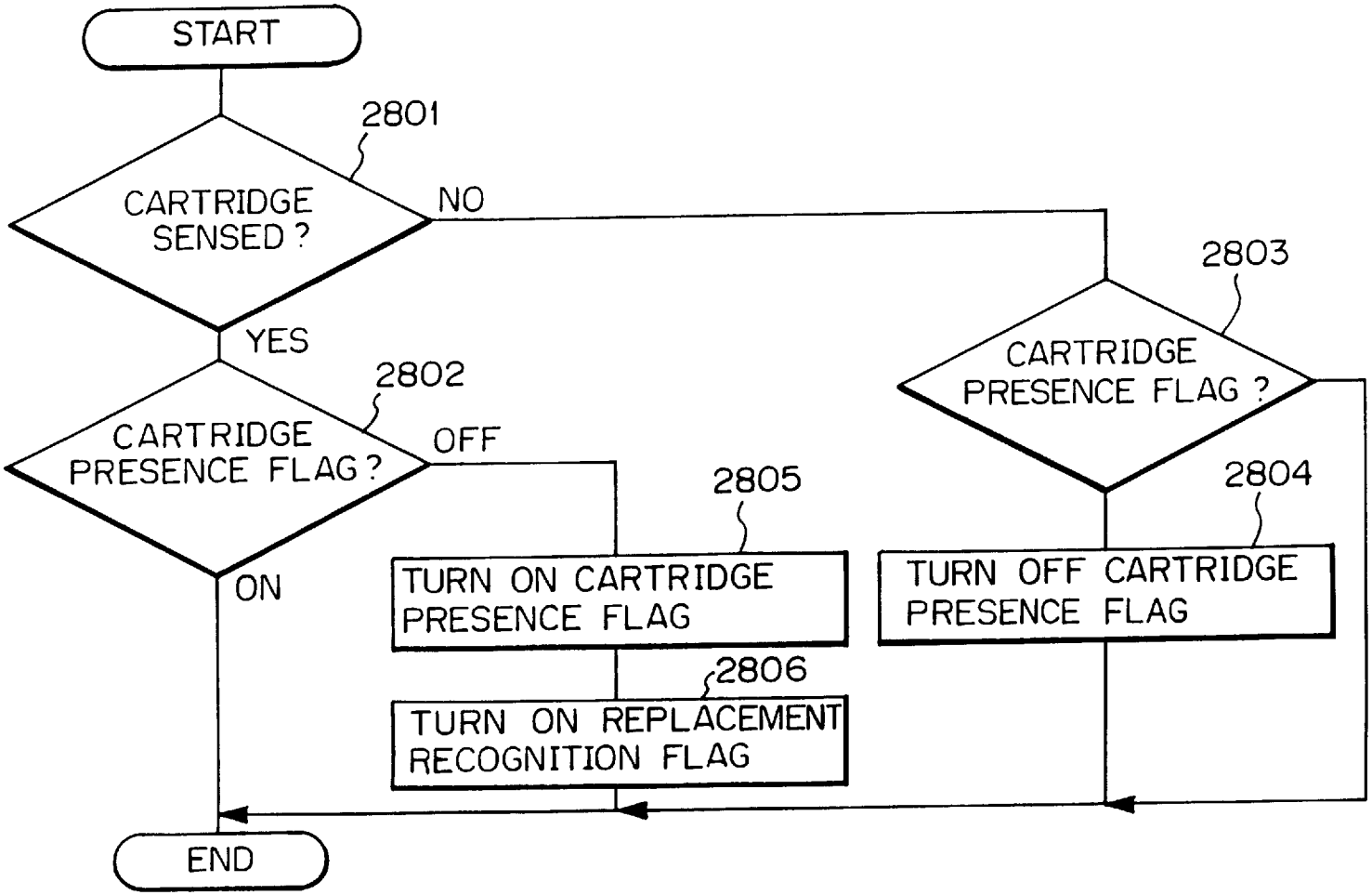

As shown in FIG. 43, if a cartridge is absent (N, step 2801), the CPU 101 determines whether or not a cartridge presence flag has been turned on (step 2802). If the cartridge presence flag has been turned off, the CPU 101 ends the routine. If the flag has been turned on, the CPU 101 turns it off and then ends the routine (step 2804). Subsequently, so long as the cartridge is not mounted to the printer, the CPU 101 determines that a cartridge is absent in the step 2801, determines that the cartridge presence flag has been turned off (step 2803), and ends the routine. When the CPU 101 determines that a cartridge mounted to the printer is present (Y, step 2801), the CPU 101 turns on the cartridge presence flag as well as the recognition flag (steps 2805 and 2806). Thereafter, so long as the cartridge is not pulled out, the CPU 101 determines that a cartridge is present in the step 2801, determines that the cartridge presence flag has been turned on in the step 2802, and ends the routine.

As shown in FIG. 41, if the replacement recognition flag has been turned on, as determined in the step 2610, the CPU 101 turns off the toner end LED assigned to the color present at the replacing position (step 2611), and then executes the recovery operation with the color present at the replacing position (step 2612). It is to be noted that if the cartridge of the color located at the replacing position is in the toner near end condition, the CPU 101 turns off the toner near end LED. However, let the following description concentrate on the toner end LED.

If the replacement confirmation flag has been turned off, as determined in the step 2611, the CPU 101 executes the homing procedure and then ends the routine.

Figure 42:
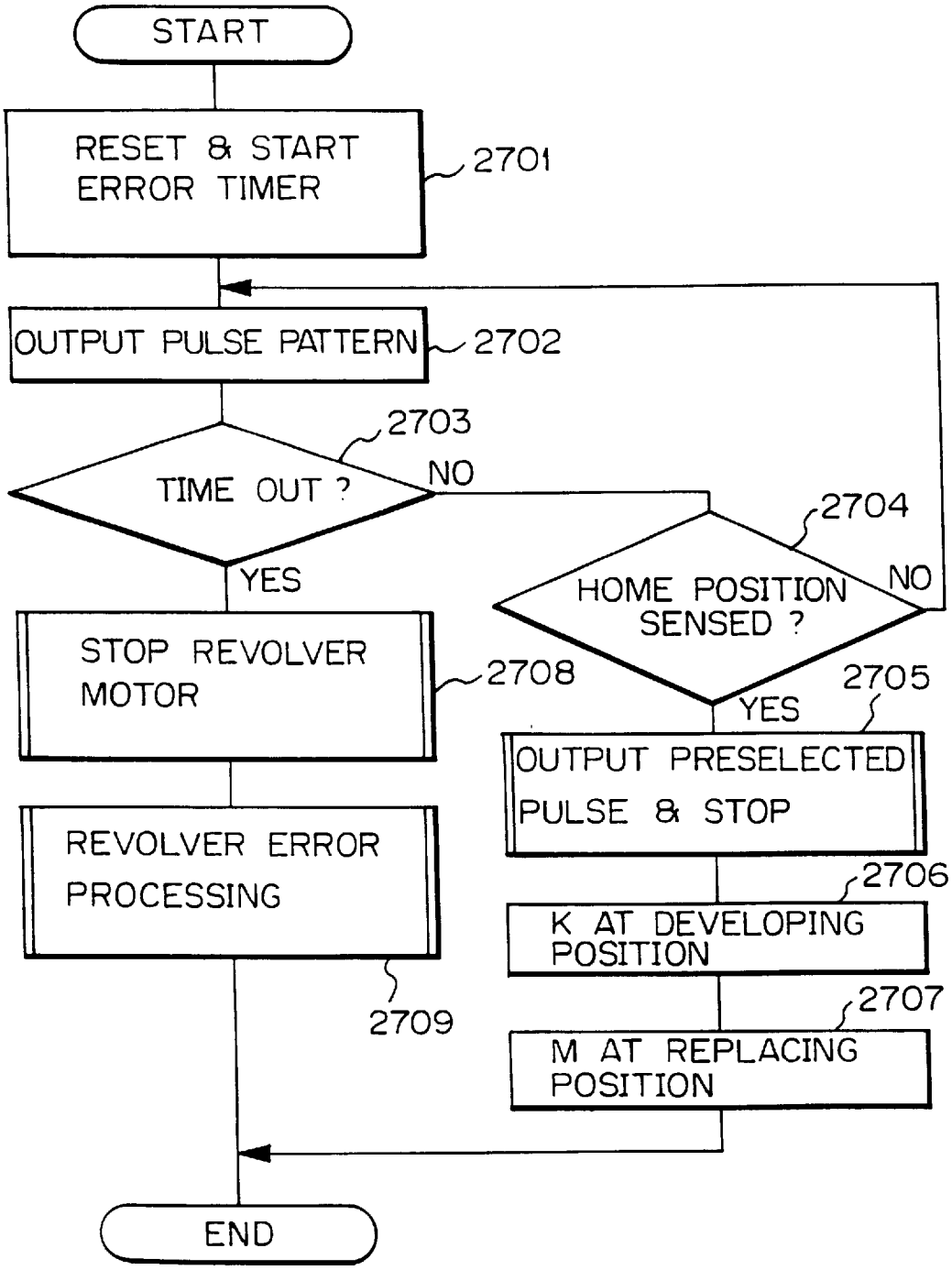
FIG. 42 is a flowchart showing homing processing included in the procedure of FIG. 41.

As shown in FIG. 42, use is made of the replacement recognition flag which is turned on on the change of the presence/absence of a cartridge indicated by the output of the cartridge sensor 143. The CPU 101 determines that the cartridge has been replaced when the presence/absence changes. Therefore, when the operator opens and closes the door without replacing any cartridge, the CPU 101 does not determine that the cartridge has been replaced.

As shown in the steps 2610–2612 of FIG. 41, on determining that the cartridge has been replaced, the CPU 101 turns off the toner end LED assigned to the color present at the replacing position, and then starts the recovery operation. This prevents the same cartridge from being repeatedly replaced, compared to the case wherein the above LED is continuously turned on during recovery operation and then turned off.

When the CPU 101 determines that a cartridge is absent in the step 2606 of FIG. 41, it displays the absence of a cartridge on the control panel and then ends the routine (step

2607), i.e., it does not advances to the homing of the step 2609 or the recovery of the step 2612. This inhibits the revolver from rotating and thereby prevents the toner remaining at the portion of the revolver joining the cartridge from flying about.

The cartridge sensor or reflection type photosensor 143 is located at the position where the cartridge is to be replaced. The problem with this type of sensor 143 is that when the gap between the adjacent cartridges arrives, the sensor 143 determines that a cartridge is absent due to the absence of a reflection. Assume that the revolver stops at a position where the sensor 143 faces the above gap due to, e.g., the accidental opening of the door. Then, the sensor 143 determines that a cartridge is absent when the door is closed again. In this condition, it is likely that the CPU 101 determines that a cartridge is absent in the step 2606 of FIG. 41, displays the absence of a cartridge on the control panel, and ends the routine (step 2607).

It is therefore preferable to determine, when the door is closed, whether the revolver has stopped while in rotation or whether it has stopped at its regular position, and to neglect the output of the sensor 143 if the stop of the revolver has occurred during rotation. This successfully prevents the rotation of the revolver from being inhibited based on the output of the sensor 143. In the illustrative embodiment, the inner cover 630 is configured such that the position of the revolver held in a halt is deviated even slightly from the replacing position, the inner cover 630 prevents the cartridge from being pulled out. Therefore, when the revolver stops while in rotation, no cartridges can be pulled out. It follows that the rotation of the revolver in the above condition occurs with all the cartridges mounted at all times, preventing the toner from flying about.

Figure 44A:
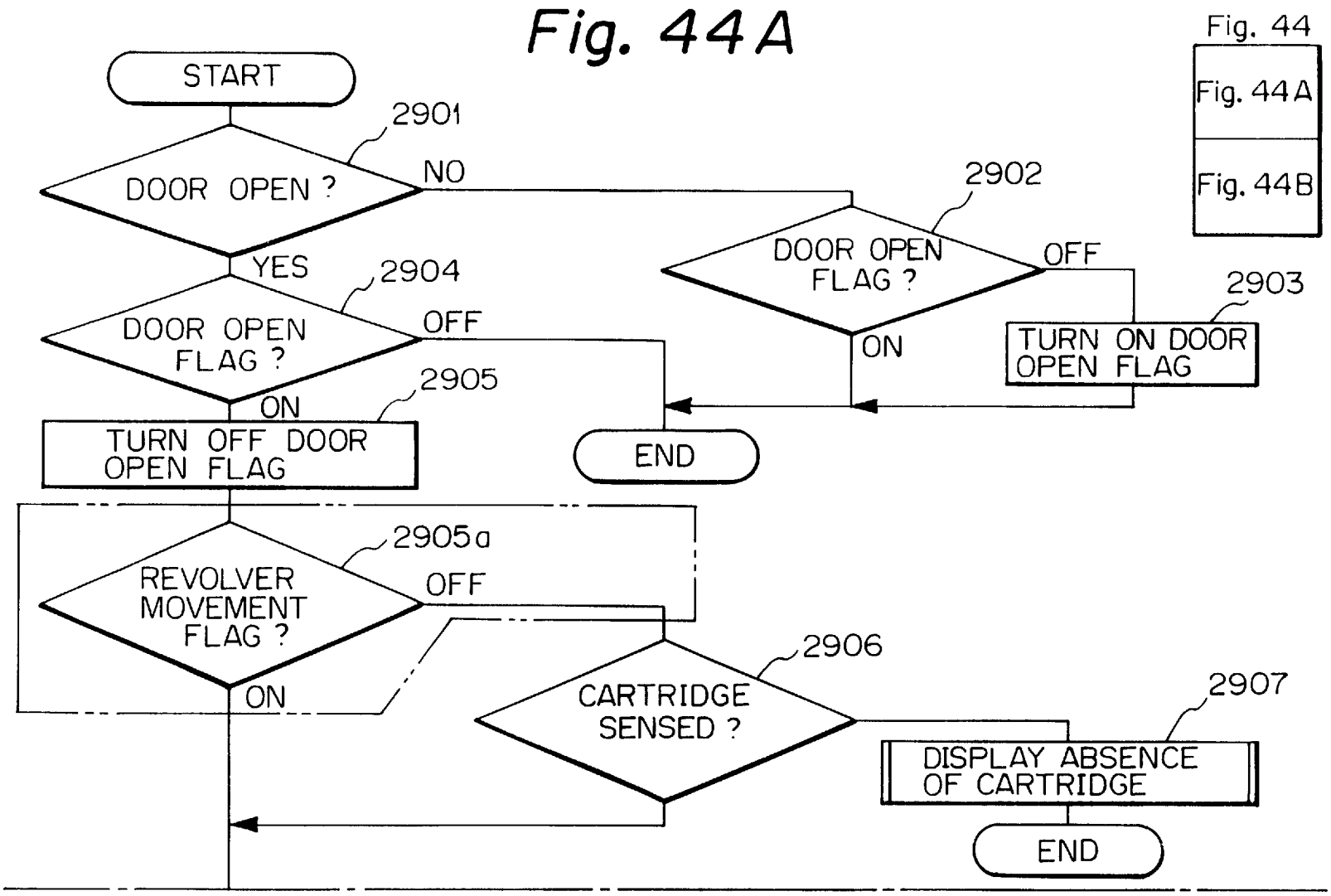
FIG. 44 is a flowchart showing another specific control procedure available with the eighth embodiment.
Figure 44B:
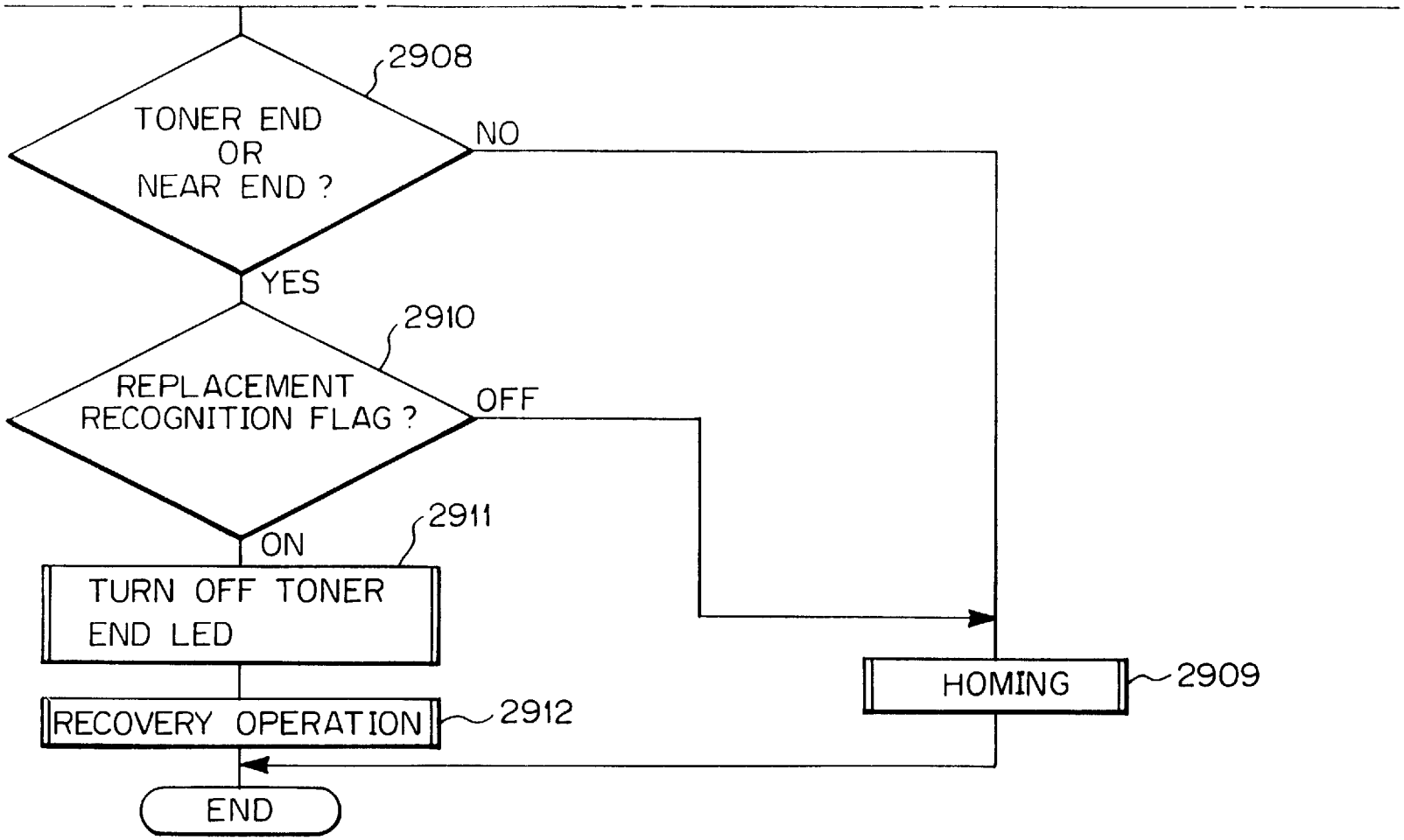

FIG. 44 demonstrates a specific procedure for determining whether the revolver has stopped while in rotation or whether it has stopped at its regular position. This procedure is similar to the procedure of FIG. 41 except for an additional decision step 2905*a* indicated by a dash-and-dots box. If the CPU 101 determines that the revolver has stopped at the regular position, i.e., that the revolver movement flag has been turned off (step 2905*a*), it advances to the step 1906 as in FIG. 41. If the CPU 101 determines that the revolver has topped while in rotation, i.e., that the revolver movement flag has been turn on (step 2905*a*), it determines that a cartridge is present and advances to the step 2908, skipping the step 2906.

Figure 45:
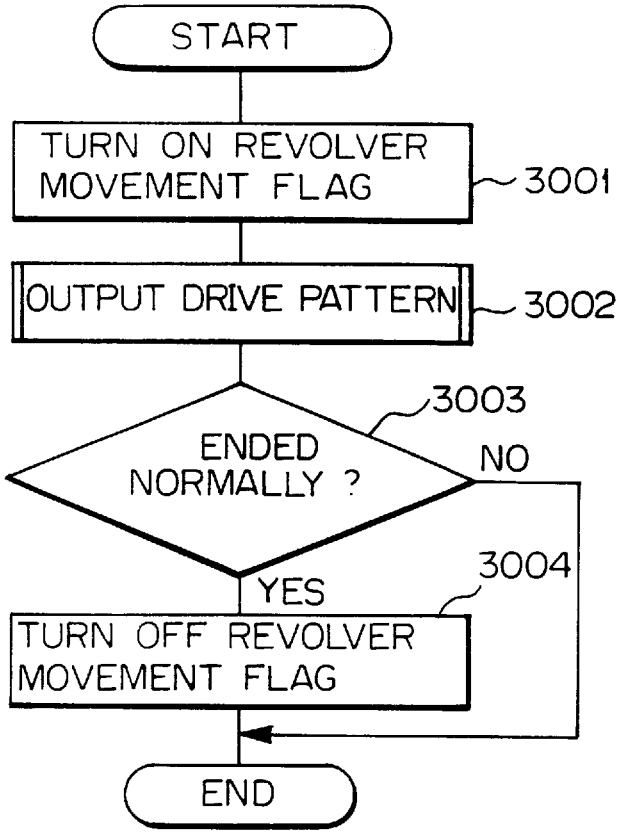

The above revolver movement flag is turned on and turned off by a specific procedure shown in FIG. 45. The procedure to be described is executed by the CPU 101 on the start of rotation of the revolver. As shown, at the beginning of rotation of the revolver, the CPU 101 turns on the revolver movement flag (step 3001) and sends a drive pattern to the revolver motor 113 (step 3002). Then, the CPU 101 determines whether or not the movement of the revolver has ended normally (step 3003). If the answer of the step 3003 is positive, the CPU 101 turns off the above flag (step 3004). At this instant, the colors are written to the RAM 103, FIG. 3. If the answer of the step 3003 is negative, e.g., if the revolver has stopped due to the accidental opening of the door, the CPU 101 ends the procedure immediately. This maintains the revolver movement flag turned off. Therefore, when the door is closed again, the CPU 101 can determine whether the revolver has stopped in its regular position or whether it has stopped while in rotation, by referencing the status of the revolver movement flag.

Figure 46:
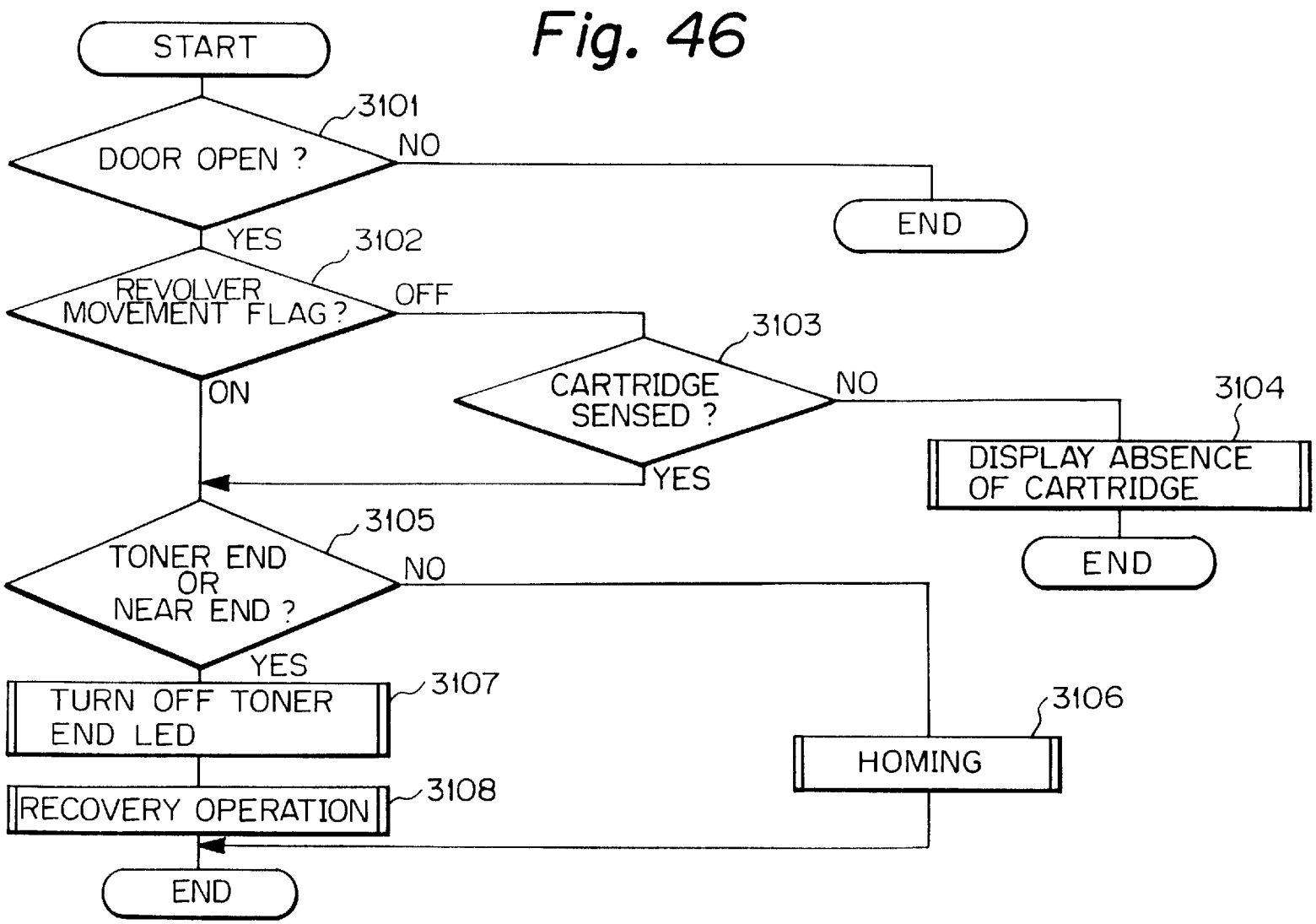

The revolver stops while in rotation not only when the door is opened during image formation, but also when the power switch of the printer is turned off during image formation. This is also apt to cause the CPU 101 to determine, on the turn-on of the power switch, that a cartridge is absent, and thereby maintain the printer inoperative. FIG. 46 shows a specific procedure for eliminating this problem.

As shown in FIG. 46, when the power switch is turned on, the CPU 101 determines whether or not the door of the printer body is closed by referencing the output of the door switch 144, FIG. 4, (step 3101). If the door is open, the CPU 101 ends the procedure. If the door is closed, the CPU 101 references the revolver movement flag. in this specific procedure, data relating to the status of the revolver movement flag is written to the RAM 103, FIG. 3, in order to hold it even when the power switch is turned off. If the above flag has been turned off, i.e., if the revolver has been stopped at its regular position, the CPU 101 determines whether or not a cartridge is present (step 3103). If the flag has been turned on, i.e., if the revolver has stopped while in rotation, the CPU 101 determines that a cartridge is present, and then executes a step 3105, skipping the step 3103. in the step 3105, the CPU 101 determines whether or not the color present at the replacing position is in the toner end or toner near end condition.

In the step 3103, the CPU 101 determines whether or not a cartridge is present at the replacing position by referencing the output of the cartridge sensor 143, FIG. 12, (step 3102). If a cartridge is absent at the replacing position, the CPU 101 displays the absence of a cartridge on the control panel (step 3104). If a cartridge is present, the CPU 101 determines whether or not the color at the replacing position is in the toner end or toner near end condition (step 3105).

If the color at the replacing position is not in the toner end or toner near end condition, as determined in the step 3105, the CPU 101 executes the homing procedure (step 3106) and then ends the routine. If the color at the replacing position is in the toner end or toner near end condition, the CPU 101 turns off the toner end (or toner near end) LED assigned to the color (step 3107), and then executes the recovery operation with the color present at the replacing position, i.e., the color located at the replacing position before the turn-off of the power switch (step 3108).

In the illustrative embodiment, if the color at the replacing position is in the toner end or toner near end condition when the power switch is turned on, the CPU 101 executes the recovery operation, assuming that a cartridge has been replaced while the power switch has been turned off. Alternatively, the CPU 101 may additionally reference the replacement recognition flag (see FIG. 41) as to the cartridge of the color located at the replacing position, and execute the recovery operation only if the flag has been turned on. In this case, data relating to the replacement recognition flag is written to the RAM 103 in the same manner as the data relating to the revolver movement flag.

When the specific procedure shown in FIG. 44 or 46 is adopted, the revolver movement flag held in its ON state may be turned off when the rotation of the revolver due to the homing or recovery processing ends normally.

The following advantages are achievable with the above embodiment.

(1) Reporting means for urging the operator to replace a toner cartridge ends urging the operator to replace a toner cartridge, without waiting for the end of a recovery operation every time it is determined that a cartridge has been replaced. This prevents a cartridge associated with any developing section from being repeatedly replaced.

(2) While a cartridge is absent, moving means for moving the cartridge is inhibited from operating. This prevents the movement means from operating while a cartridge is absent. Otherwise, toner is apt to fly about from a portion where the cartridge joins a toner outlet.

(3) When a door or cover member is closed and if the cartridges have stopped while in rotation, as determined on the basis of information stored in storing means, the output of cartridge sensing means responsive to the closing of the door is neglected. Therefore, even when no cartridges are located at a preselected position assigned to the cartridge sensing means despite that all the toner containers are present, i.e., when the output of the cartridge sensing means is erroneous, control based on the output of the sensing means is obviated.

(4) Assume that when a power switch is turned on, the switch is determined, based on the above information, to have been turned off while the above movement has been under way. Then, the output of the cartridge sensing means appearing in the above position of the cartridges is neglected. Therefore, even when no cartridges are located at the preselected position assigned to the cartridge sensing means despite that all the toner containers are present, i.e., when the output of the cartridge sensing means is erroneous, control based on the output of the sensing means is obviated.

(5) Whether or not the cartridge has been replaced is determined on the basis of a change in the presence/absence of the cartridge represented by the output of the cartridge sensing means. This prevents the cartridge from being determined to have been replaced when the operator opens and closes the door without replacing any cartridge.

Various modifications will become possible for those skilled in the art after receiving the teachings of the present disclosure without departing from the scope thereof.

What is claimed is:

1. An image forming apparatus comprising:

a plurality of developing sections supported to be movable integrally with each other;

a plurality of toner cartridges respectively removably mounted to said plurality of developing sections, and each storing toner to be replenished to the respective developing section, wherein only one of said plurality of toner cartridges located at a preselected replacing position is replaceable;

searching means for searching said plurality of toner cartridges in accordance with a preselected priority for at least one of said plurality of toner cartridges needing replacement;

moving means for moving preselected one of said plurality of toner cartridges to said replacing position; and control means for causing, at an end of image formation, said searching means to search for the toner cartridge needing replacement, and causing said moving means to move said toner cartridge needing replacement to said replacing position;

wherein when said searching means detects at least two of said plurality of toner cartridges needing replacement and if one of said at least two toner cartridges is located at said replacing position, said control means inhibits said moving means from moving said plurality of toner cartridges.

2. An image forming apparatus comprising:

a plurality of developing sections supported to be movable integrally with each other;

a plurality of toner cartridges respectively removably mounted to said plurality of developing sections, and each storing toner to be replenished to the respective developing section, wherein only one of said plurality of toner cartridges located at a preselected replacing position is replaceable;

color mode receiving means for receiving an input of any one of a plurality of color modes each designating a particular color;

searching means for searching for at least one of said plurality of toner cartridges needing replacement;

moving means for moving preselected one of said plurality of toner cartridges to said replacing position; and control means for causing, when said color mode receiving means receives the input of preselected one of said plurality of color modes, said searching means to search for one of the toner cartridges to be used in the color mode input, and causing said moving means to move the toner cartridge searched for to said replacing position.

3. An apparatus as claimed in claim 2, wherein said searching means searches said plurality of toner cartridges in accordance with preselected priority.

4. An apparatus as claimed in claim 3, wherein when said searching means detects at least two of said plurality of toner cartridges needing replacement and if one of said at least two toner cartridges is located at said replacing position, said control means inhibits said moving means from moving said plurality of toner cartridges.

5. An apparatus as claimed in claim 3, wherein while said toner cartridge searched for is in movement toward said replacing position, said control means invalidates the input of the preselected color mode received by said color mode replacing means.

6. An apparatus as claimed in claim 2, wherein when said searching means detects at least two of said plurality of toner cartridges needing replacement and if one of said at least two toner cartridges is located at said replacing position, said control means inhibits said moving means from moving said plurality of toner cartridges.

7. An apparatus as claimed in claim 6, wherein while said toner cartridge searched for is in movement toward said replacing position, said control means invalidates the input of the preselected color mode received by said color mode replacing means.

8. An apparatus as claimed in claim 2, wherein when said color mode receiving means receives a same color mode repeatedly, said control means causes said moving means to sequentially move the toner cartridges searched for by said searching means to said replacing position.

9. An apparatus as claimed in claim 8, wherein while said toner cartridge searched for is in movement toward said replacing position, said control means invalidates the input of the preselected color mode received by said color mode replacing means.

10. An apparatus as claimed in claim 2, wherein while said toner cartridge searched for is in movement toward said replacing position, said control means invalidates the input of the preselected color mode received by said color mode replacing means.

11. An image forming apparatus comprising:

a plurality of developing sections supported to be movable integrally with each other;

a plurality of toner cartridges respectively removably mounted to said plurality of developing sections, and each storing toner to be replenished to the respective developing section; and recovery executing means for restoring a toner content of any one of said plurality of developing sections to a preselected toner content;

wherein after at least two of said plurality of toner cartridges have been replaced, a recovery operation is continuously executed with said at least two developing sections.

12. An apparatus as claimed in claim 11, wherein said recovery executing means executes said recovery operation continuously only with the developing sections whose toner cartridges have been replaced.

13. An apparatus as claimed in claim 12, wherein said recovery operation consists of preprocessing, recovery processing, and postprocessing, and wherein when said recovery operation is to be continuously executed with said at least two developing sections, said recovery executing means executes said preprocessing, then executes said recovery processing with said at least two developing sections continuously, and then executes said postprocessing.

14. An apparatus as claimed in claim 13, wherein image formation is inhibited until said recovery executing means ends said recovery operation.

15. An apparatus as claimed in claim 11, wherein wherein said recovery operation consists of preprocessing, recovery processing, and postprocessing, and wherein when said recovery operation is to be continuously executed with said at least two developing sections, said recovery executing means executes said preprocessing, then executes said recovery processing with said at least two developing sections continuously, and then executes said postprocessing.

16. An apparatus as claimed in claim 11, wherein image formation is inhibited until said recovery executing means ends said recovery operation.

17. An image forming apparatus comprising:

a plurality of developing sections supported to be movable integrally with each other;

a plurality of toner cartridges respectively removably mounted to said plurality of developing sections, and each storing toner to be replenished to the respective developing section; and recovery executing means for restoring a toner content of any one of said plurality of developing sections to a preselected toner content;

wherein only one of said plurality of toner cartridges located at a preselected replacing position is replaceable, and wherein in the event of power-up of said apparatus, said recovery executing means executes said recovery operation only with the developing section corresponding to the toner cartridge located at said replacing position.

18. An image forming apparatus including a plurality of toner cartridges respectively removably mounted to a plurality of developing sections, and each storing toner to be replenished to the respective developing section, said apparatus comprising:

reporting means for urging an operator of said apparatus to replace any one of said plurality of toner cartridges;

recovery control means for causing a preselected recovery operation to occur for replenishing the toner to any one of said plurality of developing sections; and control means for causing, without waiting for an end of said recovery operation, said reporting means to stop producing a report associated with the toner cartridge determined to have been replaced.

* * * * *